US005660635A

United States Patent [19]

Jacques

[11] Patent Number: 5,660,635

[45] Date of Patent: Aug. 26, 1997

[54] NOZZLE FOR A MATERIAL DELIVERY SYSTEM

[76] Inventor: Carol Jacques, 35 Federal St., Walpole, Mass. 02081

[21] Appl. No.: 513,075

[22] Filed: Aug. 9, 1995

Related U.S. Application Data

[63] Continuation-in-part of Ser. No. 331,284, Oct. 28, 1994, Pat. No. 5,531,584.

[51] Int. Cl.[6] ..... B05B 3/02; B05B 3/18

[52] U.S. Cl. ..... 118/323; 425/447; 425/449; 239/592; 239/598

[58] Field of Search ..... 425/145, 135, 425/149, 186, 221, 90, 92, 104, 258, 447, 449; 118/201, 256, 258, 323, 308; 264/DIG. 72; 239/598, 592, 593, 594

[56] References Cited

U.S. PATENT DOCUMENTS

| | | | |
|---|---|---|---|
| 2,674,117 | 4/1951 | Butler . | |
| 2,965,312 | 12/1960 | Hale | 239/407 |
| 3,902,669 | 9/1975 | Keibler | 118/323 |
| 4,298,555 | 11/1981 | Weltmer | 264/31 |
| 4,411,389 | 10/1983 | Harrison | 239/427.5 |
| 4,417,542 | 11/1983 | Bellafiore | 118/323 |
| 4,501,223 | 2/1985 | Matsuno et al. | 118/323 |
| 4,545,156 | 10/1985 | Hockett | 118/323 |
| 4,796,814 | 1/1989 | Klemm et al. | 239/430 |
| 4,865,887 | 9/1989 | Virtanen | 118/323 |
| 5,061,115 | 10/1991 | Godbersen | 404/112 |
| 5,240,503 | 8/1993 | Levy et al. | 118/323 |
| 5,366,164 | 11/1994 | Jagiella et al. | 239/600 |
| 5,531,584 | 7/1996 | Jacques | 425/221 |

*Primary Examiner*—Khanh P. Nguyen
*Attorney, Agent, or Firm*—Weingarten, Schurgin, Gagnebin & Hayes LLP

[57] ABSTRACT

A nozzle for application of fluent material to a receiving surface. The nozzle allows for introduction of compressed air at locations along the length of the nozzle via multiple sets of plural air conduits. Individual conduits are angled toward a nozzle outlet. Further disclosed is the nozzle in an automated finish material delivery system capable of multi-dimensional translation along the receiving surface. The System nozzle can also be angled With respect to the receiving surface. A controller manages the operation of the delivery system. A tracked vehicle carries the controller, an air compressor, a pump, a generator, and a hoist. A number of sensors provide feedback regarding the operating condition of the system.

61 Claims, 53 Drawing Sheets

NOZZLE FOR A MATERIAL DELIVERY SYSTEM

RELATED APPLICATION

This application is a continuation-in-part of U.S. patent application Ser. No. 08/331,284, filed Oct. 28, 1994 now U.S. Pat. No. 5,531,584.

FIELD OF THE INVENTION

The present invention relates to a nozzle and a material delivery system for applying fluent material to a wall, and specifically to such a nozzle and material delivery system operative on a frame providing multi-dimensional motion proximate a wall.

BACKGROUND OF THE INVENTION

Nozzles used to apply fluent material such as concrete, mortar or the like typically include a cylindrical housing through which the material is pumped, sped by the introduction of compressed air at one location along the nozzle. In order to further increase the speed of the material as it leaves the nozzle, a converging region is typically employed to increase the pressure within the material just prior to a nozzle exit port, resulting in a frusto-conical chamber. The resultant material distribution after exiting the nozzle is highly concentrated along an axis defined by the cylindrical nozzle. Such a concentrated distribution is necessary for applications where the nozzle projects the material at high speeds more than a minimal distance onto a surface to be covered.

Typical situations in which such nozzles are employed involve application of fluent material to a wall by manual manipulation of the nozzle, much akin to the direction of a stream of water by a fire fighter. In typical construction situations, these material applications must cover walls of twenty feet in height, or more. It is difficult to provide a consistent depth of concrete over a significant portion of the wall using such a manually operated and directed nozzle. In pursuit of a consistent application of fluent material to a desired depth on all portions of a wall surface, it is necessary to manually manipulate the nozzle such that a significant amount of overlap occurs. This results in over-application of fluent material at most regions and therefore the wasting of the over-applied material. This further necessitates an involved procedure for removal of the excess.

It is common practice to employ teams of manual laborers to draw trowels, sometimes of considerable size, over such manually over-applied surfaces of concrete or plaster. In situations involving high walls, scaffolding or hydraulic lifts must be provided to enable such hand trowelling. This practice is quite obviously time consuming and labor-intensive, and therefore expensive, while still posing a challenge in the provision of even finishes over large surfaces.

Therefore, presently available nozzles and material delivery systems fail to provide an even distribution of fluent material at a nozzle exit along at least one dimension. Further, these nozzles require inaccurate manual manipulation, resulting in inefficient application of the fluent material on a wall surface and necessitating time-consuming and expensive removal of excess.

SUMMARY OF THE INVENTION

The present invention provides a nozzle for the application of fluent material to a receiving surface such as a wall in a new building. The instant nozzle allows for the introduction of compressed air at at least two locations along the length of the nozzle via sets of plural air conduits. This configuration promotes an even distribution of fluent material from a nozzle outlet end, resulting in an even application of material on the receiving surface. One or both of the two conduit sets are further adapted for the introduction of particulate matter into the fluent material stream, including accelerant for promoting more rapid setting of material such as concrete. Additionally, the individual conduits are angled toward the nozzle outlet end to accelerate the material within the nozzle, resulting in an even distribution of material at the nozzle outlet.

The present invention further provides such a nozzle disposed in an automated finish material delivery system for providing an even application of finish material to one or both sides of a wall. Contrary to prior art material delivery means, the present system provides required coverage on the target surface quickly, with minimal application overlap, and consequently with minimized waste. Manual intervention is minimized as well, resulting in significant cost savings and increased consistency of result.

Horizontal brackets along upper and lower edges of the wall to be finished provide support to a vertical support column which is capable of horizontal translation along the brackets. The nozzle is adapted for vertical translation along the column. A first source of motive power in cooperation with the horizontal brackets propels the support column and associated nozzle laterally along the length of the wall, while a second source of motive power is coupled to the nozzle for effecting the vertical translation. A third source of motive power enables the angulation of the nozzle with respect to the receiving surface as the nozzle translates vertically, thus resulting in a more consistent application of material.

In alternative embodiments of the present material delivery system, the brackets and column are adapted for enabling translation of the nozzle proximate a non-planar surface to be covered. Further, one alternative embodiment provides the ability to adapt the height of travel of the material delivery system, depending upon the height of the target wall.

A controller, such as an automated processor having associated memory and algorithms, manages the operation of the material delivery system. In one embodiment, the controller is disposed on a tracked vehicle along with an air compressor connected to the nozzle, a pump supplying the fluent material to the nozzle, and a generator for powering the pump and controller. The vehicle proceeds proximate the automated finish material delivery system.

A number of sensors provide feedback regarding the operating condition of the system, including the physical location of the system along the wall to be finished and the status of the finish material supply.

The present system in a first embodiment is able to work cooperatively with an automated trowelling system as disclosed and claimed in the aforementioned related application.

Thus, the presently disclosed invention provides an improved nozzle for fluent material application, and a system and method for efficient application of fluent material onto a receiving surface.

BRIEF DESCRIPTION OF THE DRAWINGS

These and other features of the present invention are more fully set forth below in the fully exemplary detailed description and accompanying drawings of which.

DETAILED DESCRIPTION

Figure 1:
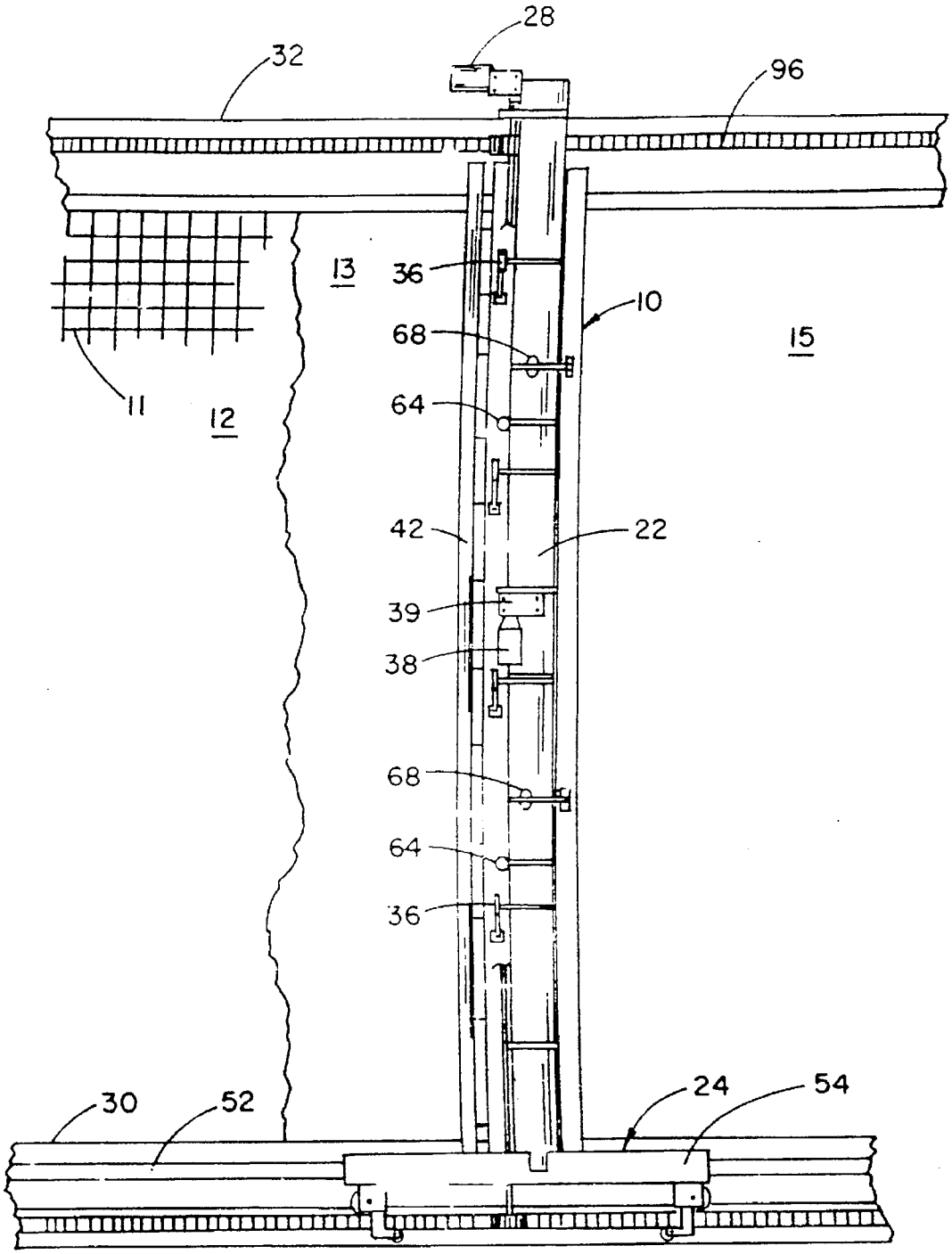
FIG. 1 is a front view of an automated trowelling system according to the present invention in an illustrative environment.

With reference first to FIG. 1, an automated trowelling system 10 according to the present invention operates proximate a planar, vertical wall to be finished 12 (only partially illustrated) along both horizontal and vertical axes to provide a desired surface texture and appearance to fluent material which has been applied to the wall 12. In FIG. 1, three regions of a wall are illustrated. In a first region 11, no finishing material has been applied. In a second region 13, finishing material has been applied, for instance by a manually operated spray gun, but the material has not been finished to provide a smooth surface. Finally, in a third region 15, the trowelling system 10 according to the present invention has provided the material with a smooth finish.

Figure 2:
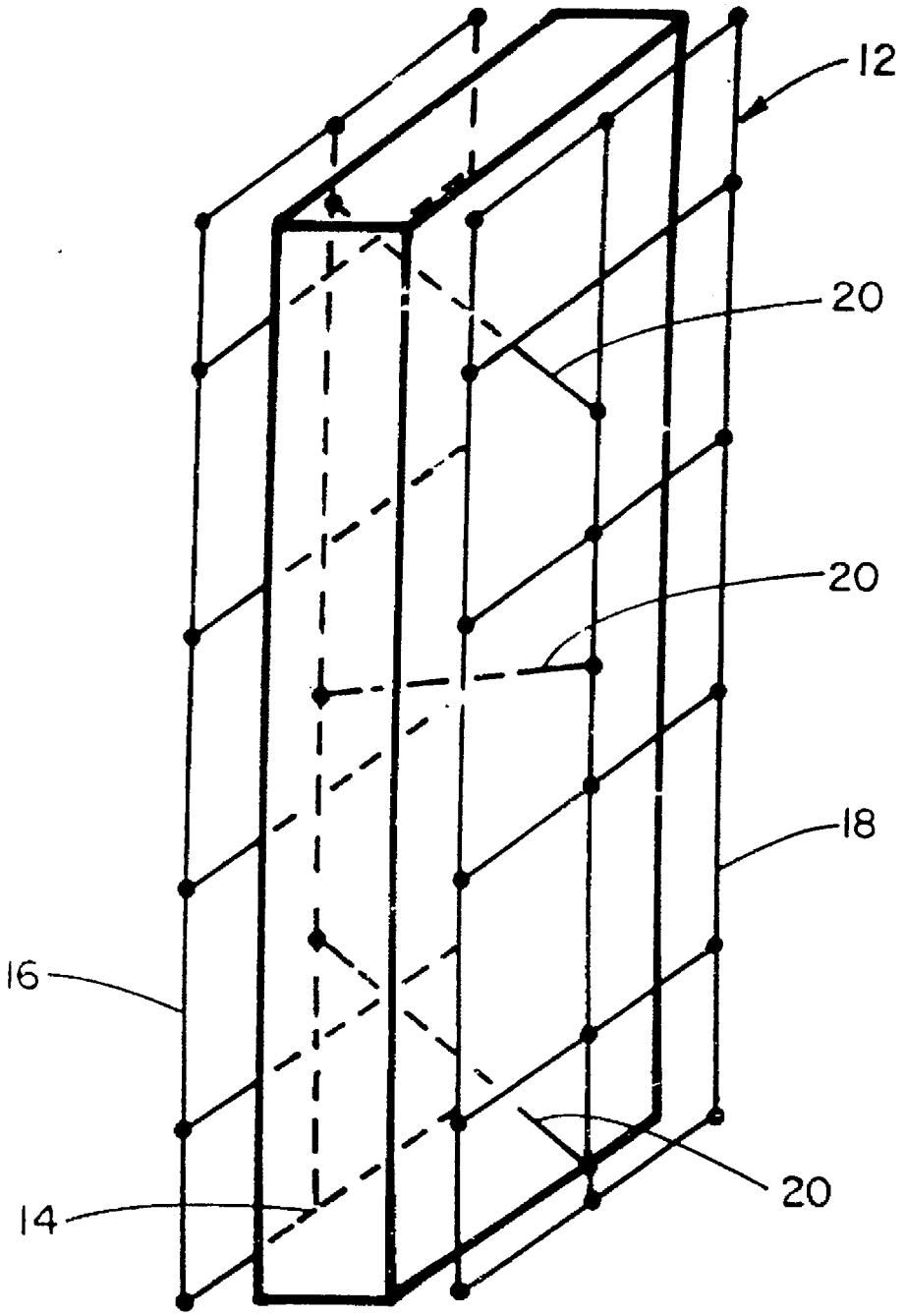
FIG. 2 is a perspective view of a portion of a wall system on which the trowelling system of FIG. 1 is employed.

As better illustrated in FIG. 2, the wall to be finished 12 can be a composite wall system comprised of a central core 14 of styrofoam or other lightweight, insulative material, sandwiched between identical wire grid screens 16, 18. Typical dimensions for the composite wall 12 components are a four inch thickness for the styrofoam central core 14 and an inch between each grid 16, 18 and the central core 14. Another set of typical dimensions are a central core 14 of two and a half inches, and two-thirds of an inch on either side of the central core 14 to each grid 16, 18. Further variations are possible, depending on the geographic location of the construction site, whether the wall to be constructed has an exterior exposure, and on the material used for the central core 14 and the grid 16, 18, among other considerations.

In the illustrated embodiment of FIG. 2, lateral support is provided to the wall 12 by cross members 20. These members 20 extend between the respective grids 16, 18, through the central core 14. The number of cross members 20 also depends upon various load-bearing requirements. The composite wall 12 of FIG. 2 can be any of a variety of heights, including twenty feet, a common measurement in many current construction settings. Further, composite wall panels such as that illustrated can be provided in standard or custom lengths, or can be easily custom cut at the construction site.

Figure 5:
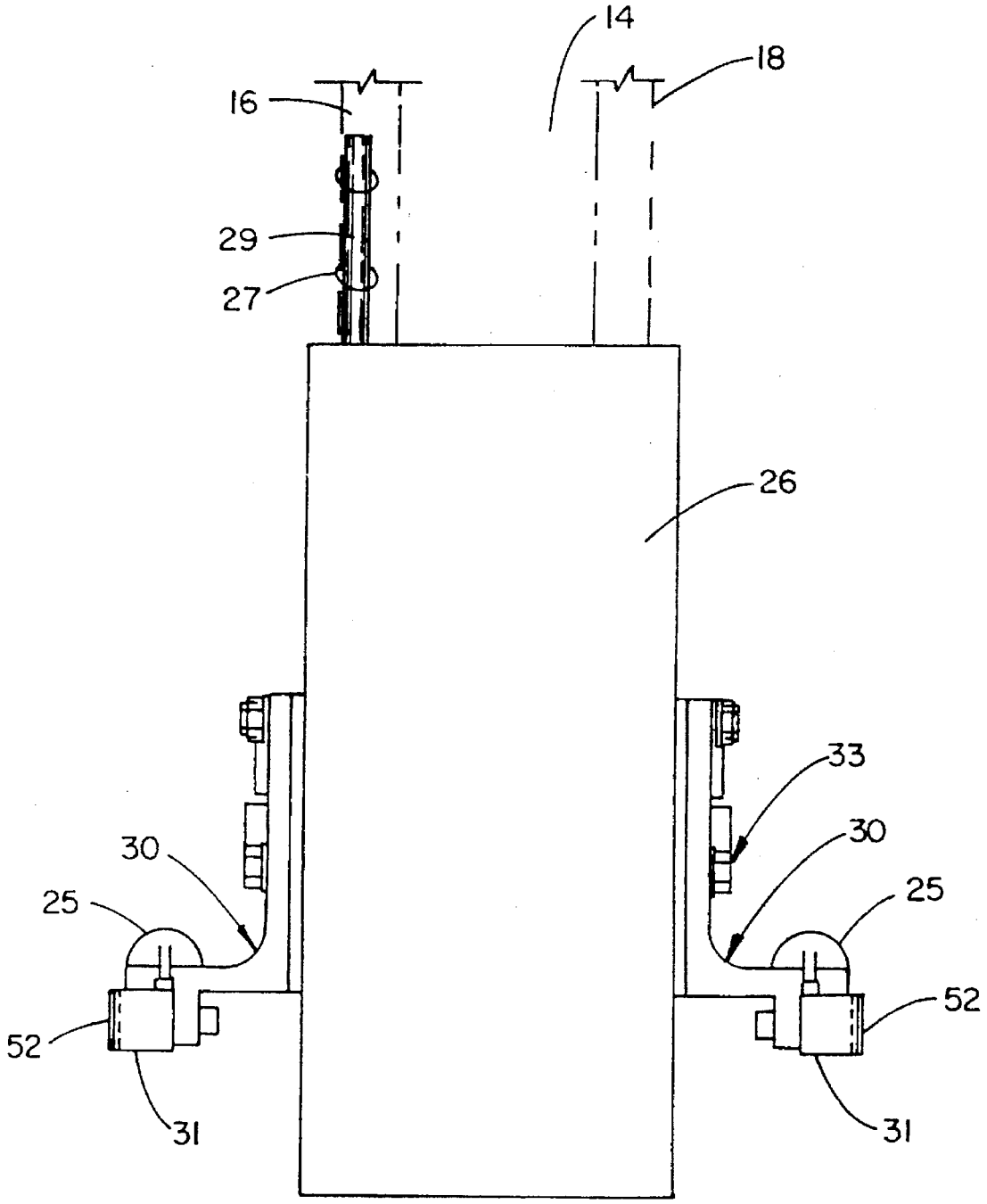
FIG. 5. is a cross-sectional view of a lower section of the wall system of FIG. 2 mounted on a footer.

As shown in FIG. 5, each wall system 12 panel is attached to a footer 26 which is typically twenty-four inches tall. The footer is commonly poured concrete. The attachment of the wall system 12 is achieved by a plurality of vertical rods 29 extending from the footer 26 such that when the wall system 12 is put in place on the footer 26, the rods 29 are just within the wire grid screen 16 and extend vertically along a lower portion of the screen 16. Thereafter, fastening means 27 such as lengths of wire, commonly referred to as tie wires, are employed to bind the wire grid screen 16 to the rods 29. A plurality of these rods 29 extends along the horizontal length of the footer 26 at regular intervals. Note that while the rods 29 are illustrated to the left-most screen 16, they could also be attached to the right-most screen 18, or to both screens 16, 18.

In the construction of a concrete wall employing the automated trowelling system 10 of the present invention, the above described wall system 12 is desirable in that it is highly insulative, sound dampening, light, and easy to fabricate and place at a work site. However, the trowelling system 10 of the present invention can also be used to finish plaster or other surface coatings on a flat wall surface, on lath, or to any other wall reinforcement structure such as wire screens (e.g. chicken wire) or reinforcing metal bars (known as rebars). A requisite of the wall to be finished is that it is capable of supporting the finishing material as the trowelling system cuts off excess and smooths the remaining material.

Having described a wall structure 12 on which the present invention operates, the trowelling system 10 itself will now be described in detail. Note that variations in exact dimensions and embodiments can be made while still providing the basic elements of the present automated trowelling system 10. Note further that the present trowelling system 10 operates on a wall structure 12 once concrete or other fluent material has been applied by Conventional means, such as by use of a manually operated spray gun, or by other specialized means.

The automated trowelling system 10 is comprised of several main components, as described again with respect to FIG. 1. Further details of the various components of the trowelling system 10 are described with respect to the remaining figures. A vertical support column 22 extends between a lower brace 24 and an upper mounting plate 98 (visible in FIG. 8), proximate and parallel to the wall 12. The entire trowelling system 10 is moved laterally (to the left in the illustrated embodiment of FIG. 1), proximate the wall 12, suspended between lower and upper brackets 30, 32. A first motor 28 provides the power for moving the trowelling system 10 laterally. The brackets 30, 32 are attached to the wall 12 (either the composite wall illustrated in FIG. 2 or another form of wall) as described in further detail below, and extend the length of the wall 12.

A main trowel 34 is attached to the vertical support column by way of multiple reel springs 36. A second motor 38 is connected through linkage 40 to the main trowel 34 and imparts vertically reciprocating motion to the main trowel 34. The reel springs 36 each provide a metal band wound about a spring biased shaft within the reel housing such that when an end of the metal band is extended away from the reel, an increasing tendency to retract is experienced. In the illustrative embodiment of the present system shown in FIG. 1, four pairs of reel springs are disposed along the height of the vertical support column 22, though it is preferred that five such pairs be employed. Each metal band free end is attached to the main trowel 34, such that the reel springs tend to counterbalance the main trowel 34, enabling vertical reciprocal motion of the main trowel 34 using only a small second motor 38. In alternative embodiments of the present invention, the reel-springs are replaced with springs, compressed air cylinders, or the like, each tending to urge the main trowel 34 back to a neutral vertical position, and thus assisting in the reciprocating motion imparted by the second motor 38. Other configurations are possible, including the use of one reel-spring or other resilient member at each location, depending upon the height of the vertical support column 22, the finishing material to be smoothed, and the type of resilient members 36 chosen.

A forward scoop 42 is mounted on the main trowel 34. As the trowelling system 10 moves laterally along the wall 12, excess wall finishing material (e.g. concrete) is removed by the forward scoop 42, and is channeled to the floor beneath the lower brace 24. Typically, the forward scoop 42 removes all but ⅛inch of excess material. The remaining excess is compacted by the reciprocating motion of the main trowel 34. Thus, the main trowel 34 not only smooths the wall finishing material, but also provides a higher degree of compaction, resulting in a more dense layer of finishing material with less trapped air.

A finish trowel 44 is also provided on the trowelling system 10. This trowel 44 is attached directly to the vertical support column 22 and does not vertically reciprocate with the main trowel 34. Rather, as the system 10 moves laterally, the vertically stationary finish trowel 44 serves to smooth any periodic patterns which may be produced by the motion of the main trowel 34. Note that in an alternative embodiment of the automated trowelling system 10 of the present invention, the finishing trowel 44 has a textured surface for creating patterns in the fluent material as the finish trowel 44 is drawn across it. Further, the planar finish trowel 44 can be replaced with a cylindrical roller having a pattern cut into it for the creation of a repetitive pattern on the finished wall 12.

Figure 3:
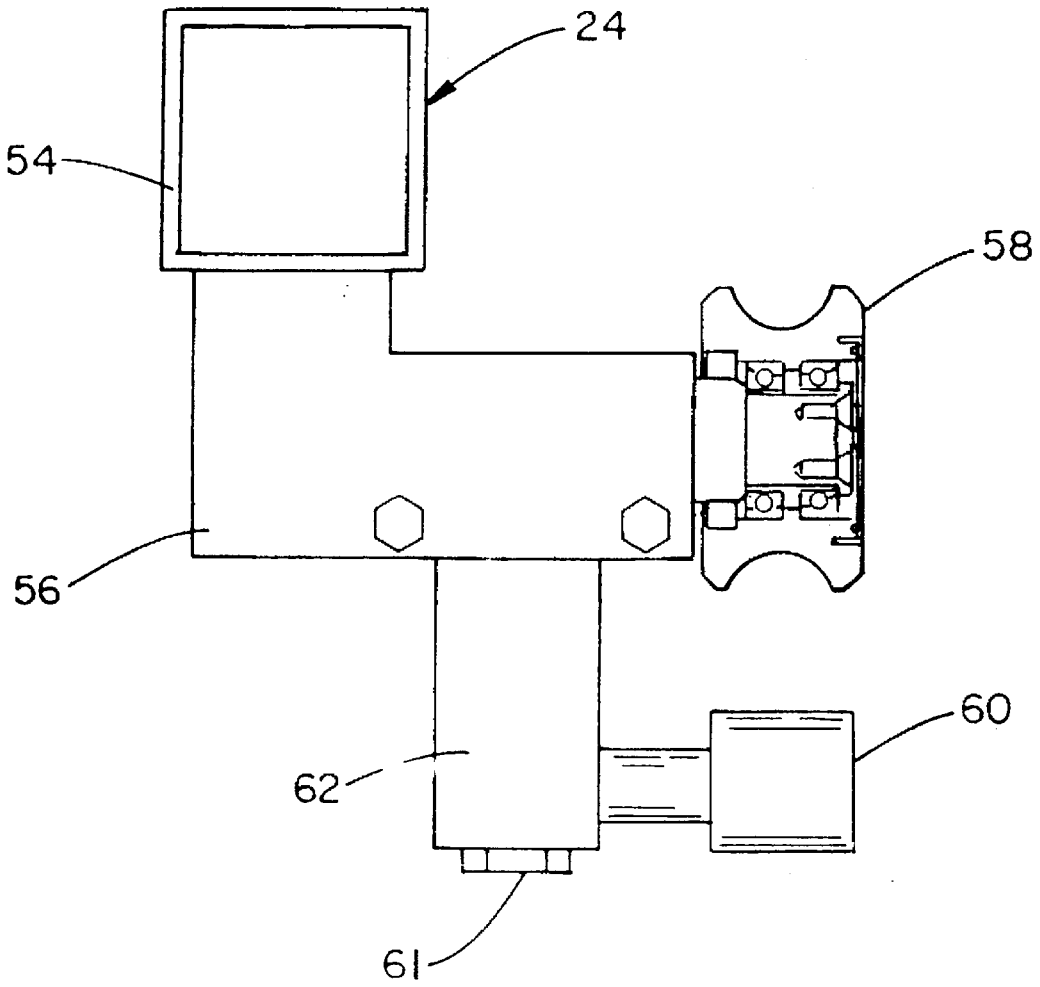
FIG. 3 is a side view of a lower brace of the trowelling system of FIG. 1.
Figure 4:
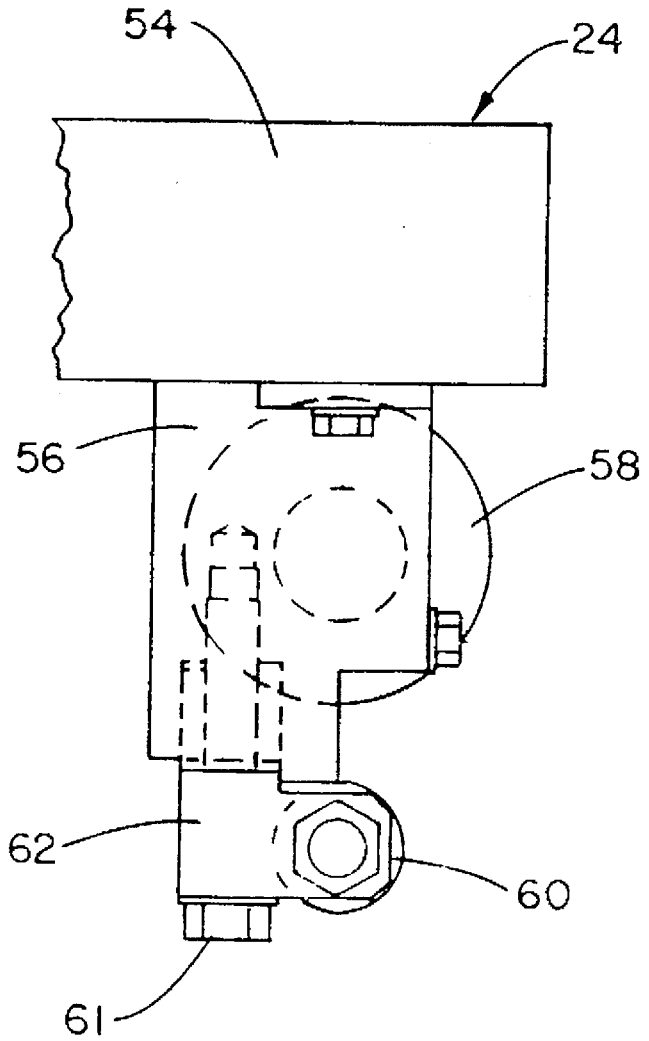
FIG. 4. is a rear view of one end of the lower brace of FIG. 3.

An end view and a front view of one end of the lower brace 24 of the trowelling system 10 are illustrated in FIGS. 3 and 4, respectively. The lower brace 24 has a horizontal member 54 which extends the length of the lower brace 24. Extending from a lower surface of the horizontal member 54 at each end thereof is a lower wheel support 56. Each of the lower supports 56 has a lower wheel 58 disposed thereon, such that the entire automated trowelling system is supported from below by the two lower wheels 58, which ride on a cooperating ridge 25 formed in the lower bracket 30 as shown in FIG. 5.

Further provided on the lower wheel support 56 is a lower follower wheel support 62 having a lower follower wheel 60 extending there from. The lower follower wheel 60, disposed below each respective lower wheel 58, is brought into contact or into close proximity with an underside 31 of the cooperating ridge 25 by the manipulation of a lower follower wheel adjustment screw 61. This prevents the lower wheel 58, and therefore the entire automated trowelling system 10, from becoming disengaged from the cooperating ridge 25 of the lower bracket 30.

If the wall to be finished 12 is of the wire grid-styrofoam composite type discussed with respect to FIG. 2, both sides of the wall 12 will need an application of finishing material, and thus will require use of the trowelling system 10 of the present disclosure. In order to increase efficiency, it is preferred, though not necessary, to attach lower brackets 30 to both sides of the footer 26 prior to commencing work on a first side. In FIG. 5, a number of lower bracket screws 33 are visible, and are distributed along the lower bracket as required based upon the load expected to be supported by the lower bracket 30 as a result of the movement of the trowelling system 10 or any other equipment utilizing the bracket 30. Consecutive sections of lower brackets 30 can joined by use of connecting plates (not shown) which are rigidly affixed to the brackets 30 thus enabling smooth progression of the wall system 10 along the wall 12.

Figure 6:
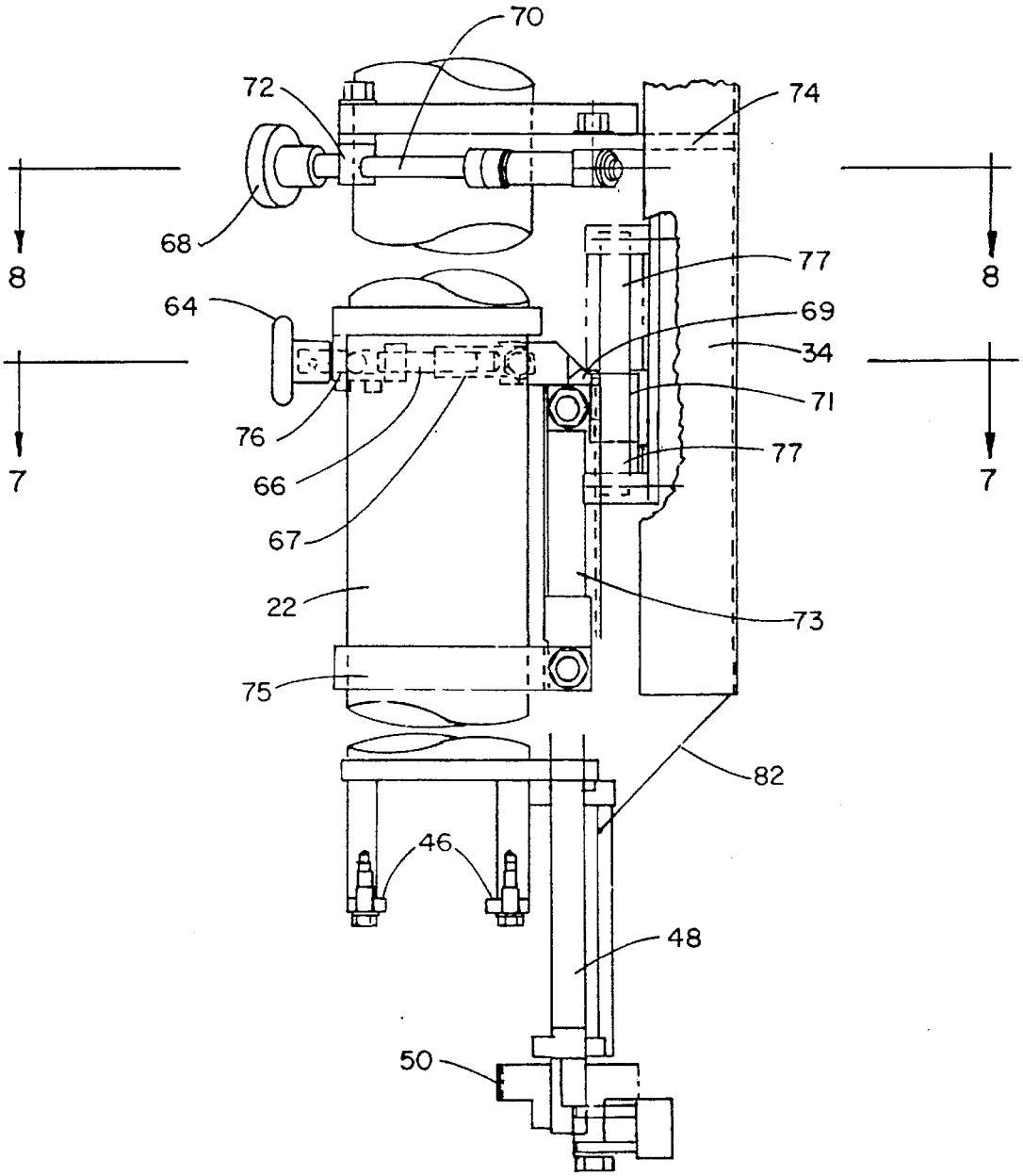
FIG. 6 is a side view of a lower third of elements of the trowelling system of FIG. 1.

A side view of a lower third of the vertical support column 22 and associated elements of FIG. 1 is illustrated in FIG. 6. The lower brace 24, as shown in FIGS. 3 and 4 and which would normally be captured by lower brace clamps 46, has been omitted for the sake of clarity. A drive shaft 48 is partially shown extending parallel to the vertical support column 22. This drive shaft 48 is driven by the first motor 28 (preferably located proximate a top end of the vertical support column 22), and terminates at a lower end in a lower drive gear 50. The lower drive gear 50 meshes with a cooperating lower drive track 52 (see FIG. 5) such that rotation of the lower drive gear 50 by the first drive motor 28 via the drive shaft 48 causes horizontal propulsion of the trowelling system 10 along the wall 12. Note that the lower drive track 52 is proximate the underside 31 of the cooperating ridge 25 on which the lower wheel 58 rides.

With reference again to FIG. 6, provided proximate the vertical support column 22 is at least one main trowel adjustment handle 64. The purpose of this handle 64 is to adjust the distance between the vertical column 22 and the main trowel 34 or, in other words, between the main trowel 34 and the wall 12. A threaded member 66 is attached to the adjustment handle 64 so that when the handle 64 is turned clockwise in an illustrative embodiment, the threaded member 66 advances toward the wall to be finished 12, and thus urges the main trowel 34 to which it is attached to likewise advance toward the wall 12. The handle can have gradations formed therein or a gauge associated therewith to enable accurate adjustment of the main trowel 34 position.

The threaded member 66 passes through a mounting point 76 disposed on the vertical support column 22, while the opposite end of the threaded member 66 is threaded into a receiving nut 67. Disposed between the threaded nut 67 and the main trowel 34 is a horizontal plate 69 having two vertically oriented and pivotable cylindrical bearings 71. Through each of these bearings 71 passes a vibratory shaft 77 rigidly affixed to the main trowel 34. Pivotally connected to the horizontal plate 69 proximate each cylindrical bearing 71 is a substantially vertical bar 73 having a lower pivotable connection to a fixed vertical support column collar 75. Thus, clockwise rotation of the adjustment handle 64 causes the receiving nut 67 to be drawn toward the handle 64. This in turn draws the horizontal plate 69, the bearings 71, the vibratory shafts 77 and the attached main trowel 34 toward the support column 22. Support for this adjustment configuration is provided by the vertical bars 73, the upper ends of which describe a small radius arc as the main trowel 34 is urged toward the support column 22. Turning the adjustment handle the opposite direction causes the main trowel 34 to move towards the wall 12. In one embodiment of the present invention, two such adjustment handles 64 and associated elements are provided, though more can be accommodated.

Figure 7:
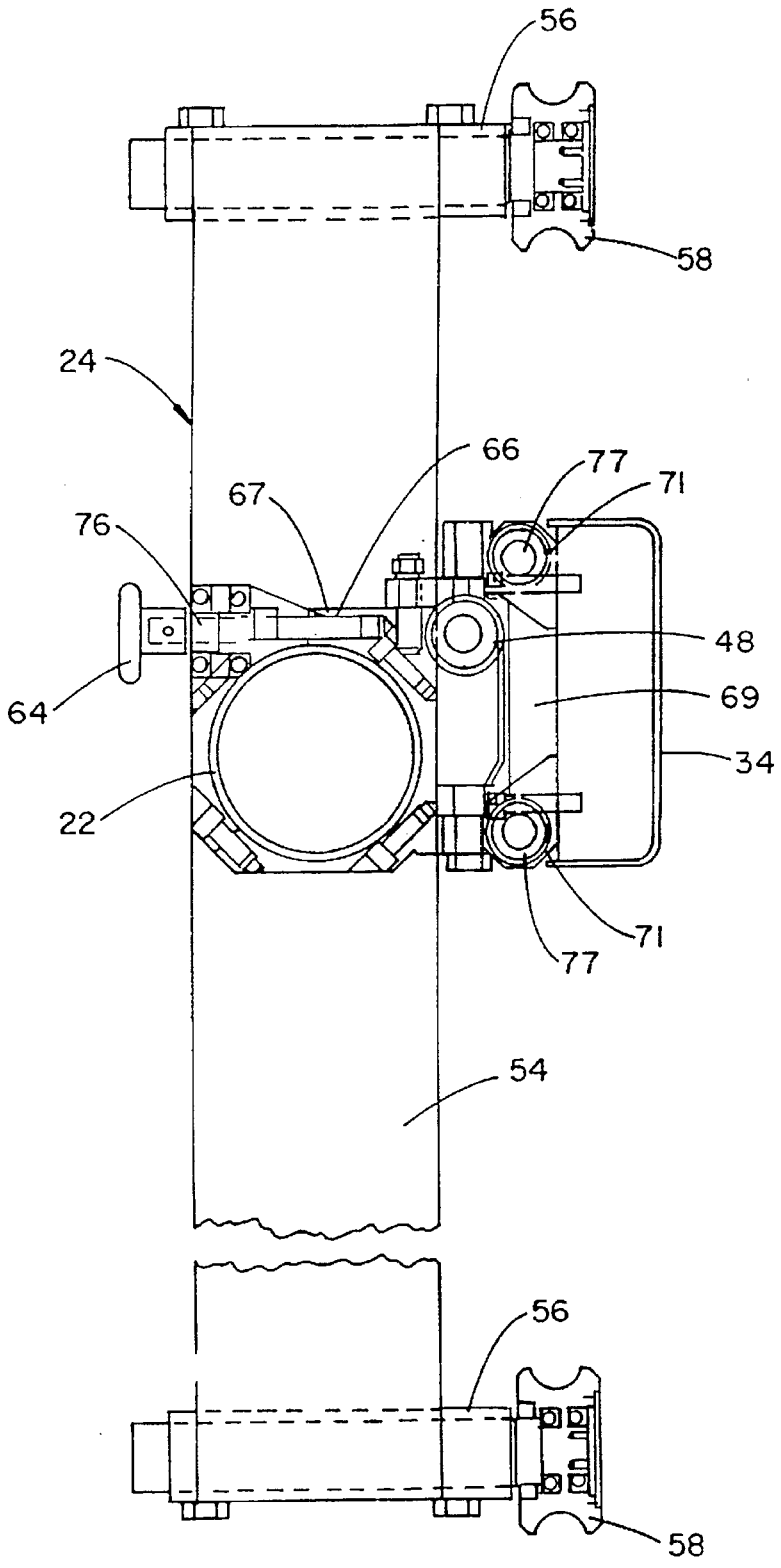
FIG. 7 is a plan view of the trowelling system of FIG. 6 taken along lines 7—7.

In FIG. 7, a top perspective view of the trowelling system 10 provides a view of the main trowel adjustment handle 64 and associated elements, as well as those portions of the trowelling system 12 below it. Note that to eliminate congestion in the drawing, the finish trowel 44 and the forward scoop 42 have been omitted. FIG. 7 further illustrates the relative disposition of the drive shaft 48 with the vertical support column 22. Note that the horizontal plate 69 is configured to avoid interference with the vertical drive shaft 48.

Figure 8:
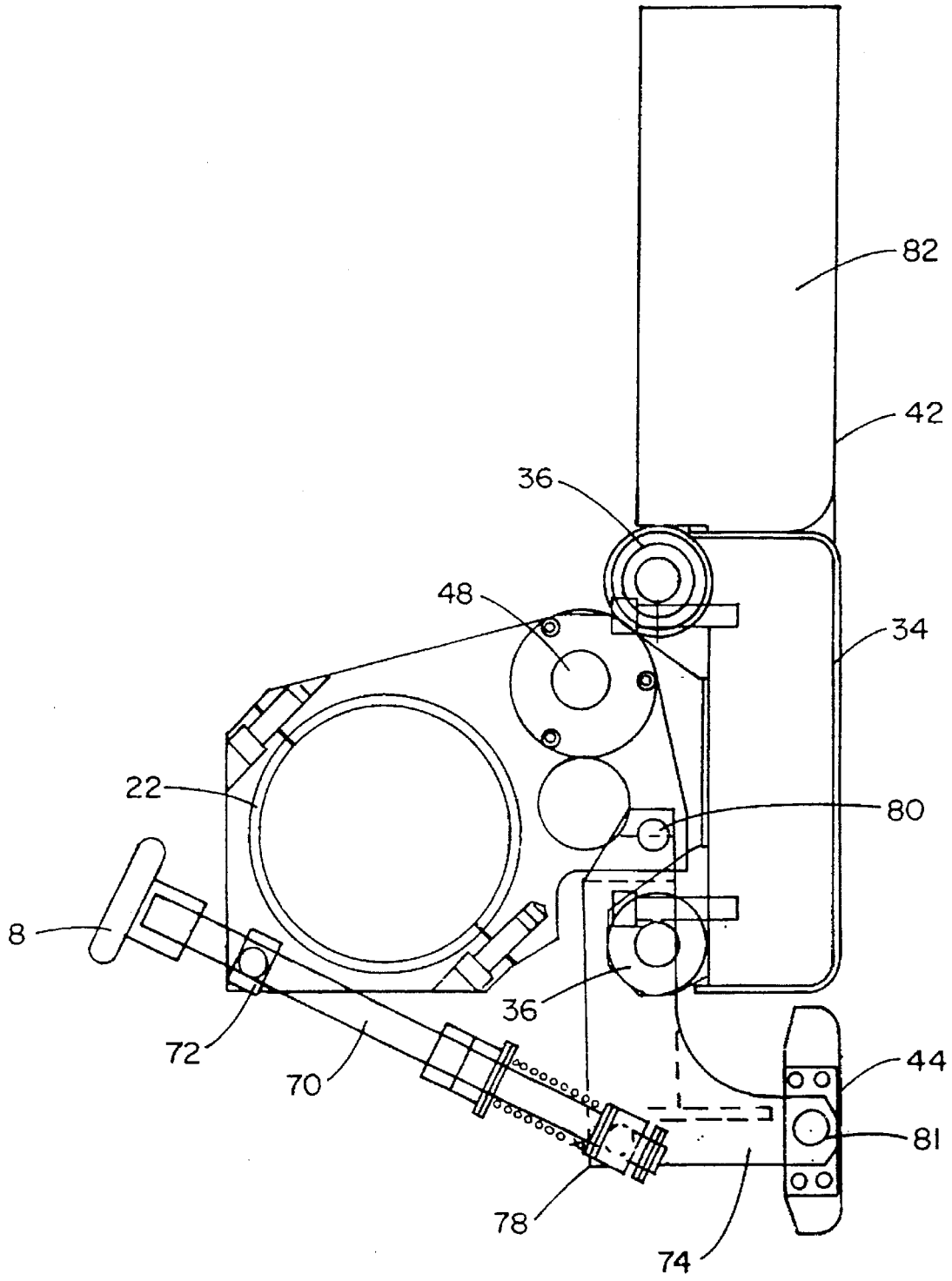
FIG. 8 is a plan view of the trowelling system of FIG. 6 taken along lines 8—8.

FIG. 8 is a top perspective view of the automated trowelling system in which the lower brace 24 of the trowelling system 10, and elements associated therewith, have been omitted. However, the finish trowel 44 and the forward scoop 42 have been included along with the main trowel 34. With reference to FIGS. 6 and 8, another handle attached to the vertical support column 22 is the finish trowel adjustment handle 68. As with the main trowel adjustment handle 64, the finish trowel adjustment handle 68 is attached to a threaded member 70 having one end passing through a mounting point 72 disposed on the vertical support column 22, and having the other end rotatably captured by a threaded pivoting nut 78 disposed on a finish trowel mounting bracket 74. A pivot point 80 is provided between the finish trowel mounting bracket 74 and the remainder of the automated trowelling system 10 such that, as the threaded member 70 is rotated counterclockwise, forcing the threaded pivoting nut 78 toward the wall 12, the mounting bracket 74 is likewise urged forward, thus increasing the pressure applied by the finish trowel 44 on the wall 12. The finish trowel 44 mates with the mounting bracket 74 at a second pivot point 81, allowing the finish trowel 44 to remain flat against the wall 12.

Attached to the main trowel 34 proximate the wall 12 and opposite the finish trowel 44 is the forward scoop 42. Note that in the perspective view of FIG. 8, the entire forward scoop is illustrated, including an angled portion 82 located proximate the lower end of the vertical support column 22. This angled portion 82 slopes down and to the left in the illustrated view. Thus, as the forward scoop 42 removes excess finish material from the surface of the wall 12 before the remaining material is smoothed by the main trowel 34, the excess is channeled by gravity and by the forward scoop 42 toward the floor beneath the lower brace 24. To avoid allowing the excess finish material from fouling the lower wheels 58 and/or the lower drive gear 50 and lower drive track 52, the angled portion 82 urges the excess away from the wall and these moving parts.

Figure 9:
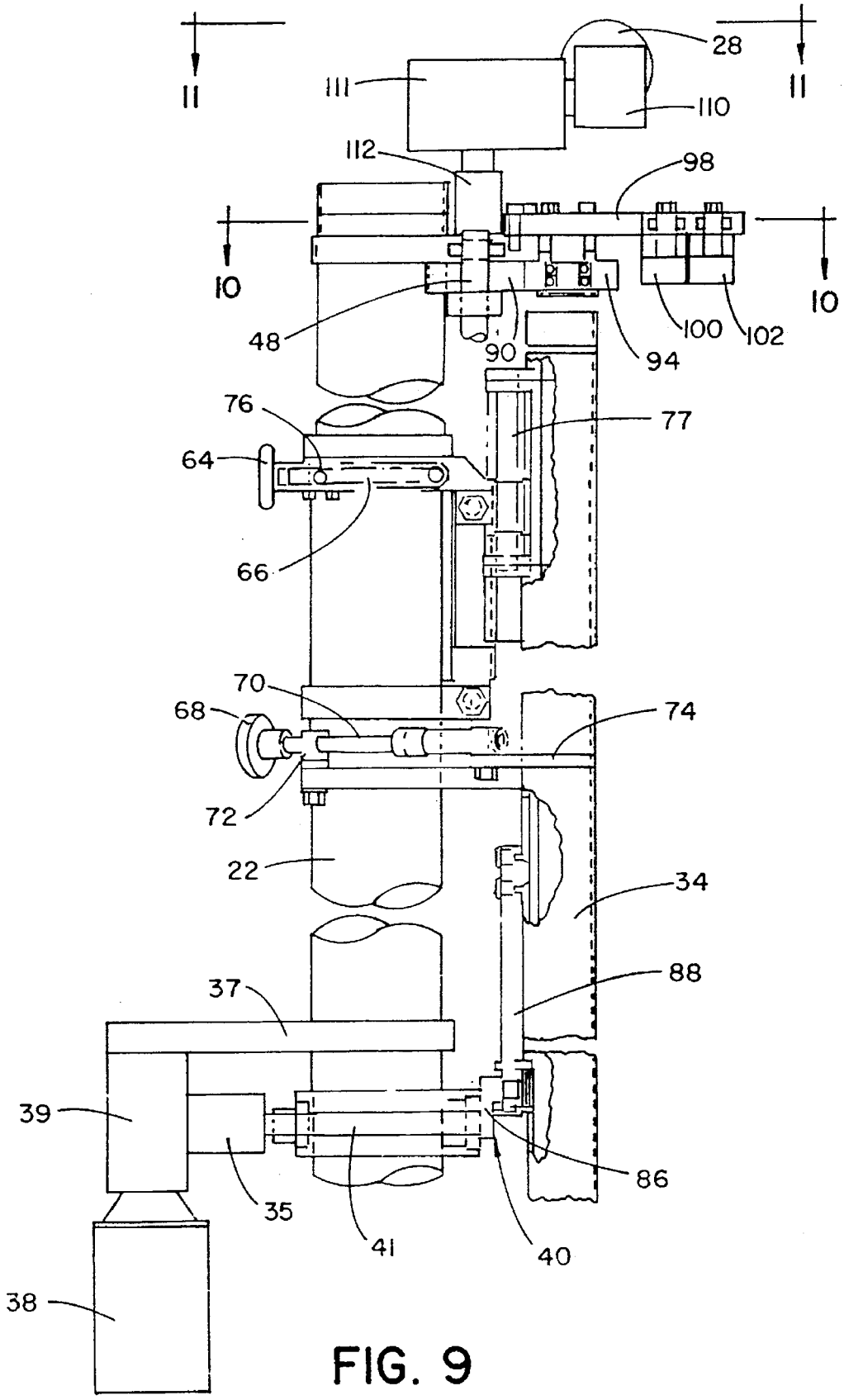
FIG. 9 is a side view of an upper two-thirds of elements of the trowelling system of FIG. 1.

The remaining upper two-thirds of the vertical support column 22 and associated elements are illustrated in FIG. 9. Further main trowel and finish trowel adjustment handles 64, 68 and associated hardware are illustrated, as introduced in FIG. 6. The second motor 38 is also shown which imparts vertically reciprocating motion on the main trowel 34 and associated forward scoop 42. The second motor 38 is attached to the vertical support column 22 by a second motor bracket 37 via a second motor gearbox 39. The gearbox 39 is coupled to an axle 41 via a coupler 35 which provides a plastic interface between the axle 41 and a shaft extending from the gearbox 39. The plastic interface eliminates the possibility that the two metal shafts will wear each other down. The linkage 40 disposed between the second motor 38 and the main trowel 34 includes: a rotating arm 86 rotated by the axle 41; and a reciprocating arm 88, a first end of which is connected to the rotating arm 86 and a second end of which is connected to the main trowel 34. Thus, as the first end of the reciprocating arm 88 tracks the rotating arm 86, the second end and the main trowel 34 are driven up and down, assisted by the latent energy stored in the multiple reel springs 36. The second motor 38 operates at 116 rpm in an illustrative embodiment.

Figure 10:
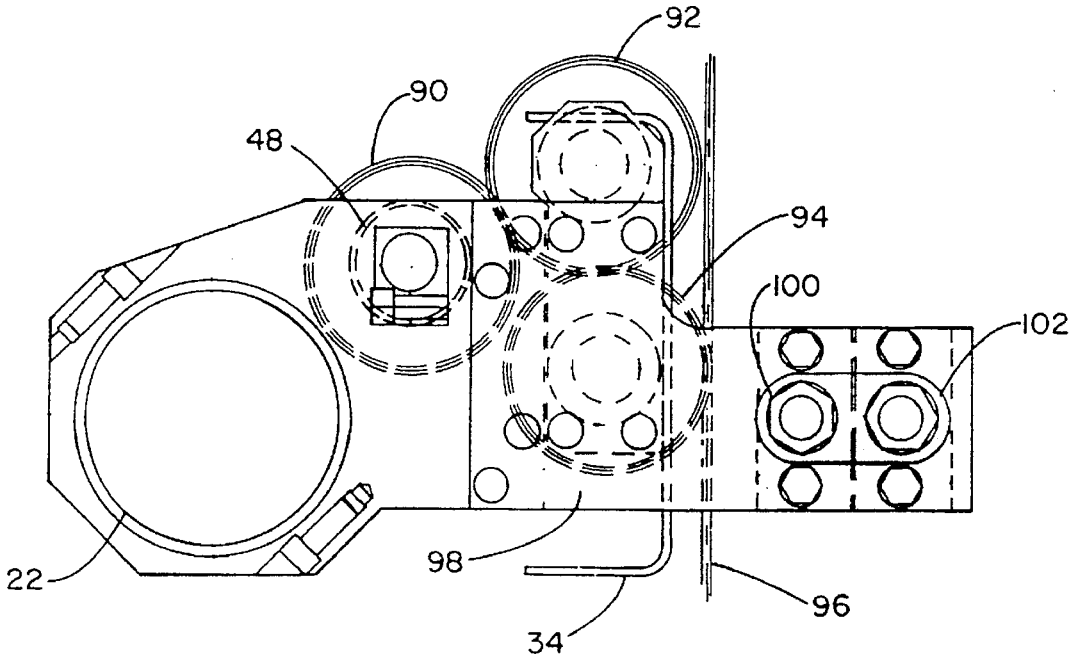
FIG. 10 is a top view of the trowelling system of FIG. 9 taken along lines 10—10.

A first upper drive gear 90, disposed at a top end of the drive shaft 48, is located proximate an upper end of the vertical support column 22. As viewed in FIGS. 9 and 10, teeth of the first upper drive gear 90 cooperate with teeth on an idler gear 92 which is suspended from an upper mounting plate 98. The rotation imparted on the idler gear 92 in turn causes a second upper drive gear 94 to rotate in the same direction as the first upper drive gear 90 and the drive shaft 48. As with the lower drive gear 50, teeth on the second upper drive gear 94 mesh with teeth provided on an upper drive track 96, shown in FIG. 13.

Note that the lower drive gear 50, the first upper drive gear 90 and the second upper drive gear 94 must be of the same diameter; the first and second upper drive gears 90, 94 and the idler gear 92 must be sized such that the rate of angular rotation of the second upper drive gear 94 is equal to that of the lower drive gear 50. Thus, as the drive shaft 48 is rotated, both the lower drive gear 50 and the second upper drive gear 94 progress along respective lower and upper drive tracks 52, 96 simultaneously, propelling the automated trowelling system 10 horizontally.

Figure 11:
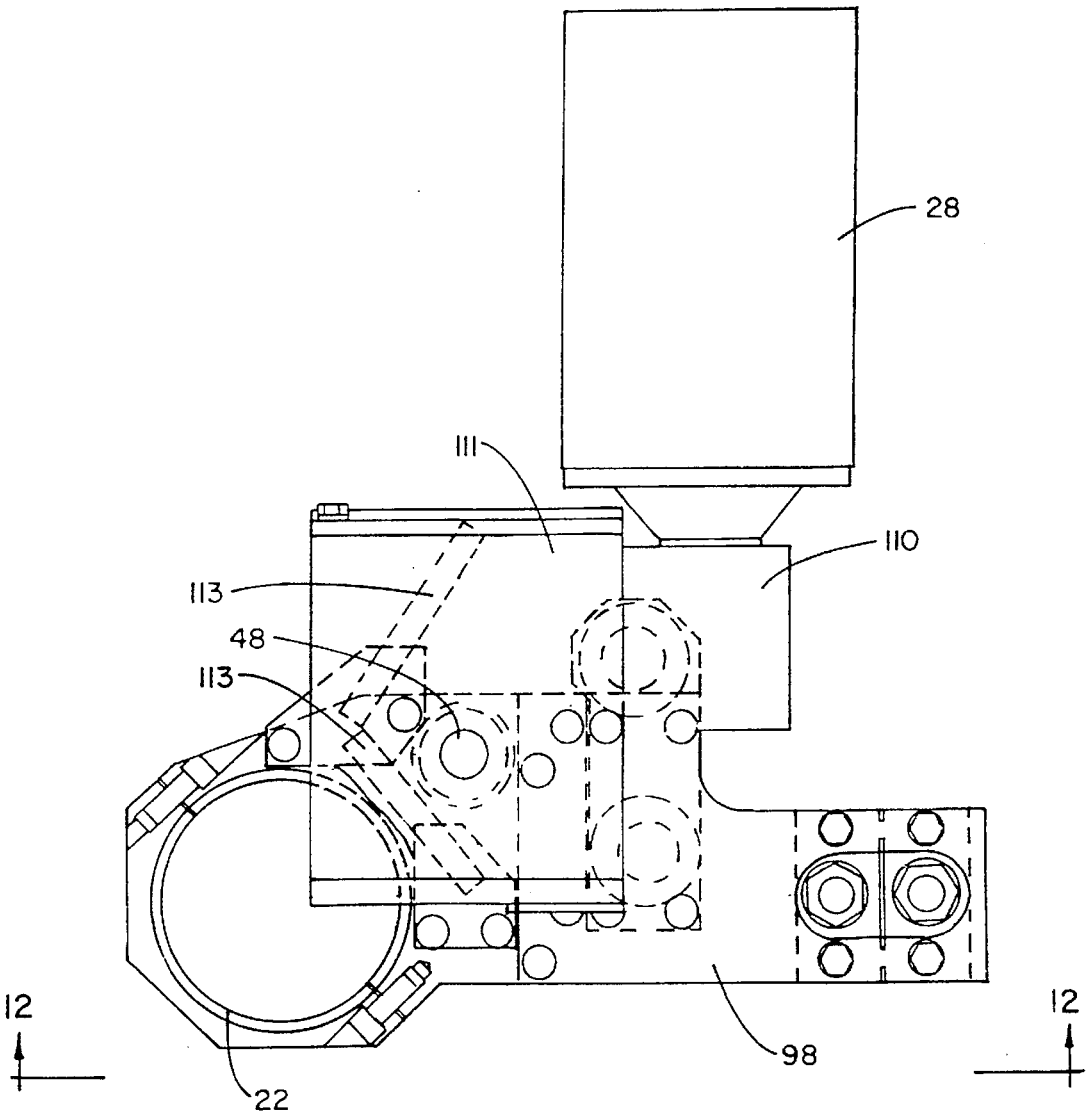
FIG. 11 is a top view of the trowelling system of FIG. 9 taken along lines 11—11.
Figure 12:
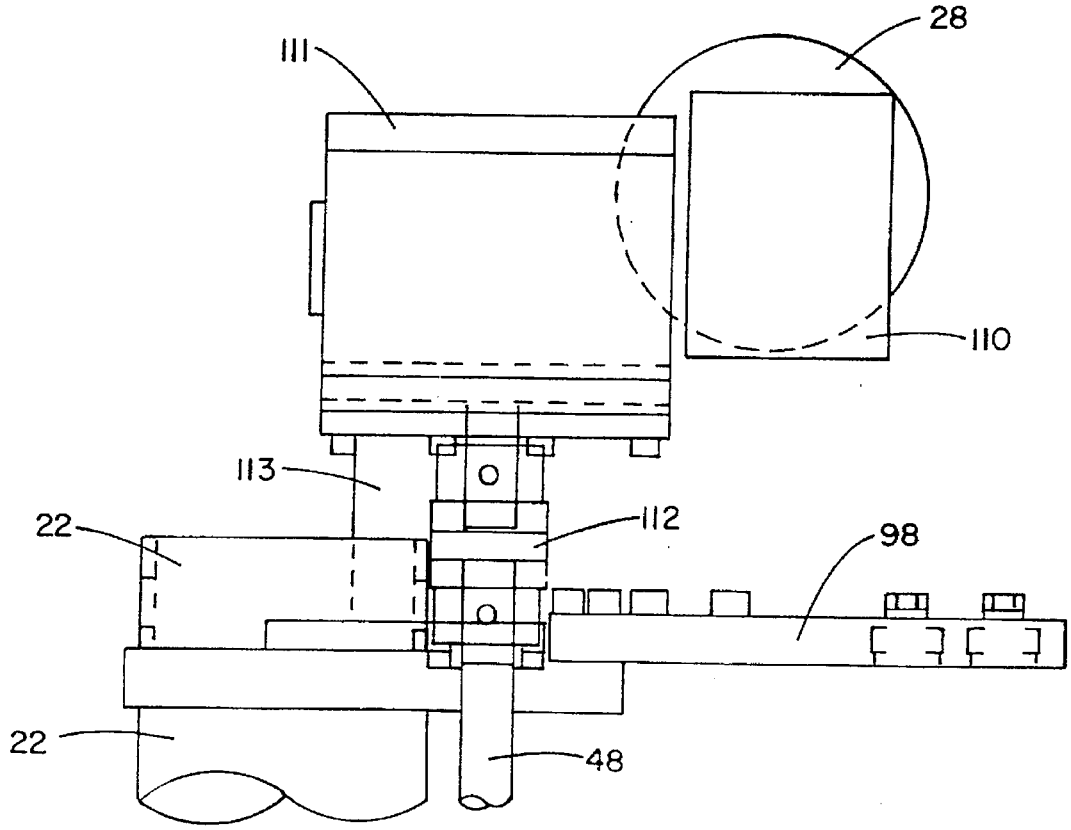
FIG. 12 is a side view of a first motor and associated elements taken along lines 12—12 in FIG. 11.

The first motor 28 is shown in FIGS. 11 and 12 atop the vertical support column 22. Note the upper mounting plate 98 both figures. As with the second motor 38, the first motor 28 is attached to and suspended from a first gearbox 110, which in turn is attached to and drives a second gearbox 111. Note that beneath the second gearbox 111 are two support brackets 113 for rigidly attaching this motor and gearbox combination to the vertical support column 22. Rotational energy is imparted to the drive shaft 48 via a coupler 112 which provides a plastic interface between the drive shaft 48 and an axle extending from the second gearbox 111. This plastic interface eliminates the opportunity for the metal drive shaft 48 and the metal axle to wear each other down. In one embodiment of the present invention, the first motor 28 is a one-half horsepower motor, and the combined ratio of the two gearboxes 110, 111 is 150:1. The drive gears are sized to enable 14.13 inches of lateral displacement per each drive shaft 48 rotation. The motor speed is such that the system 10 can travel at up to 13.7 linear feet per minute along the wall 12 to be finished.

Figure 13:
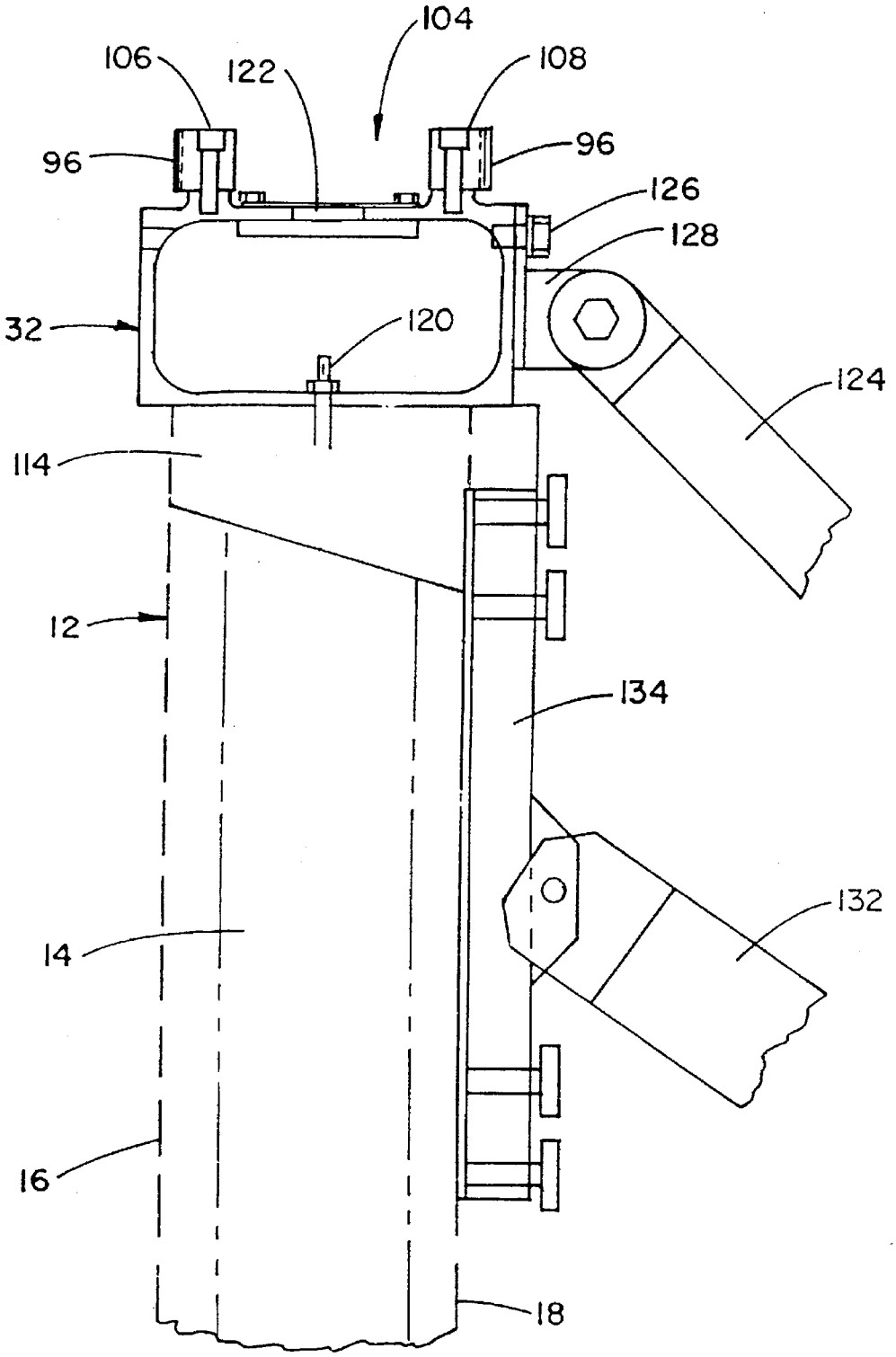
FIG. 13 is a cross-sectional view of an upper portion of the wall system of FIG. 2 rigged for acceptance of the trowelling system of FIG. 1.

In order to keep the upper portion of the vertical support column 22 proximate the wall to be finished 12, a first upper follower wheel 100 and a second upper follower wheel 102 are disposed beneath the upper mounting plate 98. These follower wheels 100, 102 extend within a channel 104, as seen in FIG. 13, and rotate freely to promote smooth progression of the trowelling system 10 in a horizontal direction. The channel 104 has a U-shaped cross-section owing to the presence of two vertical blocks 106, 108 against which the two upper follower wheels 100, 102 contact and roll. Therefore, in the illustrated embodiment of FIGS. 9 and 13, the vertical support column 22 and associated elements will tend to pull away from the wall 12 to the left. However, the first upper follower wheel 100 will press against the first vertical block 106, maintaining the automated trowelling system 10 in vertical alignment with the wall 12, and keeping the second upper drive gear 94 in contact with the upper drive track 96. Adjustments are provided at the attachment point between each upper follower wheel 100, 102 and the upper mounting plate 98 to adjust the spacing of the follower wheels 100, 102 within the channel 104.

The U-shaped channel 104 of FIG. 13 is part of an upper bracket assembly 32 which is disposed atop the wall to be finished 12 and extends the length of the wall. As described with reference to FIG. 2, the wall is comprised of a central core 14, which, in an illustrative embodiment, is made of a styrofoam sheet, disposed between two wire grid screens 16, 18. To affix the bracket 32 to the top of this wall structure 12, a central core material 14 more rigid than styrofoam is required. Consecutive lengths of bracket 32 must be properly aligned to ensure smooth progression of the wall finishing system 10 across the wall 12. Connecting plates (not shown) are disposed in and rigidly connected to the channel 104 of consecutive upper brackets 32.

Figure 14:
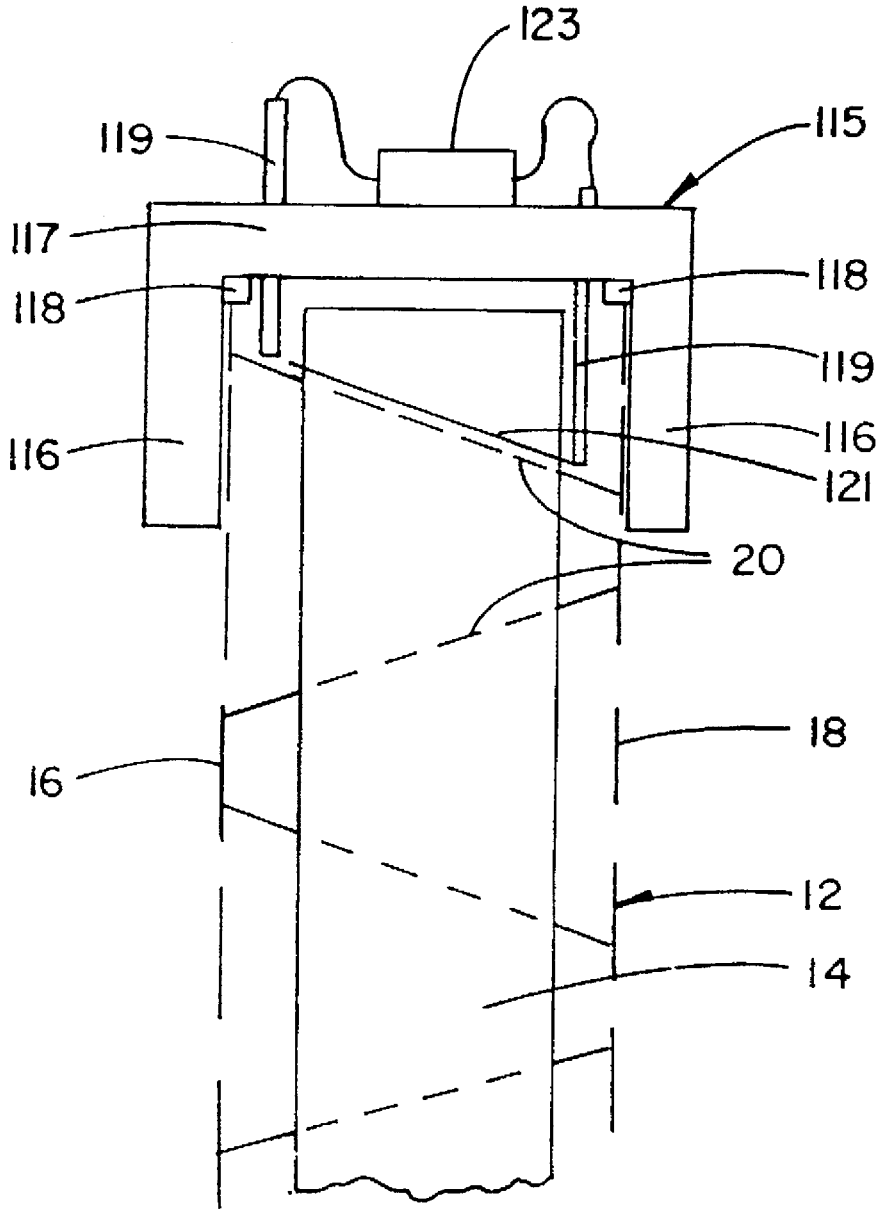
FIG. 14 is a side view of an upper portion of the wall system of FIG. 2 having a cutting frame disposed thereon.

In one embodiment of the present system, an uppermost portion of the styrofoam 14 is removed and replaced with a wood block 114 which provides a solid point of attachment for the upper bracket assembly 32. While styrofoam is an easily cut material, the core 14 of the wall 12 to be finished is difficult to access due to the wire grid screens 16, 18 on either side. Further, cross members 20 are disposed at angles between the grids 16, 18 and through the styrofoam 14. The present invention relies upon a cutting frame 115 disposed atop the wall 12 as shown in FIG. 14. The frame 115 has arms 116 which extend downward from a body region 117 on opposite sides of the wall 12. At the junction of the arms 116 and the body region 117 are disposed plastic runners 118 which enable the frame 115 to be advanced along the top of the wall 12.

Also extending downward from the body region are two height adjustable members 119 having a wire 121 extending therebetween. The wire 121 is heated, by a heat inducing element 123 such as a resistive heater or by an external heat source not an integral part of the frame 115, thus enabling the frame 115 to be advanced along the top of the wall 12 and enabling the heated wire 118 to be drawn through the styrofoam, removing an upper portion thereof. The height adjustable members 119 can be adjusted as appropriate to the geometry of the cross members 20 in the wall 12.

Once a suitable block 114 has been substituted within the wall 12, it is secured to the grids 16, 18 by fasteners such as heavy gauge staples. The upper bracket assembly 32 (see FIG. 13) is then attached to the block 114 by the use of multiple threaded fasteners 120 which are accessed via bore holes 122 in the channel 104. Multiple back-side struts 124 are then attached to the upper bracket assembly 32 on a side of this bracket 32 opposite the vertical support column 22 and the upper drive gears 90, 94. Attachment of each strut 124 to the upper bracket assembly 32 is accomplished by use of threaded fasteners 126 securing a strut plate 128 to the bracket assembly 32. In some applications, it is necessary to perform the disclosed wall finishing on both sides of the wall 12. Thus, the upper bracket assembly 32 is able to accept the strut plate 128 on either side of the bracket 32.

Figure 15A:
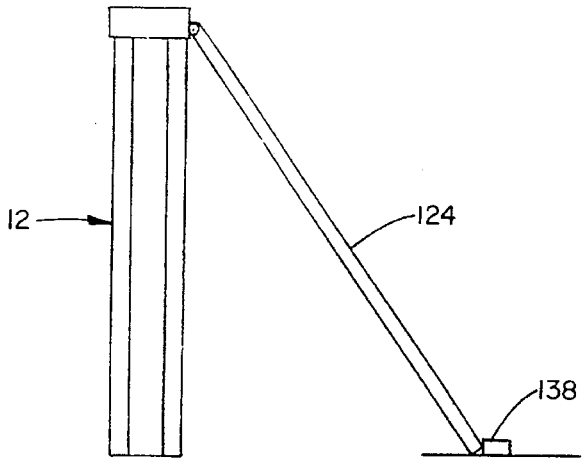
FIG. 15A is a simplified cross-sectional view of the wall system of FIG. 2 having a number of struts of a first type.
Figure 15B:
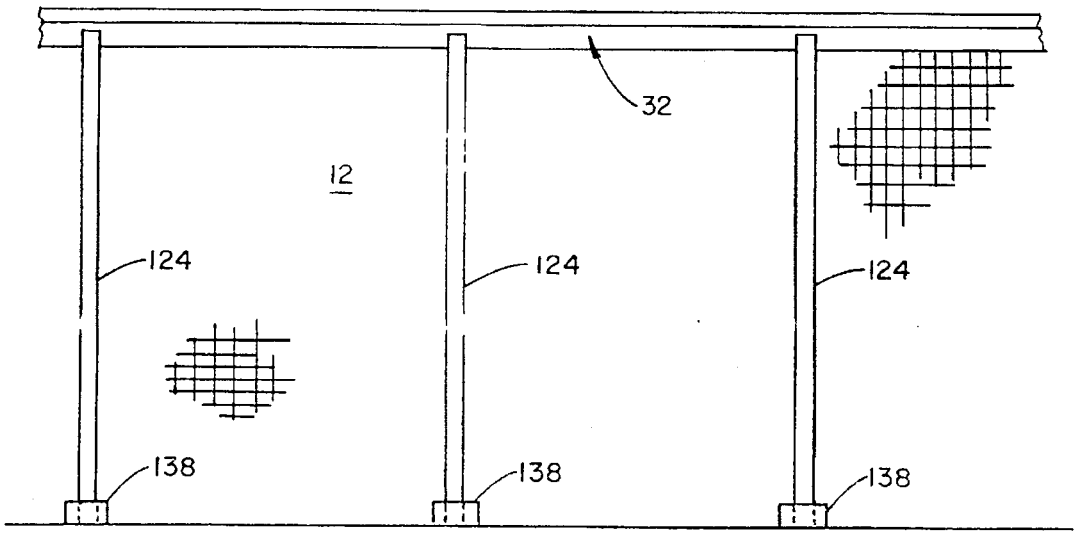
FIG. 15B is a front view of the wall system of FIG. 15A.

In one embodiment, illustrated in FIGS. 15A and 15B, each strut 124 is supported at a lower end by the use of blocks 138 nailed or otherwise secured to the floor or the ground. These struts 124 extend downward in a plane normal to the plane of the wall 12.

Figure 16A:
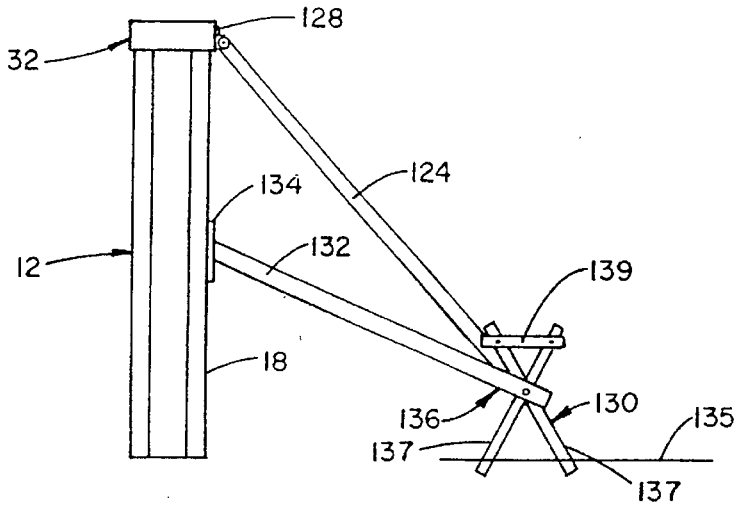
FIG. 16A is a simplified cross-sectional view of the wall system of FIG. 2 having a number of struts of a second type.
Figure 16B:
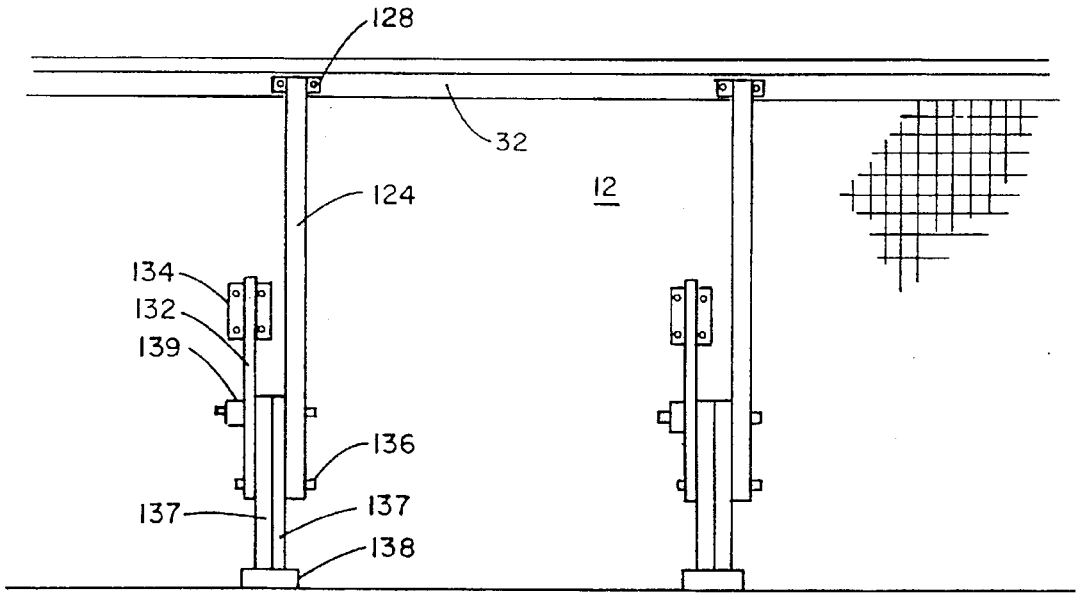
FIG. 16B is a front view of the wall system of FIG. 16A.

In an alternative embodiment, illustrated in FIGS. 16A and 16B, superior structural support for the wall 12 is provided by the use of additional support structures. Each strut 124 is again angled down and away from the upper bracket assembly 32. Intermediate struts 132 are attached to the exterior wire grid 18 at an approximate midway point in the wall 12 vertical dimension. The upper end of each intermediate strut 132 is attached to the exterior wire grid 18 via an intermediate strut plate 134 by the use of hooks having a threaded end. After each hook is looped through the grid 18, a nut is secured onto the threaded end to secure to hook to the strut plate 134. Each intermediate strut 132 extends down and away from the wall 12, in the same plane as that of the main strut 124 normal to the plane of the wall 12. The opposite end of the intermediate strut 132 is attached to the principal strut 124 at a cross-over point 136 approximately one foot above a floor surface 135. Attachment of these struts is by conventional means, such as by a threaded fastener.

Also intersecting at the cross-over point 136 are two secondary struts 137 which form an X-shaped structure 130, all four intersecting struts 124, 132, 137 being coplanar. Lower ends of the secondary struts 137 are disposed in or against the floor surface 135 in a conventional manner, such as by the use of blocks 138 attached to the floor. To further strengthen this configuration, a cross-member 139 is disposed between upper ends of the secondary struts 137.

Figure 17:
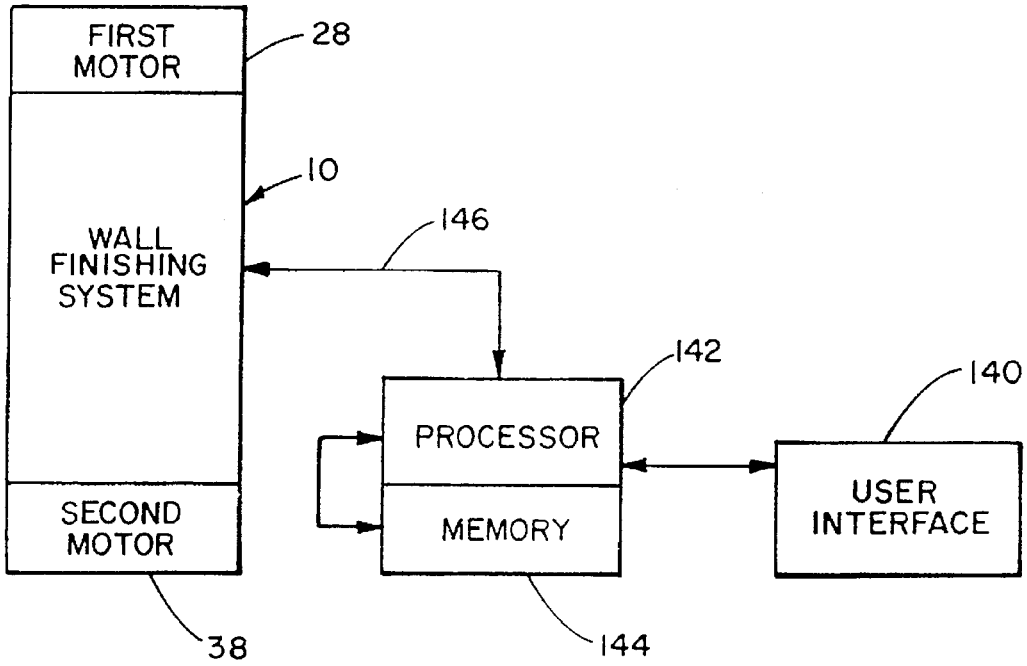
FIG. 17 is a schematic view of a system control configuration for the wall finishing system of FIG. 1.

The automated trowelling system as just described can be controlled by user input, by processor control, or by a combination of both user and processor control. For user control, a user interface 140, otherwise referred to as a remote control device, is in communication with the trowelling system 10 and thus the first and second motors 28, 38. Such communication may be via an RF link, an IR link, or may be via electrical signals conducted along wires between the remote control device 140 and the motors 28, 38. With reference to FIG. 17, user control via the user interface bypasses a processor 142 and connects directly to the trowelling system 10.

Alternatively, if the trowelling system 10 is fully processor controlled or partially processor controlled, such a user interface 140 can provide an operator with the ability to input performance characteristics such as speed or desired surface area to be finished to a processor 142 having an associated memory 144. An exemplary system configuration for a processor controlled system 10 is illustrated in FIG. 17. The user input characteristics are then translated by the processor 142 according to an algorithm stored within the processor memory 144 into commands to the motors 28, 38.

In order to further enable processor-controlled operation of the present wall finishing system, a number of sensors can be utilized. One such sensor is associated with each of the two motors 28, 38 to provide the processor 142 with an indication of motor activity and thus system location along a wall. In an exemplary embodiment, such a sensor provides an indication of shaft rotation, either the motor shaft or a member rotated by the motor, such as the drive shaft 48. Such an embodiment can provide accuracy of 1/60th of a revolution.

In one embodiment, each drive track 52, 96 is ground down at either end of the wall to be finished. Thus, when the trowelling system has reached a corner or a wall end, the system will be unable to continue to move laterally. The first motor 28 will continue to run and turn the lower drive gear 50 and the upper drive gears 90, 94 until stopped either by the processor 142 or by manual intervention.

In an alternative embodiment, another set of sensors are employed in the present system as limit switches disposed at either end of the wall to be finished 12. These switches, which can be rubber enclosed to operate in harsh working environments, provide an indication to the processor 142 that the trowel system has reached one end of a wall and must therefore stop.

The processor 142 and associated memory 144 of the present system can be located, in one embodiment, on a device known as an air track, a self-propelled, compressed-air powered vehicle commonly used in building construction environments. The processor 142, memory 144 and user interface 140 are disposed onboard in ruggedized enclosures, as appropriate to the nature of constructions sites. Cables 146 for power and data transfer are strung between the processor 142 and the trowelling system 10. To avoid the presence of dragging cables 146 which could get caught and crushed in the moving machinery, one or more booms can extend upwards from the air track, with the cables 146 suspended therefrom.

In a first variation of this embodiment, an operator drives the air track and monitors the operation of the automated trowelling system 10 from the user interface 140 onboard the air track. The operator is required to keep the air track in the vicinity of the system 10, though enough slack is provided in the cables 146 to avoid separation of the cables 146 from either the processor 142 or the system 10.

In a second variation of this embodiment, the air track is controlled by commands from the processor 142 based upon position coordinates of the system 10. Thus, in this variation on the automated trowelling system 10, a user need only provide initial wall configurations and specifications as to finishing material, finish desired, amount of time finish material has been on the wall to be finished 12 (finish material age), and ambient conditions, among other data. The trowelling system would then proceed to finish the wall 12 without further manual intervention. In either variation, any suitable vehicle other than an air track can be employed.

In other embodiments, the processor 142 and associated elements are stationary, and cables 146 extend between the processor 142 and the system 10. In this instance, the cables 146 can be straight, coiled, or retractable cables.

Figure 18:
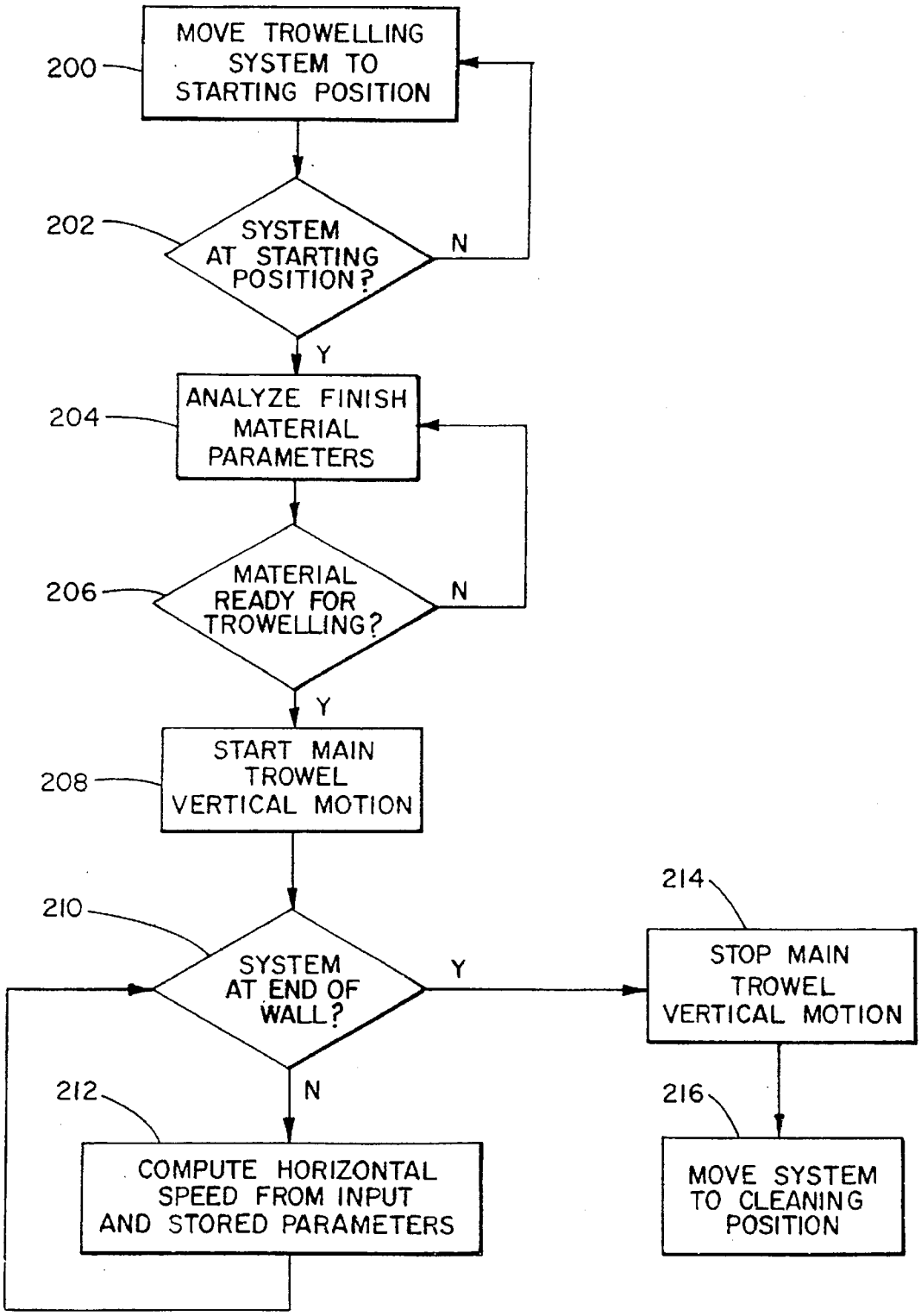
FIG. 18 is a flow chart depicting a sequence of steps executed by a processor associated with the trowelling system of the present invention.

In one embodiment, an operating procedure stored in the memory 144 for execution in the processor 142 is executed as follows and as depicted in FIG. 18. First, the trowelling system 10 is commanded to a starting position (steps 200, 202). In the depiction of FIG. 1, in which the trowelling system is proceeding to the left, such a starting position is the extreme right side of the wall.

As noted, one of the inputs which the processor 142 can receive prior to initiating the trowelling 10 system is the finish material age. The processor 142 can determine from the type of finish material, the thickness of the material and the material age, among other factors, when the trowelling system motors should be activated. Therefore, the processor 142 can idle until the necessary parameter values are achieved (steps 204, 206).

Another data set which can either be entered by a user or which can be calculated by the process or 142 based upon a database of material finishes and conditions is the frequency of main trowel 34 reciprocation. Once the processor 142 has determined that the system 10 motors 28, 38 can be activated (step 206), this frequency is used in controlling the second motor 38 via the cables 146 (step 208). Note that the second motor 38 speed given above (116 rpm) is the rated speed for the motor 38, and not necessarily the speed at which the motor 38 will run continuously.

The automated trowelling system is normally enabled for horizontal motion as long as it has not reached the end of a wall to be finished 12 (Step 210). However, other factors must be considered by the processor 142 in controlling the system lateral motion, as now described (step 212).

Figure 19:
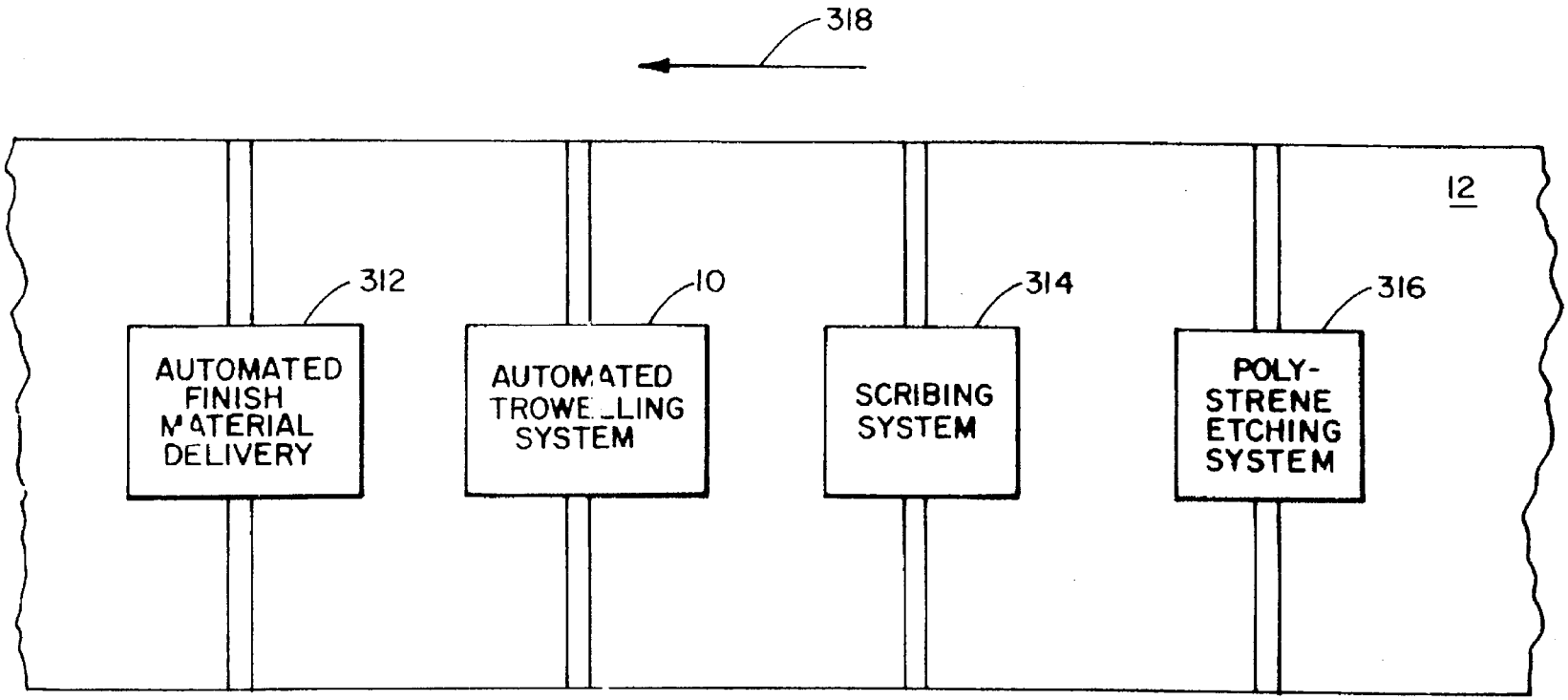
FIG. 19 is a schematic depiction of the automated trowelling system of the present invention as part of a larger wall finishing system.

In an alternative embodiment of the present invention illustrated in FIG. 19, the automated trowelling system 10 is part of a larger system including one or more of: 1) an automated finish material delivery system 312; 2) a scribing system 314 for forming desired grooves in the finished wall 12; and 3) a polystyrene etcher 316 for opening desired gaps or pockets in the finished wall, including through the central layer of styrofoam in the wall system 12. All four of these systems, or any subset thereof, move in one horizontal direction along the wall to be finished 12. In the depiction of FIG. 19, this direction is indicated by an arrow 318. The automated finish material delivery system 312 is described in further detail below.

Therefore, since the present automated trowelling system 10 can operate in conjunction with the finish material delivery system, it is necessary for the processor 142 to calculate the location of the delivery system and to determine the characteristics of the finish material itself, including its age and taking into consideration the ambient conditions, to allow the trowelling system 10 to proceed (step 212).

If the trowelling system 10 proceeds horizontally too quickly, it can gain on the automated delivery system, raising the possibility of a collision between the delivery system and the present automated trowelling system 10. Further, even if the two systems are not close enough for a collision, the possibility exists that cables to the two systems can be entangled. In any case, it is then necessary to stop the lateral progress of the trowelling system until the preceding delivery system has advanced.

Alternatively, the automated trowelling system 10 according to the present invention can approach finish material which has been on the wall system 12 for too short a time, either manually applied to the wall 12 or automatically applied via the delivery system mentioned above. As in the previous situation, the horizontal progress of the automated trowelling system 10 is halted until the finish material has reached the necessary age (step 212). Then, the horizontal speed of the trowelling system 10, as controlled by the first motor 28, is adjusted so that the trowelling system 10 progresses across the material to be finished only as it reaches the proper age.

In a further embodiment of the present invention, the processor 142 can adjust the rate of periodic vertical motion of the main trowel 34 based upon the rate of horizontal progression. Thus, when the horizontal motion is stopped due to below-limit finished material age or due to trowelling system 10 proximity to a finish material delivery system, the frequency of the vertical motion of the main trowel 34 can be decreased, even to zero, if necessary. Conversely, increased horizontal velocity of the trowelling system 10 can result in increased main trowel 34 vertical motion frequency.

Once the trowelling system has progressed horizontally across the wall to be finished 12, the processor 142 commands the second motor 38 and thus the vertical motion of the main trowel 34 to stop (step 214). Next, the first motor 28 of the system 10 is commanded to propel the system 10 to a cleaning position, which can be at either end of the wall 12, or at any point in between (step 216). The trowelling system 10 can then be hosed off with a suitable cleaning agent, which in the case of cement finishing is water. At this point, the trowelling system 10 is ready to be moved to another wall to be finished 12.

In one embodiment of the present automated trowelling system, the processor also controls annunciators such as warning lights and sirens or buzzers to alert personnel in the area that the system is, or is about to be, in motion.

A further embodiment of the present invention employs a shield disposed about the wall finishing system to prevent finishing material and other particulate matter from interfering with the moving elements such as the reel springs 36 or the adjustment handles 64, 68. Such a shield is preferably formed of two aluminum halves, each attached to one of an upper and lower half of the vertical support column 22 and each having essentially three panels. A first panel extends down a side of the vertical support column 22 opposite the wall being finished and parallel thereto. The second and third panels extend from opposite side edges of the first panel to points several inches from other side of the main trowel 34. Between the second and third panels and the trowel 34 is disposed a rubber barrier or skirt capable of deflecting approximately three inches as the main trowel 34 reciprocates up and down.

The lower half of this shield is preferably removably attached to the vertical column 22, thus enabling easy access to the lower brace 24 and associated elements. The upper half need not be so easily removed. Provision is made between the two halves for the second motor 38 and associated gearbox 39 to extend beyond the cover.

As indicated, the lower brace 24 typically has two lower wheels 58, as well as a lower drive gear 50 and other elements described above with respect to FIGS. 3, 4 and 6. Prior to installation of the system against the wall, these elements are likely to be fouled by allowing the system to rest on the floor, which may or may not be finished. Further, the wheels 58, 60 and the lower drive gear 50 may be jarred out of alignment, inhibiting proper movement of the system once installed against the wall 12.

Figure 20A:
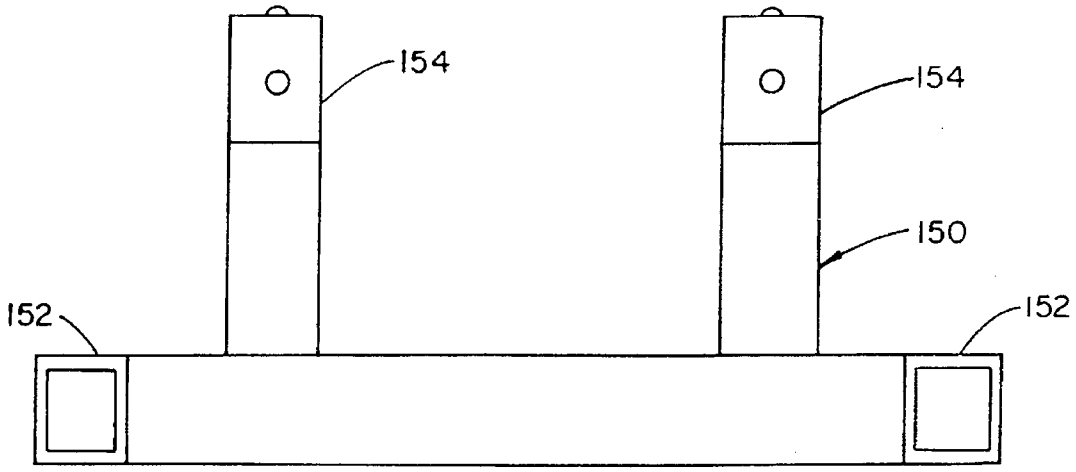
FIG. 20A is a front view of a protective bracket provided to the system of FIG. 1 in an alternative embodiment.
Figure 20B:
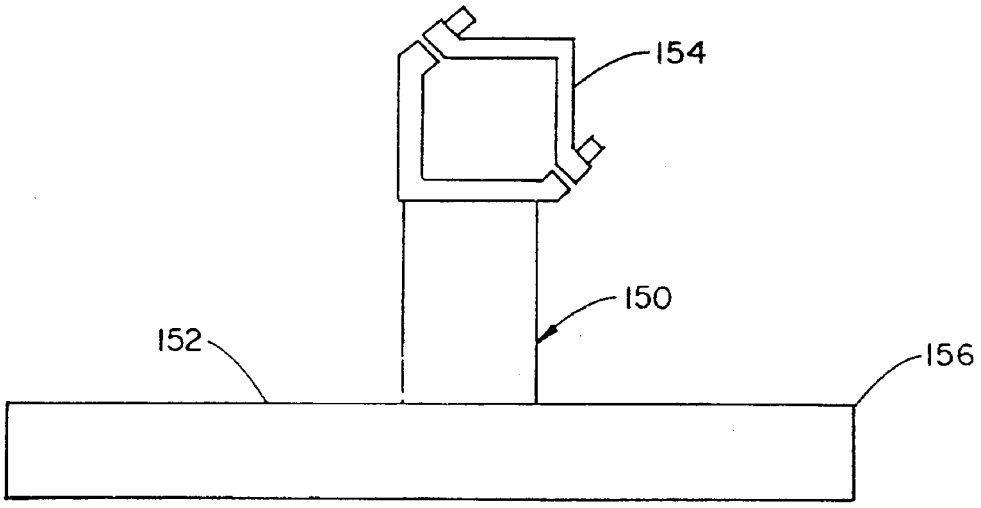
FIG. 20B is a side view of the protective bracket of FIG. 20A.

Therefore, in another embodiment of the present invention, a protective bracket 150 is provided to the lower brace 24 of the wall finishing system via clamps 154 to protect elements attached to the brace 24, as illustrated in FIGS. 20A and 20B. As the system 10 is resting horizontally on the floor, legs 152 are also resting substantially horizontally on the floor, as shown in FIGS. 20A and 20B, elevating the lower brace 24 off the floor. When the system 10 is raised to the vertical (ninety degrees clockwise in FIG. 20B), first ends 156 of the bracket legs 152 extend down onto the floor, once again elevating the brace elements above the floor. From this point, the system 10 is raised onto the wall 12, and the protective bracket 150 can be removed to avoid its protruding into the work area.

Figure 21:
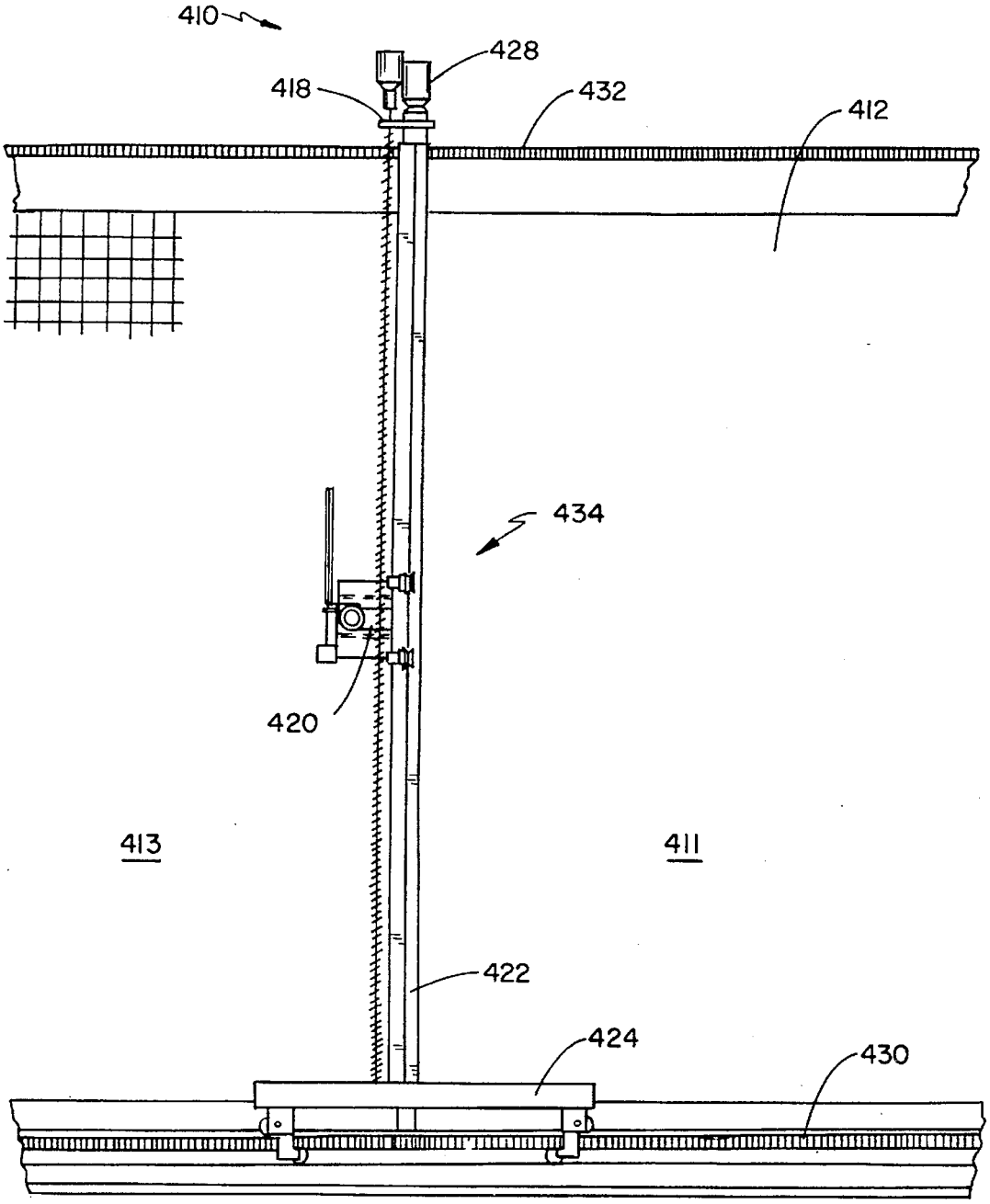
FIG. 21 is a front view of a nozzle and a material delivery system for use in a wall finishing system according to the present invention in an illustrative environment.

With reference to FIG. 21, an automated material delivery system 410 according to the present invention operates proximate a planar, vertical wall to be coated 412 (only partially illustrated) along both horizontal and vertical axes to provide a desired quantity of fluent material to the wall 412. In FIG. 21, two regions of a wall are illustrated, a first region 411 where no finishing material has been applied, and a second region 413 where finishing material has been applied by the delivery system 410. The wall to be coated 412 can be the same or similar to the wall 12 disclosed with respect to the automated trowelling system 10 and shown in FIG. 2. Attachment of this wall 12 to a footer 26 is illustrated in FIG. 5.

The material delivery system 410 itself will now be described in detail. The automated material delivery system 410 is comprised of several main components, as described with respect to FIG. 21. Further details of the various components of the system 410 are described with respect to the remaining figures.

A vertical support column 422 having a substantially square horizontal cross-section extends between a lower brace 424 and an upper mounting plate 418 (visible in FIG. 39), proximate and parallel to the wall 412. The lower brace 424 is in all aspects the same as the lower brace 24 illustrated with respect to the automated trowelling system 10. The entire delivery system 410 is moved laterally (to the left in the illustrated embodiment of FIG. 21), proximate the wall 412, suspended from lower and upper wall mounted brackets 430, 432. A first motor 428 (also illustrated in FIG. 39) provides power for moving the delivery system 410 laterally.

The brackets 430, 432 are attached to the wall 412 (either the composite wall illustrated in FIG. 2 or another form of wall) and are essentially the same brackets 30, 32 as described with reference to the automated trowelling system 10. In fact, as previously noted, it is desirous for the material delivery system 410 to precede the automated trowelling system 10 along the same brackets 30, 32.

A nozzle mounting system 434 is attached to the vertical support column for the purpose of supporting and translating a nozzle 420 both vertically along the wall 412. A nozzle 420 and mounting system 434 are further illustrated in subsequent figures.

Figure 22:
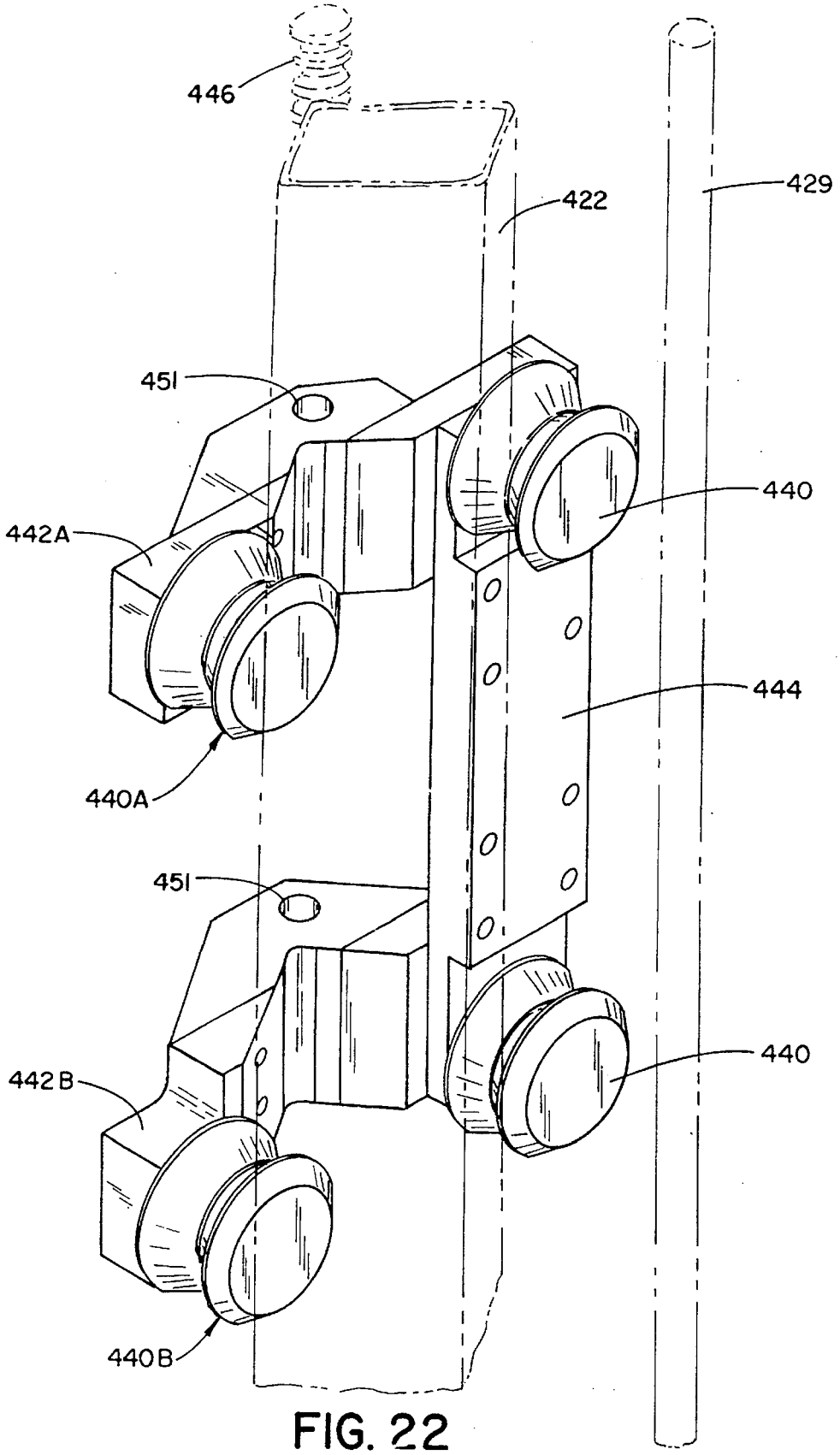
FIG. 22 is a top-right-front perspective view of tracking wheels, brackets and an interconnecting plate as used in the material delivery system of FIG. 21.

With respect to FIG. 22, upper and lower pairs of support column tracking wheels 440A, 440B are mounted on opposite sides of the vertical support column 422 (shown in phantom), above and below the nozzle 420 (not shown). The individual wheels 440 are circumferentially grooved in order to ride on opposing corners of the vertical column 422. Each pair of tracking wheels 440 are disposed on a tracking wheel bracket 442A, 442B via sealed bearings. These brackets 442A, 442B keep the individual wheels compressed against the vertical column 422, enabling precise alignment of the nozzle 420 captured therein. Connected between the brackets 442A, 442B is an interconnecting plate 444 which maintains a fixed distance between the brackets 442A, 442B and provides a rigid platform for conveying the nozzle 420 across the wall 412. Both tracking wheel brackets 442A, 442B are positioned to avoid interference with a drive shaft 429 (shown in phantom and cross-section).

Securely disposed within at least one of aligned passages 451 is a threaded bushing (not illustrated) through which a vertical screw shaft 446 (also shown in phantom) passes. As the screw shaft 446 is rotated, the entire nozzle mounting system 434, of which the elements of FIG. 22 form a part, is elevated or lowered, proximate the wall 412. In a preferred embodiment, the bushing is formed of Delran™, and the brackets 442A, 442B and the interconnecting plate 444 are formed of aluminum. The screw shaft 446 may be interfaced by one bushing in one of the brackets 442A, 442B, or by one bushing in each of the two brackets 442A, 442B.

The nozzle 420 and nozzle mounting system 434 are further illustrated in FIGS. 23 through 26. A right-hand plate 700 mounts on the interconnecting plate 444 via use of the eight holes formed in the interconnecting plate 444, best viewed in FIG. 22. Opposite the right-hand plate 700 is a left-hand plate 702, with the nozzle 420 disposed therebetween. The relative spacing between the right- and left-hand plates 700, 702 is maintained in part by cross members 704 secured to each plate 700, 702. In addition, a funnel 458, which channels fluent material from the nozzle 420 onto the wall 412, is secured to the right- and left-hand plates 700, 702 by welding.

Figure 26:
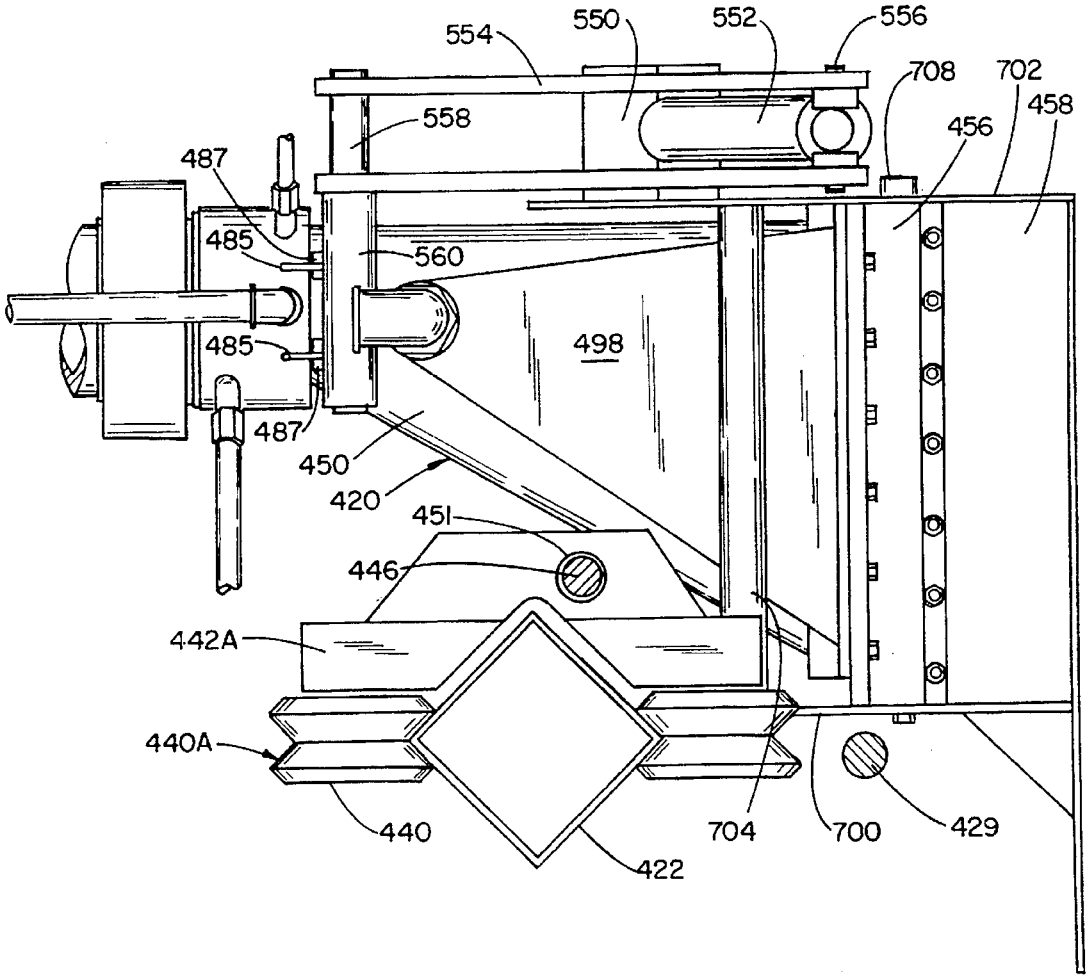
FIG. 26 is a top view of the nozzle and nozzle mounting system as used in the system of FIG. 21.
Figure 27:
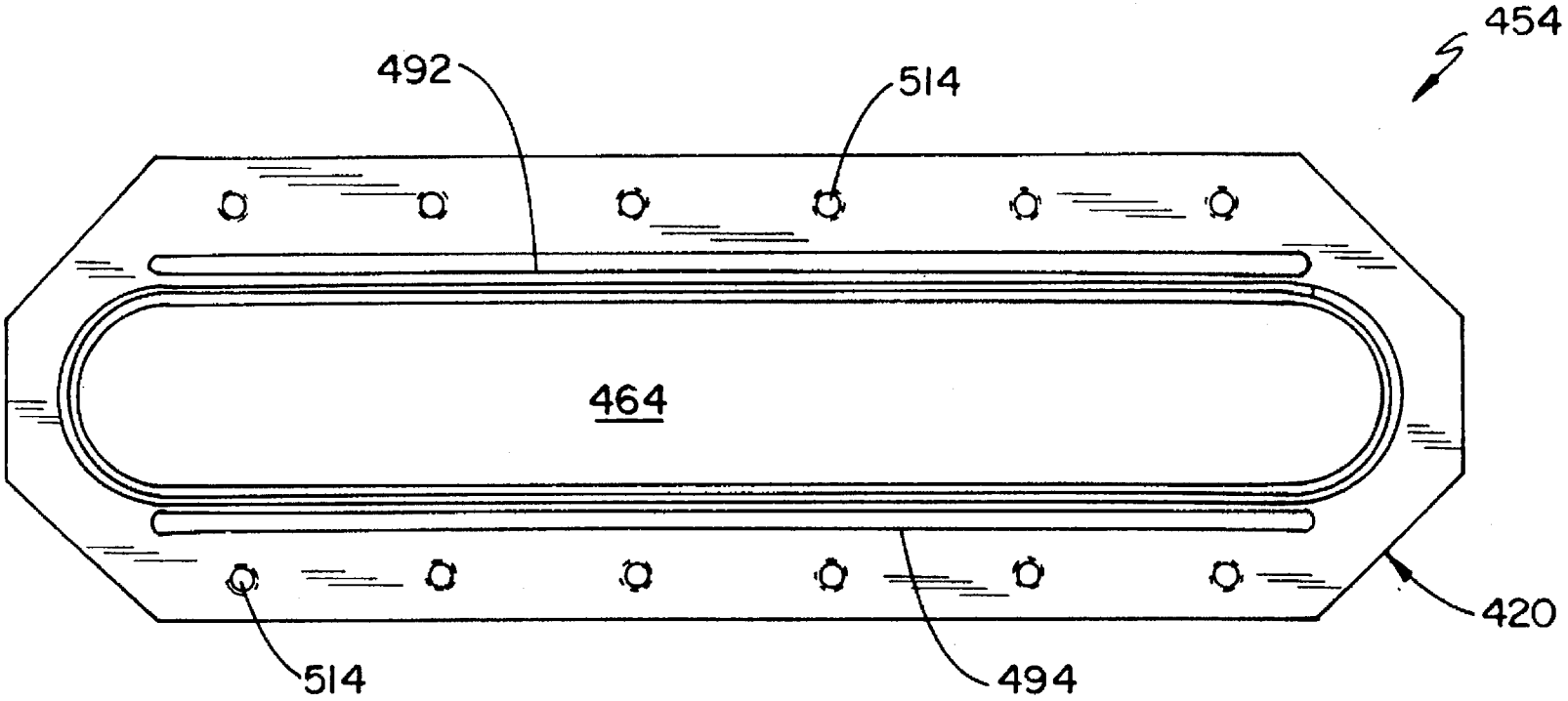
FIG. 27 is a rear end view of a nozzle body as used in the system of FIG. 24.
Figure 28:
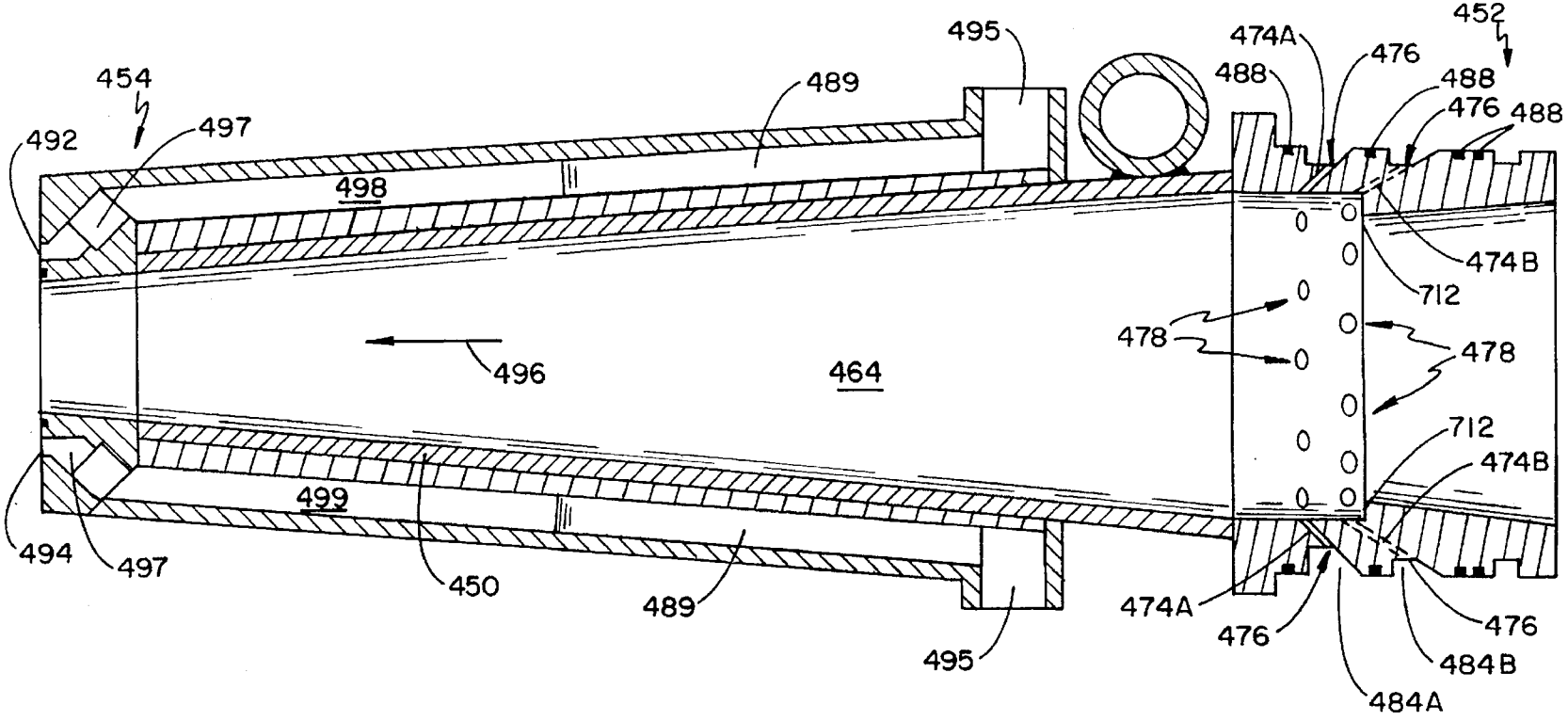
FIG. 28 is a left side section view of the nozzle body of FIG. 27.

Elements which further comprise the nozzle 420 and the nozzle mounting system 434 are best viewed with reference to FIGS. 26 through 28. The nozzle 420 includes a nozzle body 450 having a posterior end 452 and an anterior end 454, a swivel joint 456, and a funnel 458 having a convergent end 460 and a divergent end 462. These parts are formed of hardened steel in a first embodiment. Within each of these elements is a chamber 464 through which fluent material is transported toward the wall 412. In order to enhance the free flow of material through the chamber 464, in one embodiment, the interior of the nozzle 420 (i.e. the chamber 464) is coated with non-porous ceramic or another adherence resistant material such as Teflon™. This preferably includes the interior of the swivel joint 456 and the funnel 458.

In general terms, fluent material such as concrete is pumped into the posterior end 452 of the nozzle body 450, through the anterior end 454 disposed at the swivel joint 456, through the funnel 458, and onto the wall 412. Note that in a preferred embodiment, the nozzle body posterior end 452 has a circular cross-section, enabling simplified mating to standard high pressure hose couplings. Specifically, one embodiment of the nozzle body posterior end 452 mates to a four-inch diameter high-pressure hose.

The nozzle body 450 geometry changes as one progresses from the posterior end 452 to the anterior end 454, at which point the cross-section is oblong, as viewed in FIG. 27. The purpose of the change in geometry from circular to oblong is to enable the even application of material across a wide swath of wall 412 relative to the diameter of the supply hose. The chamber opening at the anterior end 454 of the nozzle is approximately 11.75 inches wide and two inches high in one embodiment.

As noted above, a swivel joint 456 is disposed at the nozzle body anterior end 454, between the nozzle body 450 and the funnel 458, parallel to planes defined by both the ground and the wall 412 and orthogonal to the right- and left-hand plates 700, 702. The swivel joint 456 is secured to the nozzle body 450 via threaded fasteners in one embodiment and enables the nozzle body 450 to pivot with respect to the funnel 458, the benefit of which will be described subsequently.

Figure 29:
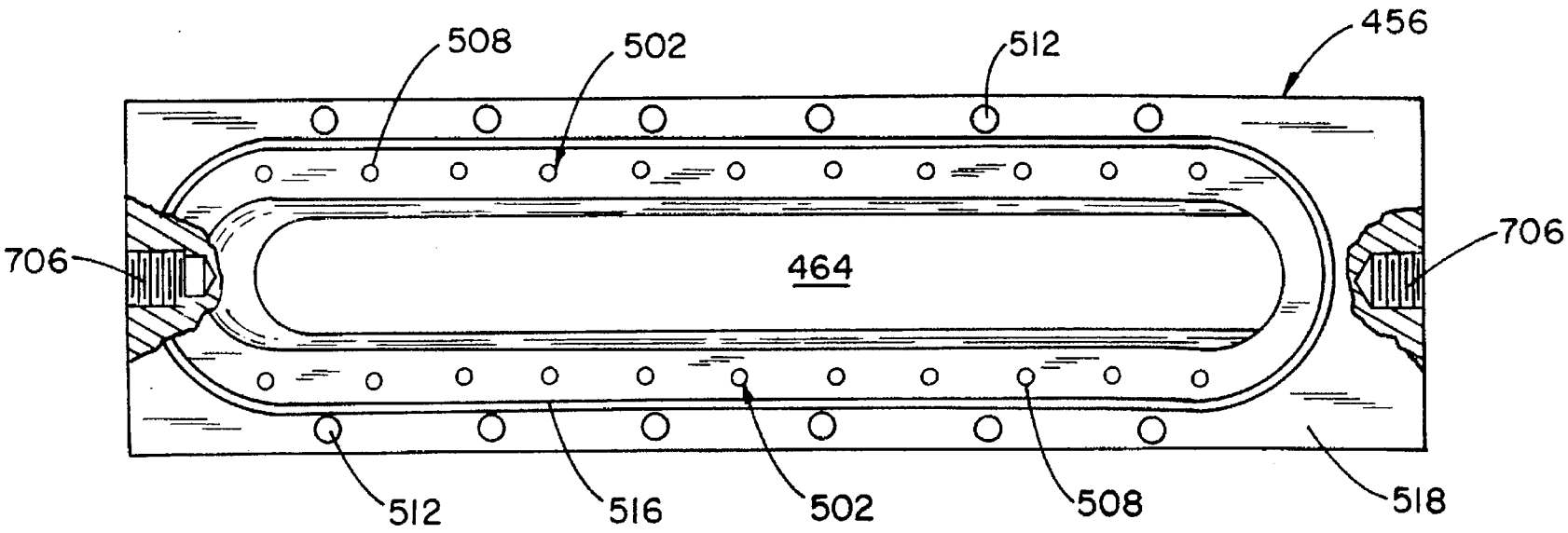
FIG. 29 is a rear end view of a swivel joint as used in the system of FIG. 21.
Figure 31:
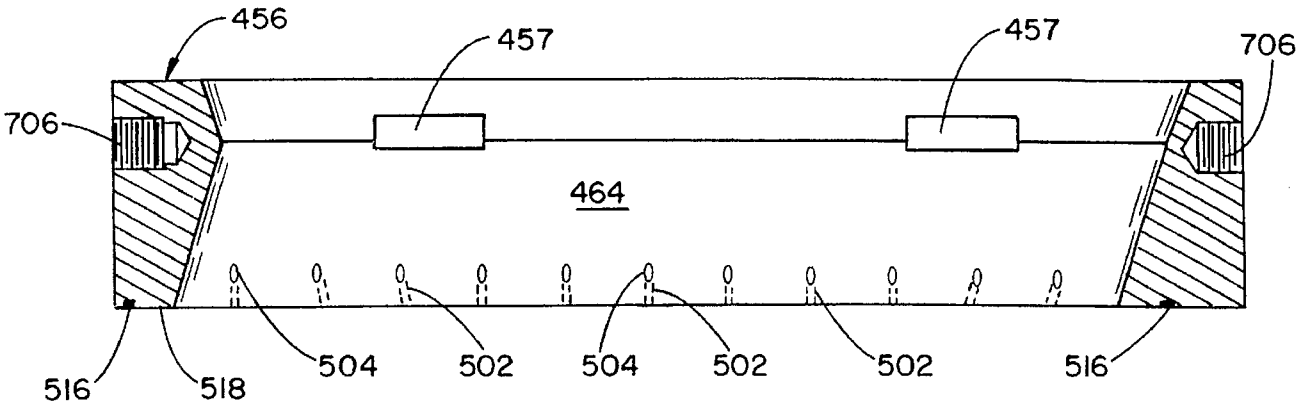
FIG. 31 is a top section view of the swivel joint of FIG. 29.
Figure 30:
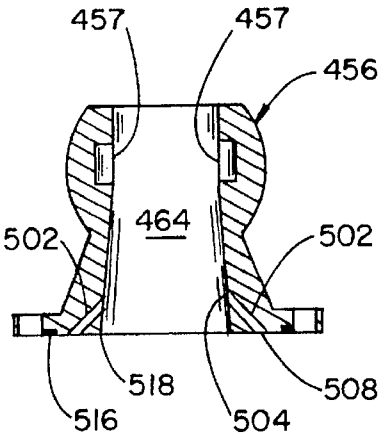
FIG. 30 is a side section view of the swivel joint of FIG. 29.

As illustrated in FIGS. 29 through 31, the swivel joint 456 has opposing fastener cavities 706 which allow threaded fasteners, extending through holes formed in the right- and left-hand plates 700, 702, to capture the swivel joint 456 between the plates 700, 702. In one embodiment, the threaded fastener extending through the left-hand wall 702 into the swivel joint 456 extends outside the wall 702 and is captured by a potentiometer 708 (FIG. 26) which provides input indicative of the nozzle 420 angular position to a processor 582, to be described further herein.

In order to enable independent movement of the swivel joint 456 with respect to the funnel 458 and to prevent the escape of pressurized fluent material from this interface, strips 710 of pliant material such as rubber or another elastomer are disposed on the funnel convergent end 460. Threaded fasteners are provided to secure these strips to the funnel 458.

The funnel convergent end 460 is located adjacent the swivel joint 456 and the divergent end 462 is typically disposed proximate the wall 412 to be finished. The funnel 458 further enables the automated material delivery system 410 to apply an even distribution of fluent material across a relatively wide portion of the wall 412 with respect to the supply hose diameter. In a preferred embodiment, the chamber opening at the funnel divergent end 462 is approximately twenty inches wide and approximately eight inches high. Further, the funnel divergent end 462 being typically disposed an inch from a wire grid screen of the wall 412 surface, the material is further distributed in an oblong pattern. By conveying the nozzle 420 vertically along the wall 412, successive, adjacent swaths or stripes of material are applied. Further detail regarding the manipulation of the nozzle 420 with respect to the wall 412 will be provided subsequently.

As shown in FIG. 28, disposed proximate the posterior end are sets of downstream posterior end conduits 474A formed in the nozzle body 450 to conduct compressed air into the chamber 464 within. The downstream posterior end conduits 474A each have a respective entrance port 476 at the nozzle body outer surface and an exit port 478 opening into the chamber 464. In an alternative embodiment of the present invention, each entrance port 476 is radially offset from its respective exit port 478 in order to introduce circular rotation in the fluent material as it progresses through the nozzle 420, in the direction of downstream arrow 496.

The entrance and exit ports 476, 478 are longitudinally offset with respect to the nozzle body 450, with the exit ends 478 being more downstream (with respect to downstream arrow 496) than the entrance ports 476. This tends to accelerate the fluent material flow through the chamber 464 and toward the wall 412. Conduit pitch, diameter, and number depend upon factors such as the type of fluent material used, the distance from the funnel divergent end 462 to the wall 412, and the rate of material application to the wall 412.

In an alternative embodiment of the presently disclosed system 410, powdered or finely ground material such as a hardening agent or accelerant is introduced into the fluent material flow at the nozzle body posterior end 452 via the posterior end downstream conduits 474A. This accelerant promotes the hardening of fluent material such as concrete once it has been applied to the wall 412. Adequate conduit 474A diameter can be specified to enable this introduction.

Also disposed at the nozzle body posterior end 452 are upstream conduits 474B. The entrance and exit ports 476, 478 of the latter conduits 474B are significantly longitudinally offset with respect to the nozzle body 450, with the exit ports 478 being more downstream (with respect to downstream arrow 496) than the entrance ports 476. This longitudinal offset can be greater than that of the downstream conduits 474A. The upstream conduits 474B are preferably laterally offset with respect to the downstream conduits 474A, as shown in FIG. 28, to promote a more even distribution of compressed air against the fluent material.

In one embodiment of the present invention, the chamber 464 within the nozzle body 450 in the vicinity of the exit ports 478 has an abrupt increase in diameter 712. The exit ports 478 for the upstream and downstream posterior end conduits 474A, 474B are disposed proximate this abrupt diameter increase 712. In one embodiment, the exit ports 478 for the upstream conduits 474B are disposed immediately downstream of this diameter change. Alternatively, the same exit ports 478 are disposed along the diameter change 712, facing the wall 412. In either case, compressed air, typically from the same source as that used for the downstream conduits 474A, creates a compressed air cavity from the abrupt diameter increase 712 to a point downstream of the downstream conduit 474A exit ports 478. This enables an even distribution of compressed air against the fluent material as the latter is pumped past the exit ports 478, and results in a consistent acceleration of the material.

In alternative embodiments of the present invention, the posterior end conduits 474A, 474B are not evenly distributed about the interior surface of the chamber 464, but rather are distributed in a higher concentration in one or more radial regions to impart a desired distribution of accelerations in the passing fluent material. Further, the diameter of the these conduits 474A, 474B need not be identical, but can be selected to impart a desired distribution of air pressures to the fluent material. Overall, characteristics of the conduits 474A, 474B such as diameter, radial offset, and inclination are chosen based upon the physical characteristics of the compressed gas and particulate matter conveyed therethrough. While air has been recited as the preferred gas, other gases can be employed depending upon the application.

Figure 23:
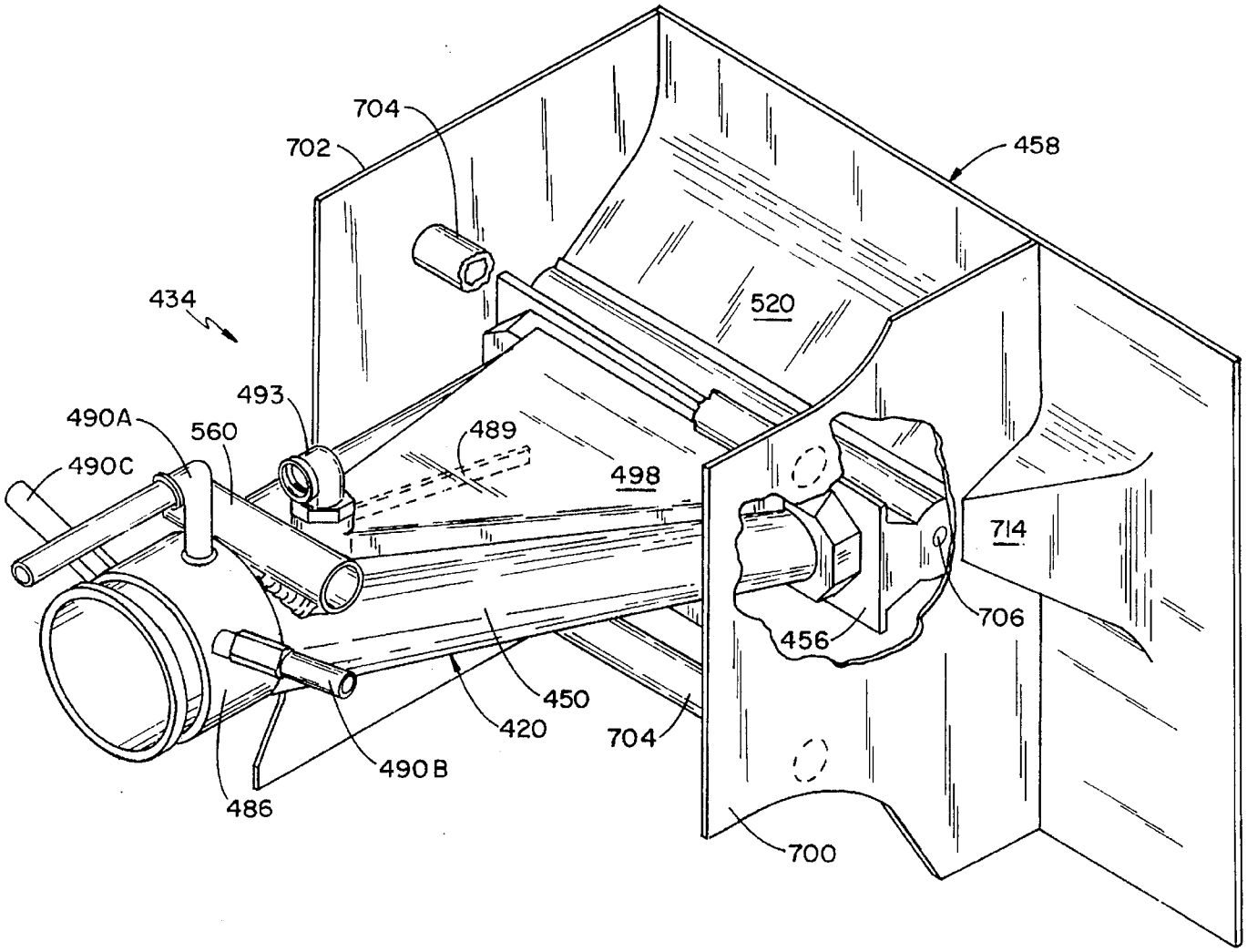
FIG. 23 is a top-right-front perspective view of a nozzle and nozzle mounting system as used in the system of FIG. 21.

Compressed gas is provided to the posterior end conduits 474A, 474B via respective posterior end plenums 484A, 484B formed between the nozzle body posterior end 452 and a rigidly attached collar 486, as shown in FIG. 23. While one collar 486 forming two plenums 484A, 484B is illustrated in this figure, two distinct collars, each fixedly attached to the nozzle, can be used to achieve the same result. The collar 486 is preferably provided with one or more pins 485 projecting toward and parallel to the surface of the nozzle body. These pins 485 are captured within cooperating sockets 487 formed on the nozzle posterior end 452. By preventing the collar from rotating, the potential for tangled hoses is minimized.

In order to provide an air tight seal between the collar 486 and the nozzle body 450, four seals such as O-rings 488 are provided. A further benefit of maintaining the collar 486 in a fixed position relative to the nozzle 420, there is less chance that these seals 488 will degrade over time with repeated wear. This is particularly important as compressed gas (and particulate matter such as accelerant, if used) is provided to the downstream plenum 484A via the collar 488 at a first downstream coupling 490A. This plenum 484A supplies compressed gas to the chamber 464 via the posterior end downstream conduits 474A. Worn, leaking seals would impair the ability of the disclosed system to operate at high air pressure.

Another downstream coupling 490C is provided in the illustrated embodiment. Here, a source of solvent such as water is connected for flushing out the nozzle after use to avoid the formation of hardened concrete within the nozzle.

A second source of compressed gas, typically from the same source of compressed gas as that supplied to the downstream plenum 484A, is supplied to the upstream plenum 484B via an upstream coupling 490B and thus through the posterior end upstream conduits 474B.

As noted previously, the nozzle body 450 changes shape as one moves from the posterior end 452 to the anterior end 454. Specifically, and as evident in FIGS. 24, 26 and 27, the nozzle body 450 narrows in height but expands significantly in width. As shown in FIGS. 27 and 28, at the anterior end 454 of the nozzle body 450, upper and lower anterior end plenums 492, 494 face downstream, as indicated by downstream arrow 496. Also illustrated is an inner sealing ring 500, such as an O-ring, for mating the nozzle body 450 anterior end 454 to the swivel joint 456.

The upper and lower plenums 492, 494 receive compressed air from respective upper and lower compressed air chambers 498, 499 formed above and below the nozzle body 450. Passages 497, such as cylindrical openings in the anterior end 454 of the nozzle body 450, allow compressed gas within the chambers 498, 499 to enter the upper and lower plenums 492, 494. Each chamber 498, 499 has a respective orifice 495 into which is fitted a compressed air coupling 493 (shown in FIG. 23) for communication with a source of compressed gas.

In order to evenly distribute compressed gas throughout the upper and lower compressed air chambers 498, 499, a wing wall 489 (shown in phantom in FIG. 23 and in profile in FIG. 28) is provided in a first embodiment of the present material delivery system 410. This wall 489 aids in evenly channeling compressed gas to the upper and lower plenums 492, 494 of the anterior end 454. The number of passages 497 and the geometry of the chambers 498, 499, wall 489, and associated fittings are configured according to the needs of the particular embodiment.

Portions of the swivel joint 456, as illustrated in FIGS. 29, 30, and 31. The swivel joint 456 has a rearward face 518 attached to the nozzle body anterior end 454 via fasteners such as screws disposed in swivel joint screw holes 512 and in cooperating nozzle body screw holes 514 (FIG. 27). Disposed across a long dimension of the swivel joint 456, both above and below the chamber 464, are anterior end conduits 502 having respective entrance ports 508 disposed on the rearward face 518. As with the posterior end conduits 474A, 474B described above, the anterior end conduits 502 are offset longitudinally in one embodiment in order to accelerate the fluent material through the adjoining funnel 458 and onto the wall 412.

In a preferred embodiment of the present invention, compressed gas is provided to the chamber orifices 495 via conduits which have adjustable valves such as solenoid driven valves. Thus, the air pressure delivered into the inner chamber 464 at the anterior end conduits 502 is adjustable to provide higher gas pressure from the higher set of conduits 502 (via upper chamber 498) by constricting the pressurized gas supply line to the lower chamber 499, thus driving fluent material downward through the funnel 458. The reverse situation is also enabled, where higher gas pressure is provided from the lower set of conduits 502 (via the lower chamber 499) by constriction of the pressurized gas supply line to the upper chamber 498. As will become evident in conjunction with a description of system 410 operation, this ability to "steer" the fluent material flow from the funnel 458 is highly desirable.

The swivel joint 456 is also provided with several semicircular dados 457 in one embodiment which receive a nozzle plug 461, also known as a flushing plug, used during a nozzle cleaning process. With oval plates 463 in place within the dados 457, water introduced through the downstream posterior end conduits 474A flushes out the interior of the nozzle body 450. The dados 457 are further configured to enable the suspension of the swivel joint 456 and nozzle body 450 from the plug. The swivel joint must be removed from the funnel convergent end 460 to install the plug 461.

Once the swivel joint 456 rearward face 518 is attached to the nozzle body anterior end 454, the entrance ports 508 of the anterior end conduits 502 are aligned with respect to the anterior end upper and lower plenums 492, 494. The previously described inner sealing ring 500 on the nozzle body anterior end 454 provides a seal against plenum 492, 494 pressure loss, as does an outer sealing ring 516 disposed in the swivel joint rearward face 518. The latter sealing ring 516 can also be formed from an O-ring.

Selected anterior end conduits 502 within the swivel joint 456 are radially offset such that the conduit extends toward the center of the swivel joint 456 as air progresses from the entrance port 508 to an exit port 504. The purpose of this pitch in selected ones of the anterior end conduits 502 is to promote an even distribution of fluent material throughout the adjoining funnel 458.

Pivotably disposed on the swivel joint 456, opposite the nozzle body 450, is the funnel 458. As noted previously, the funnel 458 has a convergent end 460 at the swivel joint 456 and an opposite divergent end 462 which is typically placed proximate the wall 412.

Figure 24:
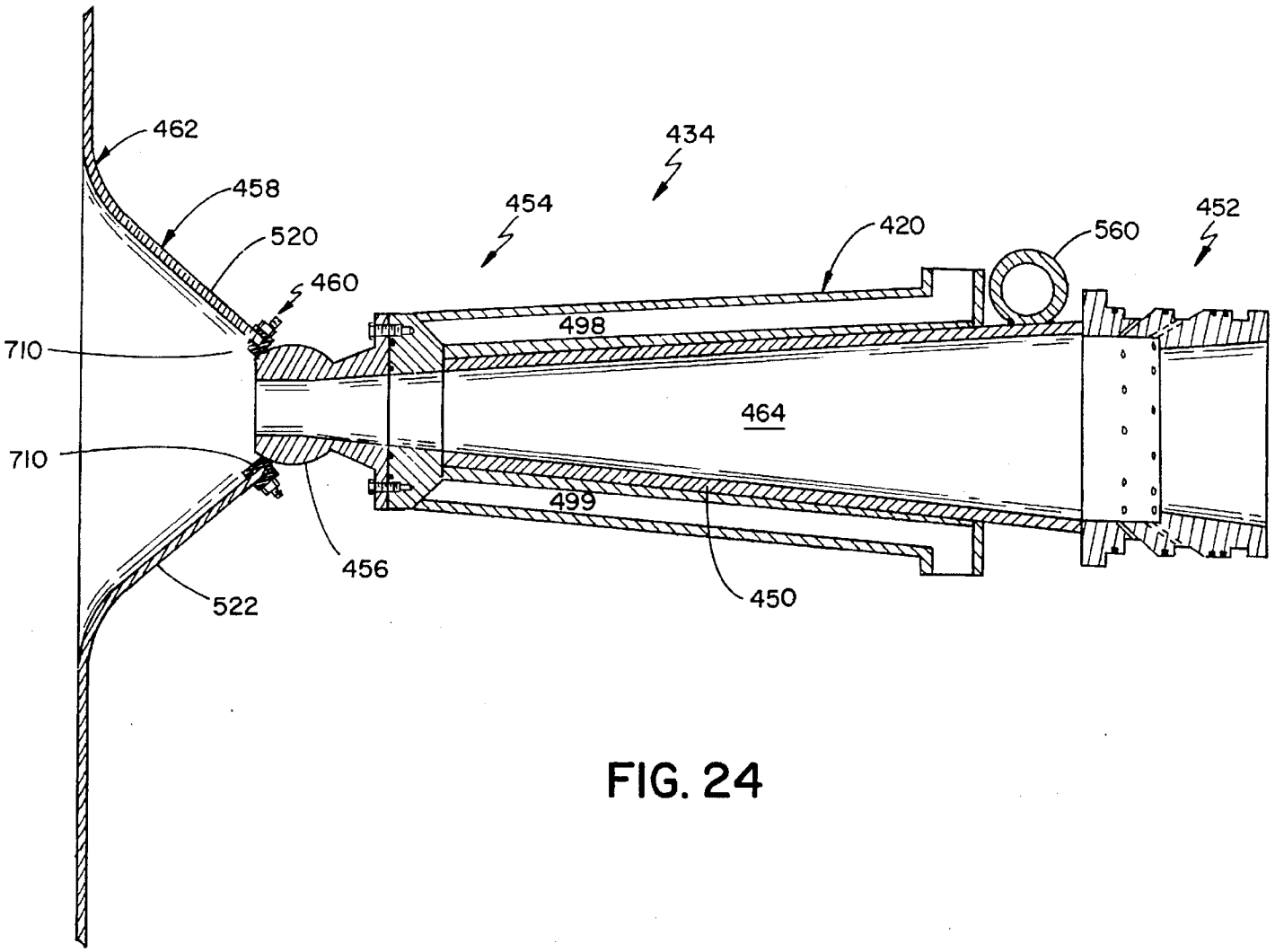
FIG. 24 is a left side section view of a nozzle of FIG. 23.

Two major parts of the funnel 458 are the upper and lower plates 520, 522, as shown in FIGS. 23 and 24. The upper plate 520 begins at the swivel joint 456 and proceeds upward and toward the wall 412 at approximately forty-five degrees from horizontal. Approximately three and one-half inches (measured horizontally) from the swivel joint 456, the upper plate 520 arcs upward to proceed vertically for another four inches, ending at an upper plate top edge 524. Similarly, the funnel lower plate 522 proceeds downward at a forty-five degree angle from horizontal for three inches and one-half inches (measured from the horizontal), then vertically downward for another six and one-half inches, ending at a lower plate bottom edge 526. The vertical portions of the upper and lower plates 520, 522 serve to smooth out any gross deviations in the applied fluent material as the nozzle 420 proceeds vertically along the wall 412. The recited measurements are for an illustrative embodiment; other dimensions are possible.

As previously noted, the upper and lower plates 520, 522 are affixed to the right- and left-hand plates 700, 702. Specifically, the upper and lower plates 520, 522 are welded along the entire interface between the left-hand plate 702 and the upper and lower plates 520, 522. Thus the left-hand plate 702 partially defines a portion of the chamber 464.

At the interface between the right-hand plate 700 and the funnel 458, the right-hand plate 700 is cut away, allowing the funnel 458 to project beyond the right-hand plate 700. A cap plate 714 is affixed to the rearward facing portion of the extended funnel 458 to channel fluent material onto the wall 412. This cap plate 714 has a substantially trapezoidal shape, with the shortest edge affixed to the outside of the right-hand plate 700, and the adjacent side edges affixed to respective upper and lower funnel plates 520, 522.

Figure 25:
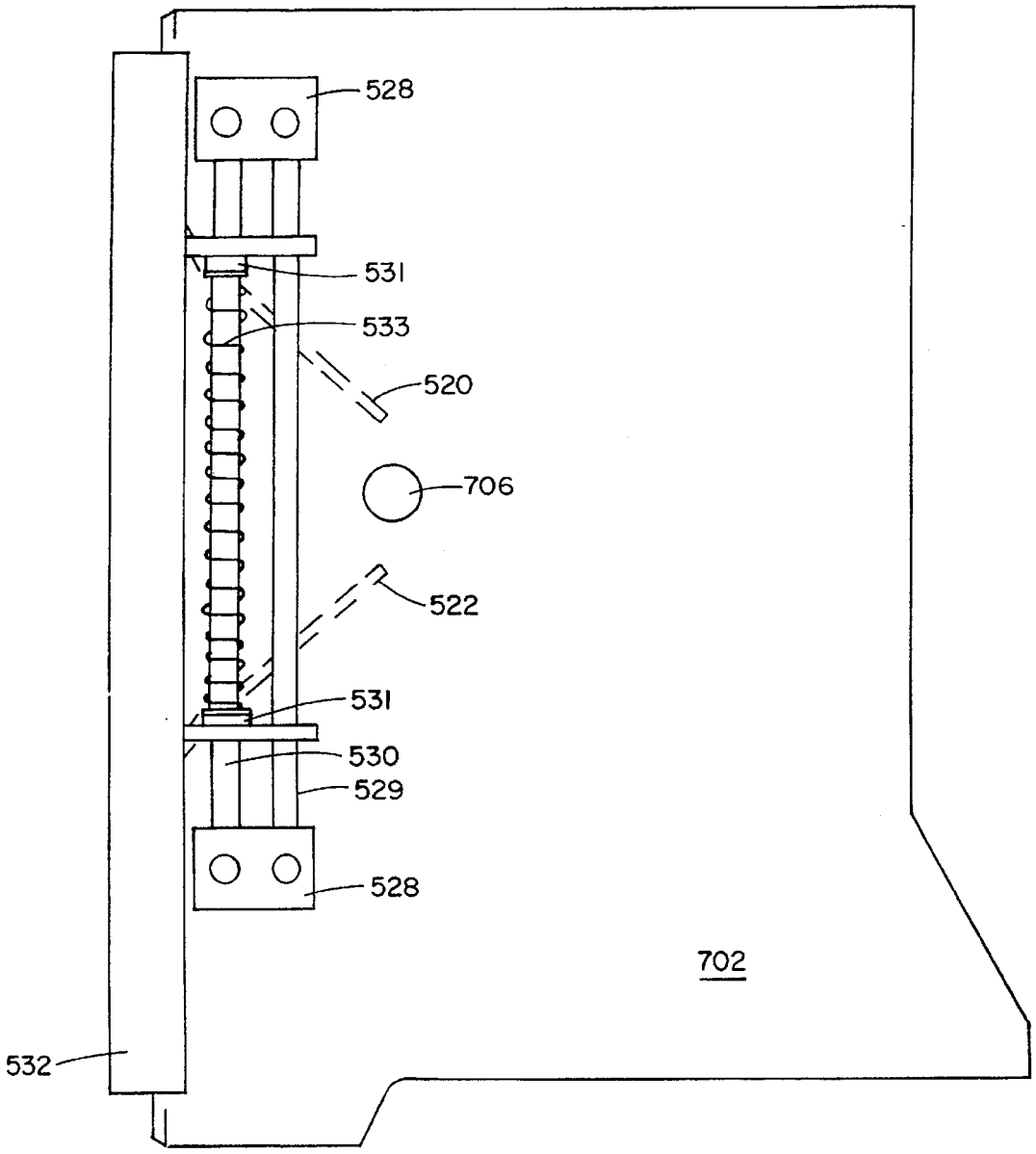
FIG. 25 is a left side view of a side dam mounted on a left-hand plate as used in the system of FIG. 21.

As shown in FIG. 25, a side dam 532 is resiliently mounted to the left-hand plate 702 for limited vertical motion from a neutral position. For purposes of illustration, the upper and lower funnel plates 520, 522 are illustrated in phantom, and the swivel joint fastener cavity 706 is also shown. Other previously described details are omitted. This dam 532 is attached to the left-hand plate 702 via two mounting blocks 528 having left and right rods 530, 529 extending therebetween. The left rod 530 in the illustrated embodiment is provided with a resilient member such as a coil spring 533 disposed between two washers 531. The washers are capable of movement against the spring force only. Extensions from the side dam 532 are slidably captured on the left and right rods 530, 529, and enable the side dam 532 to move either up or down against the spring force. The purpose of the dam is to keep applied fluent material on the wall 412 directly in front of the funnel 458; it prevents material from being ejected along the wall 412 to the left of the nozzle 420. As the nozzle mounting system 434 moves vertically upward proximate the upper bracket 432, the side dam, which is more proximate to the wall 412 than the upper, lower or left-hand plates 520, 522, 702, is urged downward as it bumps against a lower corner of the upper bracket 432. Once the mounting system 434 begins moving vertically downward again, the side dam assumes the neutral position once again. Similarly, as the mounting system 434 approaches the lower travel limit, the side dam is driven against the lower bracket 430 and consequently is urged upward.

As noted, the right-hand side of the funnel 458 has a cap plate 714 which prevents applied material from passing to the right of the nozzle mounting system 434. There is no need to provide an analogous dam on the right side, since fluent material is already applied on this side, thus preventing material from being ejected to the right. This assumes that the normal operating direction for the present invention is right to left. It is understood that the opposite convention could be employed, in which case, the nozzle 420 and its affiliated equipment would be fashioned as a mirror image of that described herein.

Figure 32:
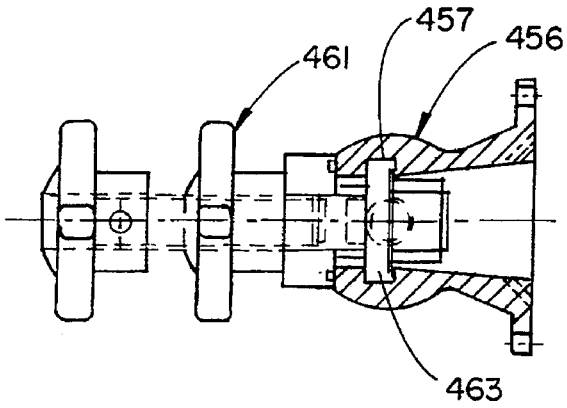
FIG. 32 is the swivel joint side section view of FIG. 30, also showing a flushing plug in place.
Figure 33:
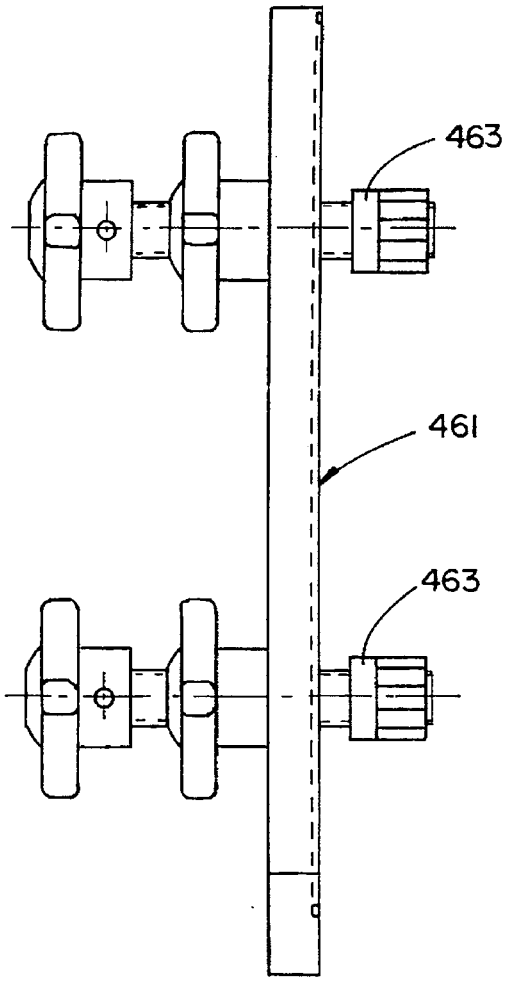
FIG. 33 is a plan view of the flushing plug of FIG. 32.
Figure 34:
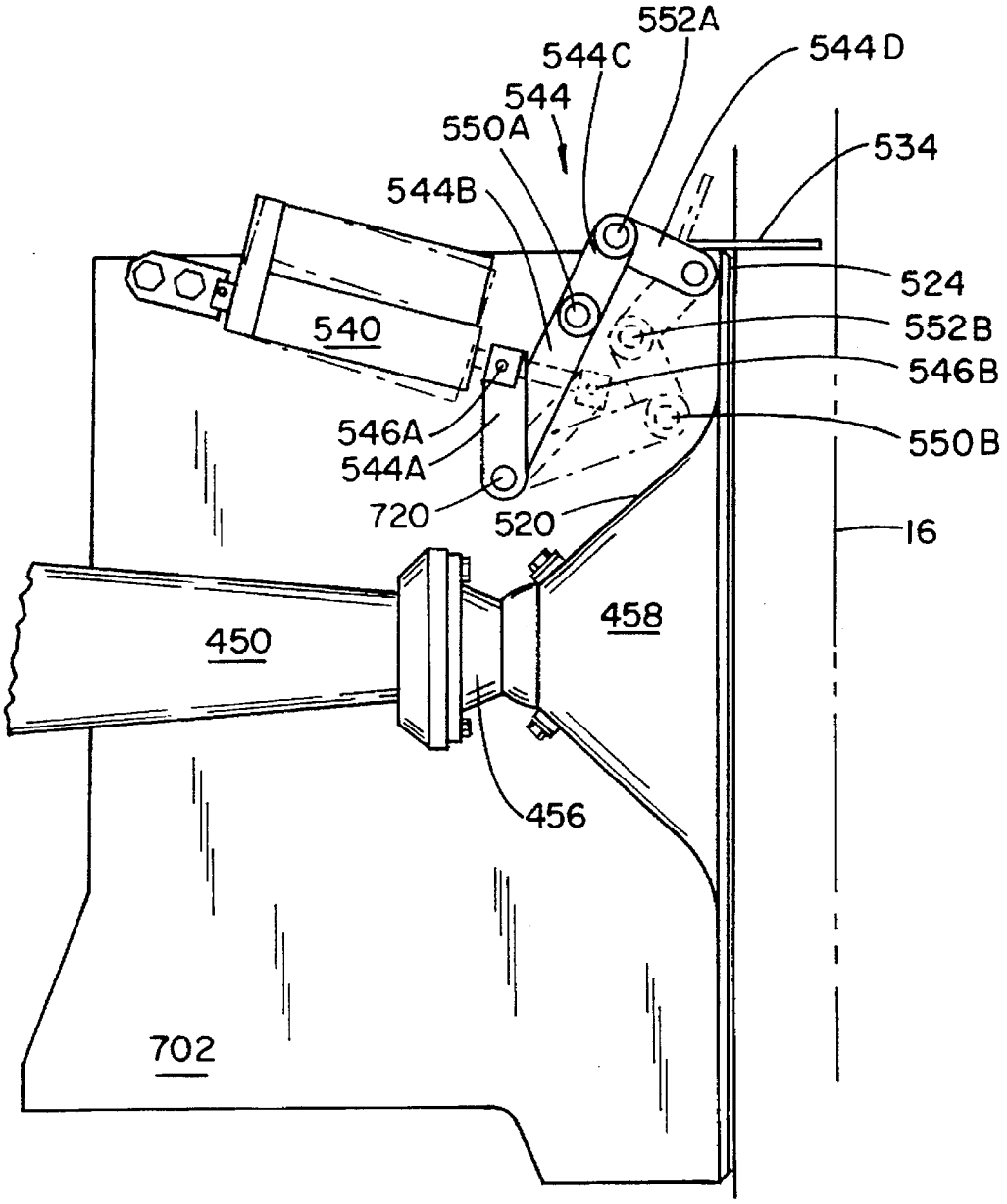
FIG. 34 is a partial right side view of the nozzle and nozzle mounting system of FIG. 23.

Rotatably attached along the top edge 524 of the funnel upper plate 520 is an upper flap 534 approximately one inch wide, as shown in FIGS. 32 and 33. Similarly, as shown in FIG. 34, a lower flap 536, also approximately one inch wide, is rotatably attached along the bottom edge 526 of the lower plate 522. These flaps 534, 536, preferably provided with a coating of non-stick material such as Teflon™, are provided in order to keep fluent material on the wall 412 directly in front of the funnel 458 rather than exiting above or below the nozzle 420. Note that the lower flap 536 is preferably angled approximately forty-five degrees away from the wall 412. Thus, as material is driven against this lower flap 536, it is gradually allowed to fall against the wall 412. Otherwise the weight of collected material against a flap orthogonal to the wall might cause flap linkage 546 failure.

As the nozzle 420 and the mounting system 434 move vertically upward, the nozzle 420 leaves a swath of applied fluent material below it. Therefore, the just-applied material prevents any further material from exiting below the nozzle 420. In order to prevent fluent material from escaping upwardly, the upper flap 534 is swung into position such that it extends perpendicular to the wall 412 and to the upper plate 520 vertical portion, close (roughly one-eighth inch) to the wire grid screen 16, 18 (if a wall system such as that illustrated in FIG. 2 is used) or to a wall 412.

Likewise, when the mounting system 434 travels vertically downward, it leaves a swath of applied material above it. Thus, the upper flap 534 is retracted, and, to prevent material from exiting below the nozzle 420, the lower flap 536 is swung into position.

The position of each of these flaps 534, 536 is controlled by respective upper and lower actuators 540, disposed on the left-hand plate 702, above and below the nozzle body 450. Between each of the flaps 534, 536 and the respective actuator 540, is a respective linkage 544, 546. The upper linkage 544 has a fixed pivot point 720, and the lower linkage has a fixed pivot point 722, each of which is affixed to the left-hand plate 702. Each actuator/linkage/flap combination operates similarly. Therefore, only the operation of the upper combination will be discussed, as follows.

With reference to FIG. 32, as an upper actuator 540 shaft extends from point 546A to 546B, first upper link 544A rotates clockwise about pivot point 720. This causes second upper link 544B to rotate clockwise about the pivot point 720 such that a far end of this second link 544B rotates from point 550A to point 550B. A far end of third upper link 544C is thus displaced from point 552A to 552B, which in turn rotates fourth upper link 544D counterclockwise. The upper flap 534, connected to the fourth upper link 544D, is thereby rotated counterclockwise and out of position. The retraction of the upper actuator 540 shaft causes the flap 534 to rotate clockwise, into position.

As the nozzle mounting system 434 approaches the uppermost vertical travel limit, it is necessary to rotate the upper flap 534 out of position to avoid driving the extended flap 534 into the upper bracket 432. This is done at the last possible moment to avoid allowing fluent material to expand upwardly. Similarly, the lower flap 536 is swung out of position just before being driven into the lower bracket 430. To prevent such ejection of fluent material, an alternative embodiment of the present invention, shown in FIGS. 33 and 34, provides strips of resilient material 724 such as rubber along lower edges of the upper bracket 432, and upper edges of the lower bracket 430. These strips 724 extend approximately one-quarter inch from the respective bracket 430, 432, which is sufficient to prevent the ejection of significant amount of fluent material. Cleaning of the funnel surface facing the wall 412 is also effected by provision of the strips 724.

The foregoing discussion of flap 534, 536 positioning with respect to mounting system 434 movement is expanded in further detail below.

As the mounting system 434 is driven vertically upwards along the wall 412, it is preferred to tilt the nozzle body 450 downward with respect to the wall 412 in order to avoid the creation of air pockets or bubbles in the fluent material on the wall. Specifically, as the mounting system 434 is driven upwards, it is preferred to angle the nozzle body 450 downward by approximately thirty degrees. This ensures that fluent material is forced down into the cavity formed between the funnel 458 and the wall 412 first. Any excess is then driven upwards and added to as the system 434 is raised. Further, if particulate material of any size is ejected form the nozzle, it will tend to get lodged in the just-applied fluent material, rather than ricocheting upwards.

At the upper edge of the wall 412, shown in FIG. 33, the nozzle body 450 is pivoted sixty degrees about the swivel joint 456 (the nozzle body 450 now angling upward approximately thirty degrees) just prior to driving the mounting system 434 laterally across the wall 412 in preparation for depositing an adjacent vertical swath.

As discussed previously with regard to FIG. 28, the quantity of compressed gas supplied to each of the upper and lower chambers 498, 499 formed above and below the nozzle body 450 is adjustable in order to effectively steer the fluent material flow as it exits the funnel 458. This ability is employed in conjunction with the angulation of the nozzle body 450. Thus, as the nozzle approaches the top of the wall 412, the gas pressure within the upper chamber 498 is decreased, allowing the material stream to angle upwards. At the same time, the nozzle body 450 is angled about the swivel joint 456 until it is pointing upward by thirty degrees. At this point, the gas pressure within the two chambers 498, 499 is equalized. Thus, the ability to steer the fluent material via a chamber pressure differential compensates for the time it takes to angle the nozzle body 450.

Once moved laterally, the mounting system 434 then moves downward. At the lower extreme, shown in FIG. 34, the nozzle body 450 is pivoted upward sixty degrees to a position thirty degrees above horizontal, moved laterally across the wall 412, then upward again. Once again, details as to mounting system 434 movement are provided subsequently.

This angulation of the nozzle body 450 is accomplished by the use of a third motor 550 disposed on the outside surface of the left-hand plate 702 of the nozzle mounting system 434 and shown in FIG. 26. Specifically, the third motor 550 is an electric motor pivotably connected at a lower end to the left-hand plate 702, and an upper end of this third motor 550 is connected to a lifter arm 552 which preferably is a screw shaft rotated by the third motor 550. An upper end of this lifter arm 552 is connected to a first end of a lifting link 554, which in one embodiment is comprised of two parallel plates disposed on either side of a swivelling pin 556 atop the lifter arm 552. The lower end of the lifting link 554 has a lifting pin 558 extending across and above the nozzle body 450, into a cylindrical shaft 560 attached to a top surface of the nozzle body 450. Thus, as the third motor 550 rotates in a first direction, the lifter arm 552 extends with respect to the nozzle mounting system 434, lifting the lifting link 554 and consequently pivoting the nozzle body 450 upward about the swivel joint 456. Likewise, rotation of the third motor 550 in an opposite direction results in pivoting the nozzle body 450 downward about the swivel joint 456.

Figure 38:
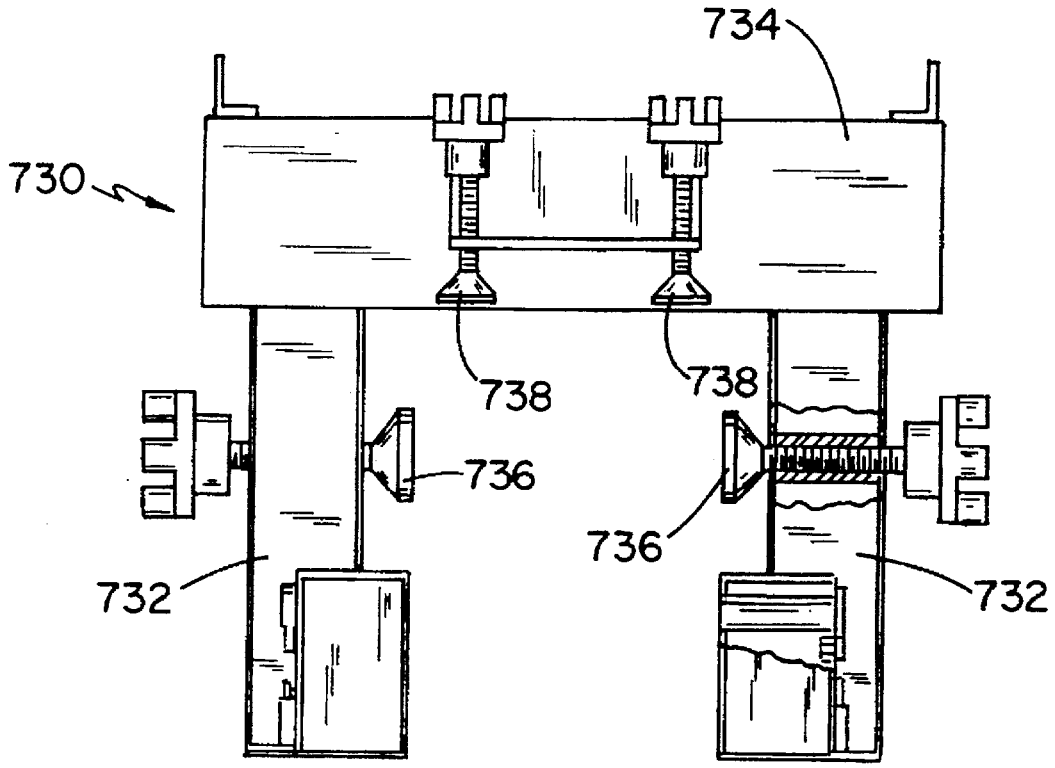
FIG. 38 is a front view of the drill guide of FIG. 37.

A lower brace 424 of the automated material delivery system 410 is illustrated in FIG. 38. The lower brace 424 has a horizontal member 426 which extends the length of the lower brace 424. Extending from a lower surface of the horizontal member 426 at each end thereof is a lower wheel support similar to that depicted with respect to the brace of the previously described trowelling system, as shown in FIGS. 3 through 5. In an alternative embodiment, more than two lower wheels are employed for supporting the system 410 from below. Also included are follower wheel supports and wheels as previously described.

If the wall to be coated 412 is of the wire grid-styrofoam composite type discussed with respect to FIG. 2, both sides of the wall 412 will need an application of finishing material. In order to increase efficiency, it is preferred, though not necessary, to attach lower brackets 30 to both sides of the footer 26 prior to commencing work on a first side. In FIG. 5, a number of lower bracket screws 33 are visible, and are distributed along the lower bracket as required based upon the load expected to be supported by the lower bracket 30 as a result of the movement of the material delivery system 410 or any other equipment utilizing the bracket 30. Consecutive sections of lower brackets 30 can be joined by use of connecting plates (not shown) which are rigidly affixed to the brackets 30, thus enabling smooth progression of the material delivery system 410 along the wall 412.

Figure 35:
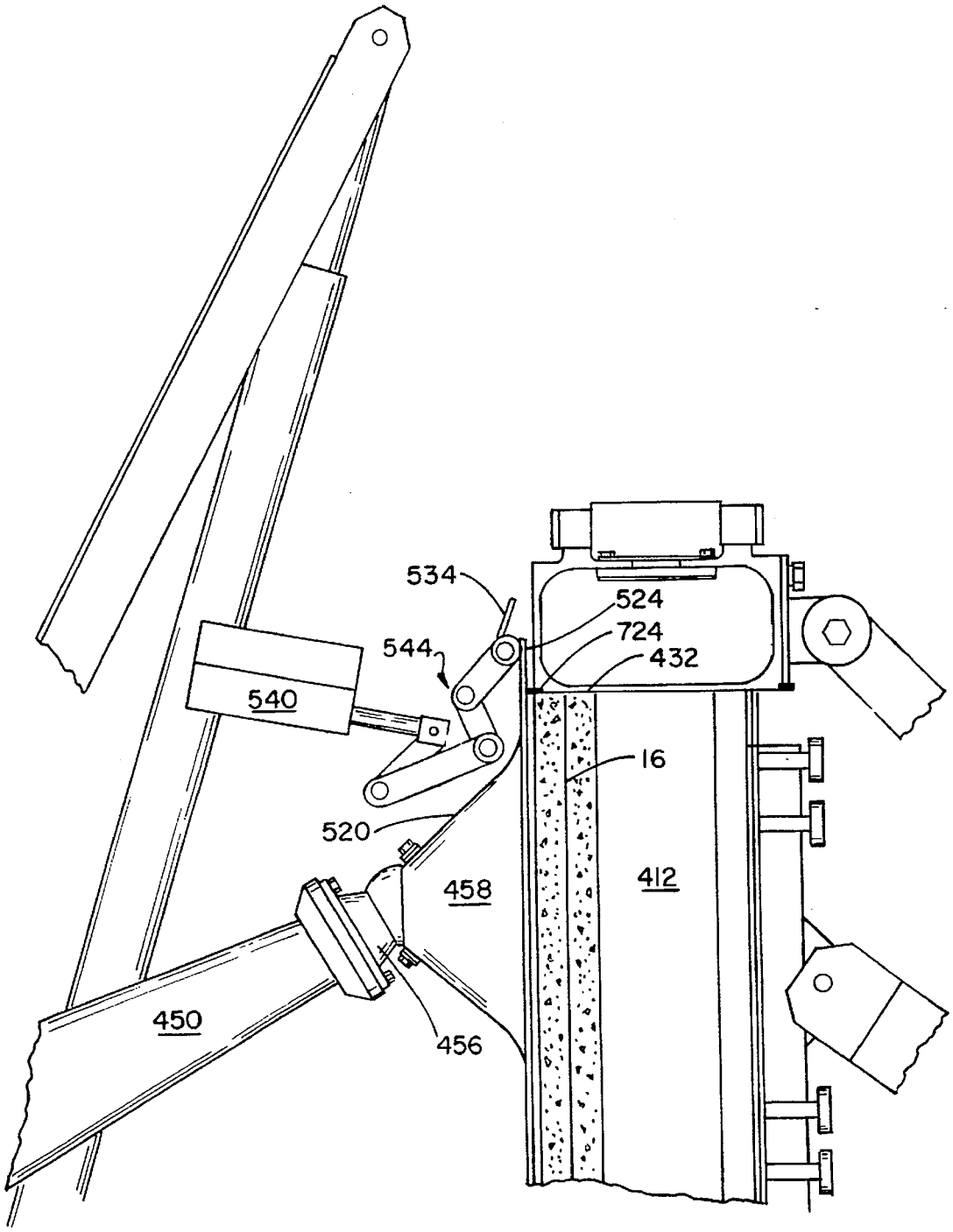
FIG. 35 is a partial right side view of the nozzle and nozzle mounting system of FIG. 23 disposed proximate an upper end of a wall to be covered.
Figure 36:
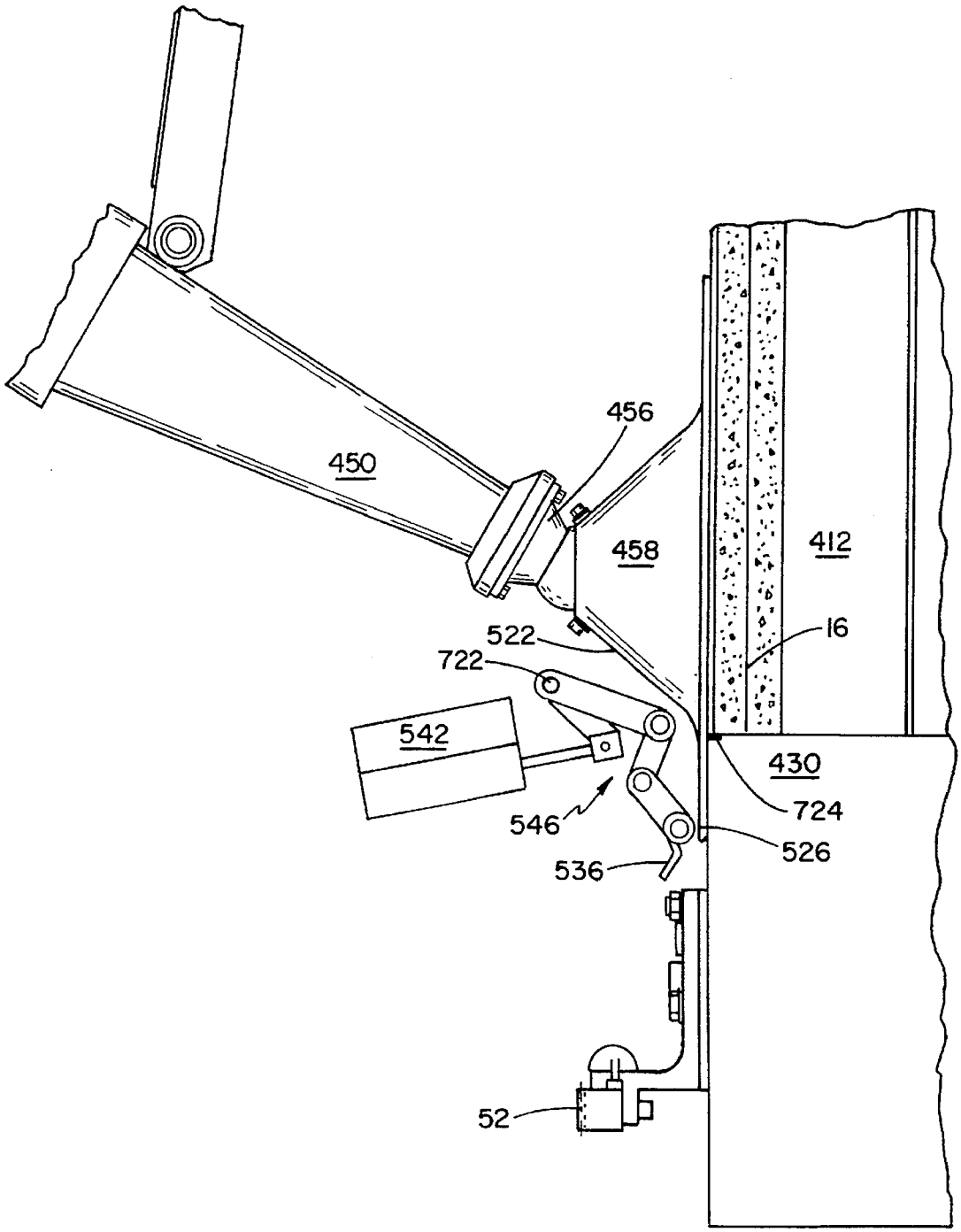
FIG. 36 is a partial right side view of the nozzle and nozzle mounting system of FIG. 23 disposed proximate a lower end of a wall to be covered.

In order to facilitate the installation of the lower bracket 432, one embodiment of the present invention employs a drill guide 730 as illustrated in FIGS. 35 and 36. This guide 730 provides parallel drill tube carriers 732, each containing a plurality of drill tubes through which anchor holes are drilled in the preformed footer 26. Two or more bridge members 734 are provided between and are affixed to the opposing drill tube carriers 732. Projecting inward on each drill tube carrier 732 toward the footer captured therebetween are adjustable footer clamps 736 which are tightened about the footer by manipulation of screw handles disposed thereon. Also disposed from each bridge member 734 is at least one height adjustment handle 738, manipulation of which raises and lowers the drill guide 730 relative to the footer 26. It is recognized that the present drill guide 730 has application beyond use just with the present material delivery system 410.

Figure 37:
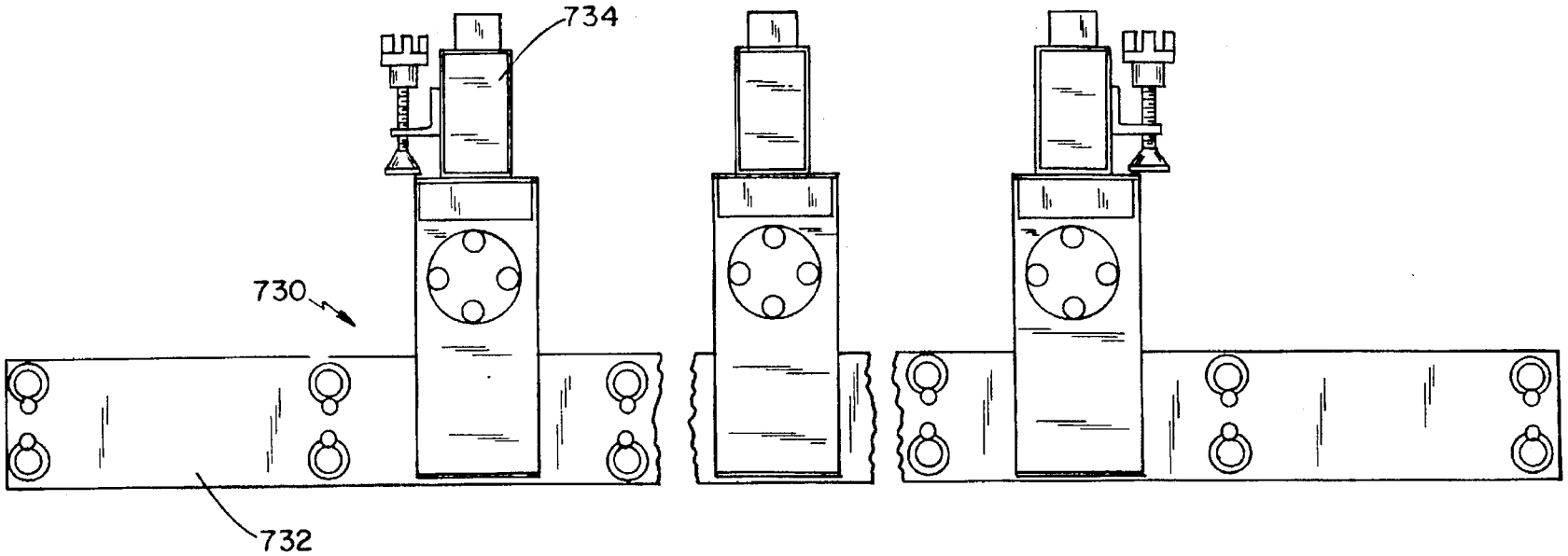
FIG. 37 is a right side view of a drill guide as used in conjunction with the material delivery system of FIG. 21.

A side view of a lower third of the vertical support column 422 and associated elements is illustrated in FIG. 37. The lower brace 424, which is normally be captured by lower brace clamps 414, has been omitted from FIG. 37 for the sake of clarity. The drive shaft 429 is partially shown extending parallel to the vertical support column 422. This drive shaft 429 is driven by the first motor 428 (preferably located proximate a top end of the vertical support column 422), and terminates at a lower end in a lower drive gear 431, also shown in FIG. 37. The lower drive gear 431 meshes with a cooperating lower drive track 52 (see FIG. 5) such that rotation of the lower drive gear 431 by the first drive motor 428 via the drive shaft 429 causes horizontal propulsion of the material delivery system 410 along the wall 412. The lower drive track 52 is proximate the underside 31 of the cooperating ridge 25 on which the lower wheel 421 rides.

A lower mounting plate 760 is attached to the lower brace 424 by the lower brace clamps 414 and provides an lower anchoring point for the vertical support column 422. The vertical drive shaft 446 is captured beneath the lower mounting plate 760 in a bushing 762. Also attached to the lower mounting plate, as shown in FIG. 37, is a downwardly extending collar 764 in which the horizontal drive shaft rotates. This collar 764 and the bushing 762 are attached to the lower mounting plate 760 by means of threaded fasteners or the like.

With regard to FIGS. 41 and 42, a trough 465 is disposed below the lower mounting plate 760, between the plate 760 and the wall 412 in order to prevent excess fluent material from fouling the lower wheels 421 and the lower drive gear 431. Any excess material is caught within the trough 465, and is channeled away from the wall 412 and the lower bracket 430 disposed thereon. Flanges 467 are provided for mounting the trough 465 into respective lower wheel supports 56 (see FIG. 3) and for extending the trough away from the material delivery system 410 toward the wall 412.

A rectangular opening 468 is provided within the trough 465 to allow the excess material to exit the trough 465. An angled slide 469 guides the material away from the lower bracket 430, which is disposed beneath the trough 465, and onto the work area floor a small distance from the footer 26. The illustrated slide 469 is actually formed of two portions, an upper portion 469A rigidly affixed to the trough 465, and a removable extension 469B. Bolts protruding from the upper portion 469A mate with aligned slots in the extension 469B. The trough 465 and slide 469 are preferably coated with a non-stick material such as Teflon™ or non-porous ceramic.

Figure 39:
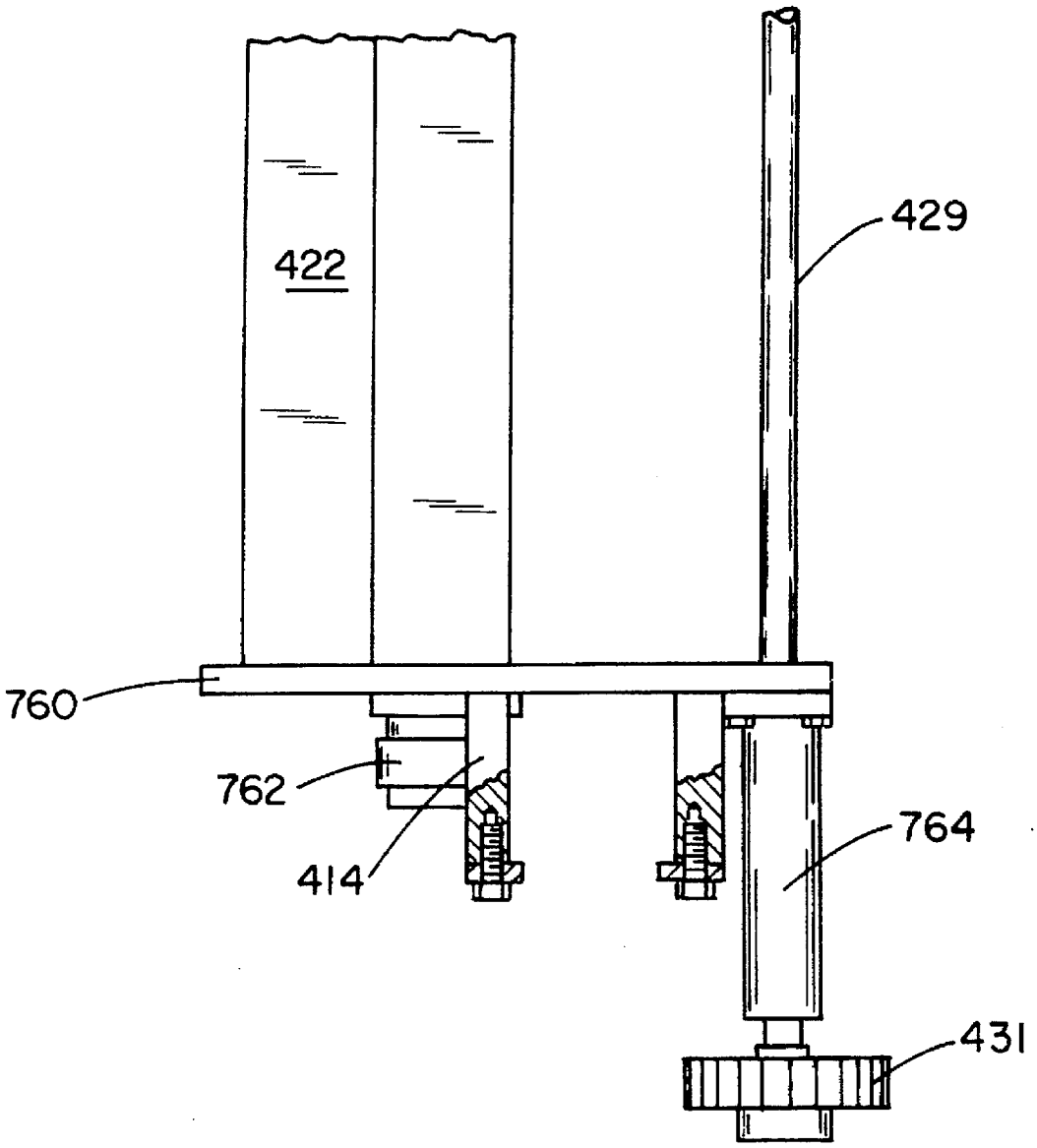
FIG. 39 is a right side view of a lower end of a support column and associated elements as used in the system of FIG. 21.

The remaining upper two-thirds of the vertical support column 422 and associated elements are illustrated in FIG. 39. Included in this view is the first motor 428 (a first gearbox 416 and coupler 433 are obscured behind a first motor support plate 417), a second motor 438, an electric motor brake 459, and a second gearbox 417. Rotational energy is imparted to the drive shaft 429 via the coupler 433 which provides a plastic interface between the drive shaft 429 and an axle extending from the second gearbox 439. This plastic interface eliminates the opportunity for the metal drive shaft 429 and the metal axle to wear each other down.

A first upper drive gear 435, disposed at a top end of the drive shaft 429, is located proximate an upper end of the drive shaft 429. As viewed in FIG. 40, teeth of the first upper drive gear 435 cooperate with teeth on an idler gear 437 which is suspended from an upper mounting plate 443. The rotation imparted on the idler gear 437 in turn causes a second upper drive gear 441 to rotate in the same direction as the first upper drive gear 435 and the drive shaft 429. As with the lower drive gear 431, teeth on the second upper drive gear 441 mesh with teeth provided on an upper drive track 96, shown schematically in FIG. 40.

The lower drive gear 431, the first upper drive gear 435 and the second upper drive gear 441 must be of the same diameter; the first and second upper drive gears 435, 441 and the idler gear 437 must be sized such that the rate of angular rotation of the second upper drive gear 441 is equal to that of the lower drive gear 431. Thus, as the drive shaft 429 is rotated, both the lower drive gear 431 and the second upper drive gear 441 progress along respective lower and upper drive tracks 52, 96 simultaneously, propelling the automated material delivery system 410 horizontally.

As shown in FIG. 39, a first embodiment of the present invention includes an arm 466 rigidly affixed to the column 422 and extending proximate the horizontal drive shaft 429. At the end of the arm 466 closest to the drive shaft 429, a bushing (obscured in FIG. 39) supports the drive shaft 429 and prevents torquing of the shaft.

Figure 40:
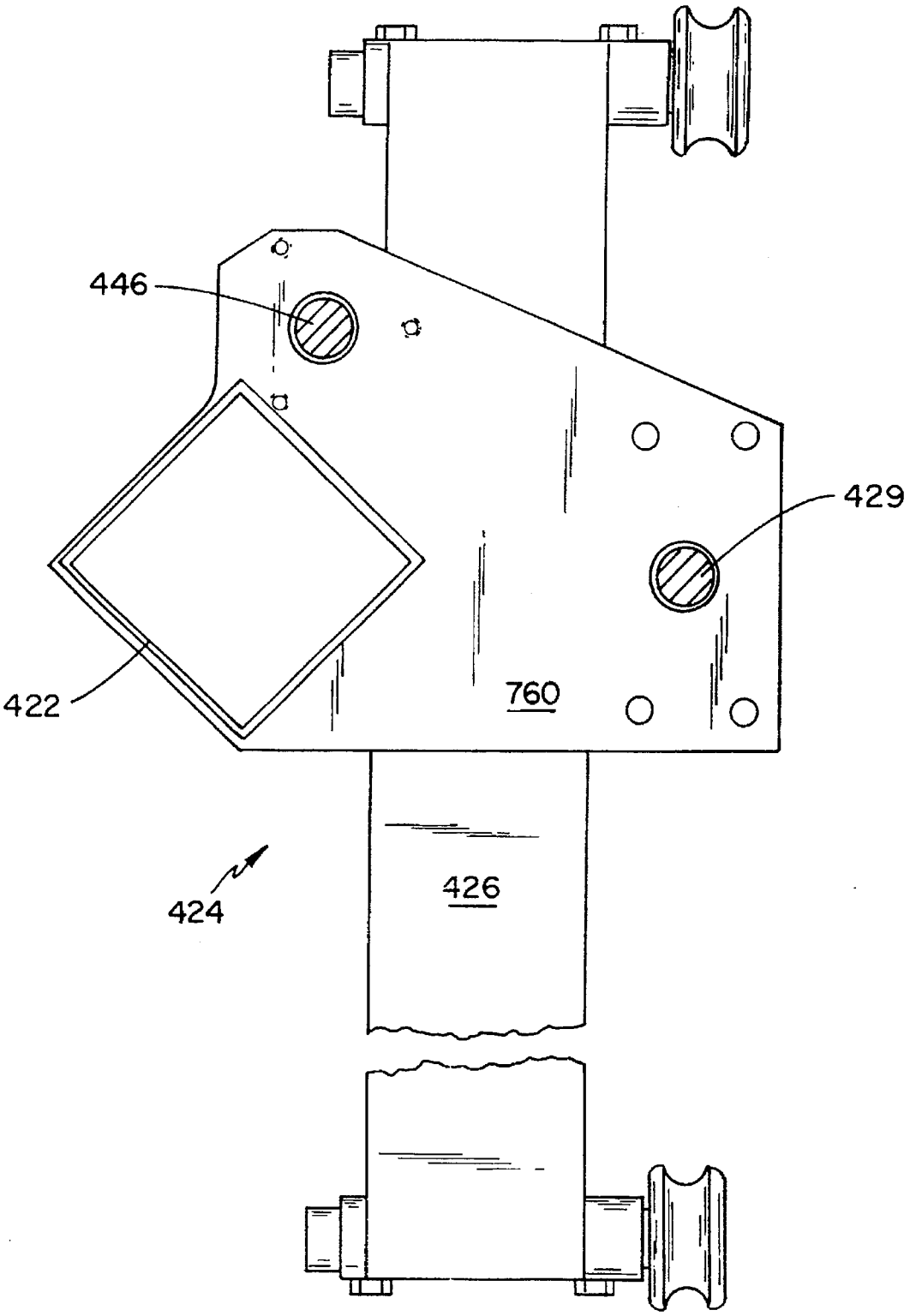
FIG. 40 is a top view of the lower end of the support column and associated elements of FIG. 39.

As shown in FIGS. 39 and 40, the upper mounting plates 418, 443 are rigidly attached to the vertical support column 422 and extend over the upper mounting bracket 432. In one embodiment, a cylindrical shaft 740 is disposed within an upper end of the vertical support column 422, thus providing a more stable attachment point for the upper mounting plates 418, 443.

Figure 41:
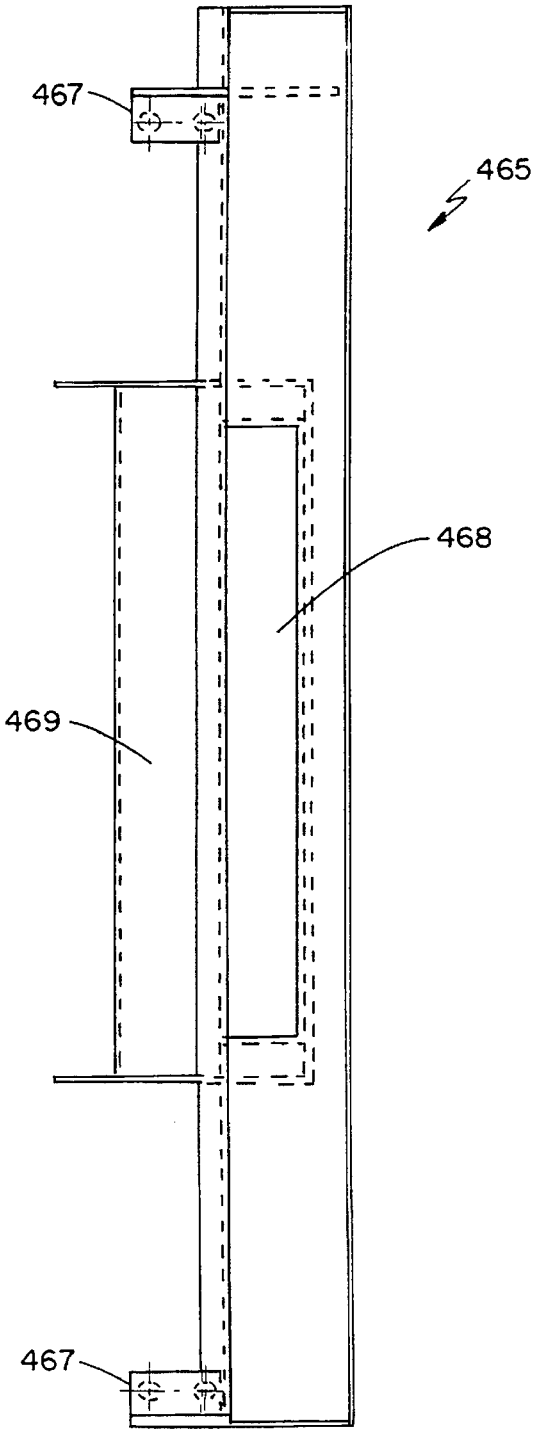
FIG. 41 is a top plan view of a funnel as employed with the system of FIG. 21.
Figure 42:
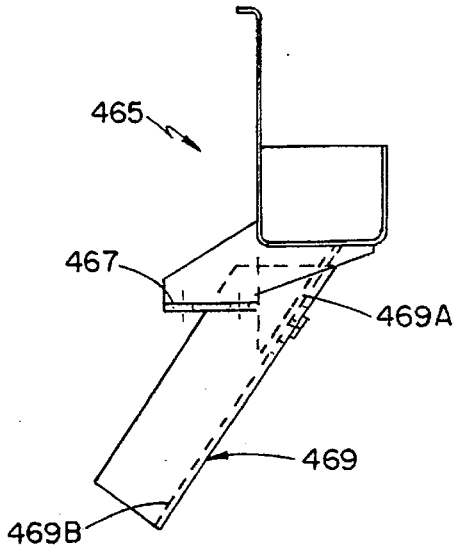
FIG. 42 is a side view of the funnel of FIG. 41.
Figure 43:
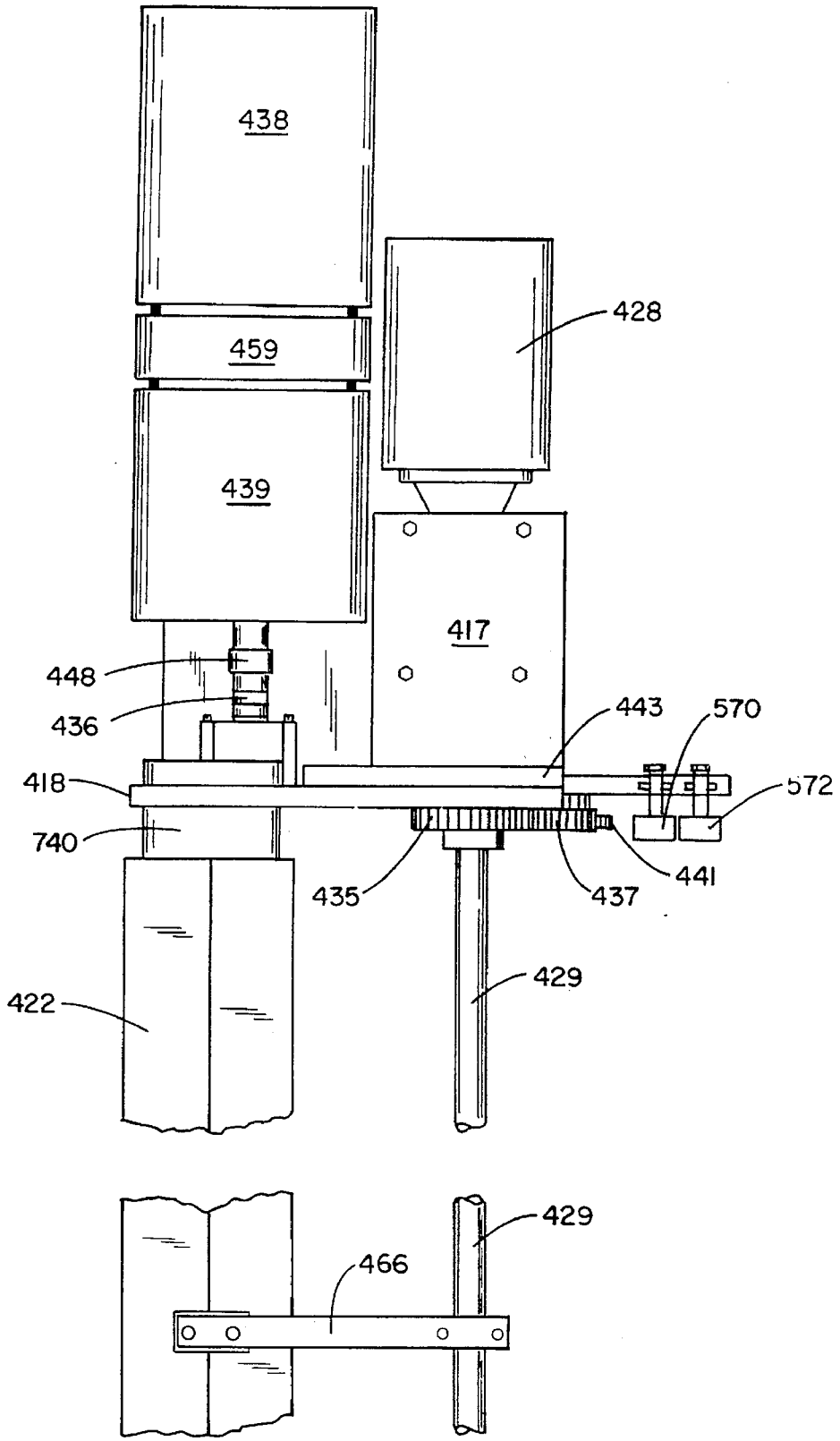
FIG. 43 is a right side view of an upper end of the support column and associated elements as used in the system of FIG. 21.

With reference to FIGS. 39 and 41, the first motor 428 and a second motor 438 are disposed adjacent to one another atop the vertical support column 422, supported by the upper mounting plates 418, 443. The first motor 428 and an associated first motor gearbox 416 extend above the upper mounting plate 443 substantially in alignment with and for rotation of the drive shaft 429, thus enabling the horizontal translation of the nozzle mounting system 434. As noted, the first motor coupler 433 serves as an interface between the first motor gearbox and the drive shaft 429.

Similarly, the second motor 438 and an associated second motor gearbox 439 extend above the upper mounting plate 443 substantially in alignment with and for rotation of the screw shaft 436, thus enabling the vertical translation of the nozzle mounting system 434. A second motor coupler 448 serves as an interface between the second motor gearbox and the screw shaft 436.

In one embodiment, the first and second motors 428, 438 are electric motors. Support brackets 417, 445 rigidly attaching these motor and gearbox combinations to the mounting plates 418, 443 and thus to the vertical support column 422. In another embodiment of the present invention, the first motor 428 is a one-half horsepower motor, and the ratio of the gearbox 416 is 150:1. The second motor 438 is a five horsepower motor. The drive gears are sized to enable 14.13 inches of lateral displacement per each drive shaft 429 rotation. The first motor 428 speed is such that the system 410 can travel at up to 13.7 linear feet per minute along the wall 412 to be coated. Further, the second motor 438 is capable of raising the nozzle mounting system 434 twenty feet in thirty-two seconds.

Due to the weight of the nozzle 420 and the nozzle mounting system 434, it is necessary in one embodiment to provide the second motor 438 with an electric brake 459. Thus, when the nozzle mounting system 434 has been driven to the top of the wall 412 and the second motor is stopped, the weight of the nozzle 420 and system 434 will not cause the second motor to slip, allowing the mounting system 434 to descend.

In order to keep the upper portion of the vertical support column 422 proximate the wall to be coated 412, a first upper follower wheel 570 and a second upper follower wheel 572 are disposed beneath the upper mounting plate 443. These follower wheels 570, 572, shown in FIG. 39, extend within a channel 104 formed in the upper bracket 432, as seen in FIG. 13 with respect to the substantially similar trowelling system upper bracket 32, and rotate freely to promote smooth progression of the delivery system 410 in a horizontal direction parallel to the wall 412. The channel 104 has a U-shaped cross-section owing to the presence of two vertical blocks 106, 108 against which the two upper follower wheels 570, 572 contact and roll. Therefore, in the illustrated embodiment of FIG. 39, the vertical support column 422 and associated elements will tend to pull away from the wall 412 to the left. However, the first upper follower wheel 570 will press against the first vertical block 106, maintaining the automated material delivery system 410 in vertical alignment with the wall 412, and keeping the second upper drive gear 441 in contact with the upper drive track 96. Adjustments are provided at the attachment point between each upper follower wheel 570, 572 and the upper mounting plate 443 to adjust the spacing of the follower wheels 570, 572 within the channel 104.

The automated material delivery system 410 as just described can be controlled by user input, by processor control, or by a combination of both user and processor control. For user control, a user interface 580, otherwise referred to as a remote control device, is in communication with the delivery system 410 and thus the first, second, and third motors 428, 438, 550. Such communication may be via an RF link, an IR link, or may be via electrical signals conducted along wires between the remote control device and the motors 428, 438, 550. User control via the user interface 580 connects directly to the automated material delivery system 410, as shown in dashed lines in FIG. 42.

Alternatively, if the delivery system 410 is fully processor controlled or partially processor controlled, such a user interface. 580 can provide an operator with the ability to input performance characteristics such as speed or desired surface area to be finished to a processor 582 having an associated memory 584. The user input characteristics are then translated by the processor 582 according to an algorithm stored within the processor memory 584 into commands to the motors 428, 438, 550. In this case, the user interface 580 can be a keyboard or touch-screen associated with a computer which houses the processor 582 and associated memory 584. Due to the desirability of precise timing in the operation of the motors, it is preferred that the system 410 be operated under processor 582 control.

In order to further enable processor-controlled operation of one embodiment of the present material delivery system 410, a number of sensors can be utilized. One such sensor is associated with each of the three motors 428, 438, 550 to provide the processor 582 with an indication of motor activity and thus system location and status along the wall 412. In an exemplary embodiment, such sensors provide an indication of shaft rotation, either the motor shaft or a member rotated by the motor, such as the drive shaft 429 or the swivelling pin 556 disposed within the swivel joint 456. Such an embodiment can provide accuracy to 1/60th of a revolution.

In one embodiment, each drive track 52, 96 is ground down at either end of the wall to be finished. Thus, when the material delivery system 410 has reached a corner or a wall end, the system will be unable to continue to move laterally. The first motor 428 will continue to run and turn the lower drive gear 431 and the upper drive gears 435, 441 until stopped either by the processor 582 or by manual intervention.

In an alternative embodiment, another set of sensors are employed in the present system 410 as limit switches disposed at either end of the wall to be coated 412. These switches, which can be rubber enclosed to enable operation in harsh working environments, provide an indication to the processor 582 that the delivery system 410 has reached one end of a wall and must therefore stop.

In other embodiments, sensors provide an indication to the processor 582 of the proximity of upper and lower wall edges, of upper boundaries of windows and doors, and of lower boundaries of windows. Such sensors enable the processor 582 to control the operation of the nozzle mounting system 434 and associated equipment responsible for the flow of fluent material. Details of such control are provided below with respect to the flow charts in FIGS. 46A through 46E.

As illustrated in FIGS. 43A through 43D, the processor 582 and associated memory 584 of the present system are located, in one embodiment, on a device known as an air track 590, a self-propelled, compressed-air powered vehicle commonly used in building construction environments. The processor 582, memory 584 and user interface 580 are disposed onboard in ruggedized enclosures, as appropriate to the nature of constructions sites. In a further embodiment of the present system 410, the air track 590 provides an air compressor 592, a fluent material pump 594, a water reservoir 595, and a generator 596, in addition to a cabin 591 having seating for an operator, the cabin 591 acting as the ruggedized enclosure for the processor 582 and associated equipment, as illustrated in. FIGS. 43A through 43D.

In alternative embodiments of the present invention, any tracked vehicle is used in place of the air track. For instance, a similar tracked vehicle powered by hydraulics is employable.

The generator 596 provides power for operating the compressor 592 and pump 594, as well as the processor 582 and memory 584. The generator 596 can be diesel fueled.

The water reservoir 595 is employed to purge the pump 594 associated hoses, and the nozzle 420 in between or at the end of material applications. Without such purging, material such as cement can set up within and ruin these elements, particularly if the cement has had accelerant added to it.

The air compressor 592 is a standard, diesel driven compressor providing approximately 900 cfm in a preferred embodiment. 0f this, adequate pressure is provided to power the tracked vehicle 590 in an air powered embodiment as well as to supply the posterior end couplings 490A, 490B, 490C and the upper and lower plenum air couplings 493. In a further embodiment of the present invention, one or more air tanks are provided on an air powered version of the tracked vehicle 590 in order to propel the vehicle 590 short distances while the material delivery system 410 continues applying fluent material to the wall 412. Without these tanks 586, compressed air diverted to propel the vehicle could conceivably negatively impact the air pressure delivered to the material delivery system 410.

In a preferred embodiment, the pump 594 is a progressing cavity pump such as the Moyno® L, J and JS progressing cavity pumps sold by Robbins Myers, Inc. of Springfield, Ohio. The primary benefit achieved by use of such pumps is the avoidance of surges in pump pressure commonly found at the travel limits of single or dual piston pumps. This is of significance in the present application since pulses in material pressure can result in uneven application of the material on the wall 412. Material to be applied to the wall 412 such as cement is provided to the pump via a hopper 593.

Figure 44:
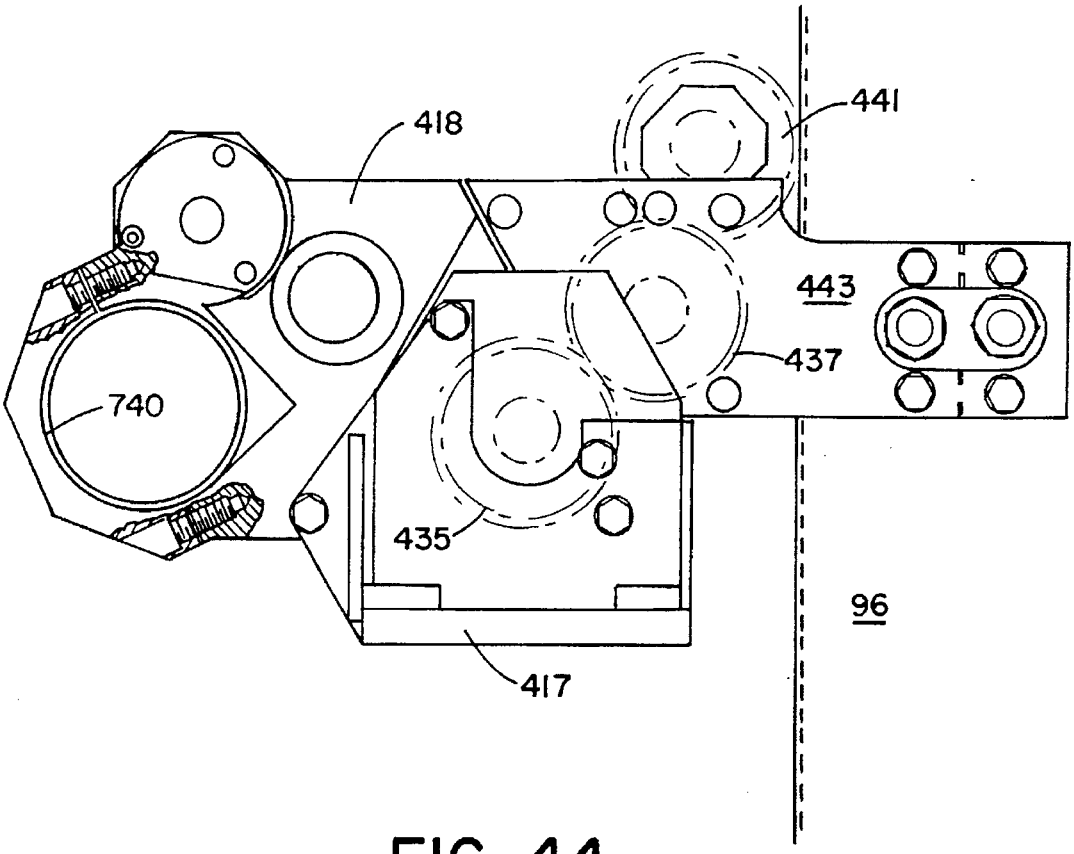
FIG. 44 is a top view of the upper end of the support column and associated elements of FIG. 43.

High pressure hose and a number of swivel couplings are provided between the pump 592 and the posterior end 452 of the nozzle body 450. As shown in FIG. 44, a pipe 600 extends upwardly from the fluent material pump 594 disposed of the air track 590 and terminates in a swivel coupling 602. A boom type hose 604 is attached to the swivel coupling 602 and attaches to the posterior end 452 of the nozzle body 450 via elbows 606. The vertical pipe 600 is supported by a brace 601 extending from the air track 590.

To avoid the presence of dragging data cables which could yet caught and crushed in the moving machinery, such cables are preferably run along the vertical pipe 600 and the hose 604 to the system 410. Otherwise, one or more booms can extend upwards from the air track, with the cables suspended therefrom.

A further embodiment of the present system 410 includes a ruled, vertical boom 744 disposed on the air track 590, the boom 744 having a hoist (not shown) disposed thereon capable of lifting the vertical support column 422 and associated elements. This configuration greatly facilitates the installation and removal of the system from the wall 412, as well as the initial installation of uncoated wall panels 412.

The processor 582 not only controls and monitors the progression of the material delivery system 410 of which it is a part, but can also command the progression of the air track 590 to minimize the distance between the air track 590 and the nozzle mounting system 434. Rotation sensors disposed at air track axles are used in another embodiment to detect movement of the air track 590. For instance, the air track 590 may remain stationary while the system 410 applies approximately six or seven horizontal linear feet of material to the wall 412. Then, the air track 590 is commanded to proceed a like distance along the ground. As noted, cables for power and data transfer are strung between the processor 582 and the material delivery system 410. Thus, in this variation on the automated material delivery system 410, a user need only provide initial wall configurations (i.e. size of wall, location of doors and windows, etc.) and specifications as to material to be applied and ambient conditions, among other data. The material delivery system 410 would then proceed to coat the wall 412 without further manual intervention.

In another embodiment, an operator drives the air track 590 and monitors the operation of the automated material delivery system 410 from the user interface 580 onboard the air track. The operator is required to keep the air track in the vicinity of the system 410, though enough slack is provided in the hose 604 and cables to allow some distance to separate the air track 590 from the system 410. In either variation, any suitable vehicle other than an air track can be employed.

In other embodiments, the processor 582 and associated elements are stationary, and cables extend between the processor 582 and the system 410. In this instance, the cables 598 can be straight, coiled, or retractable cables.

Figure 45:
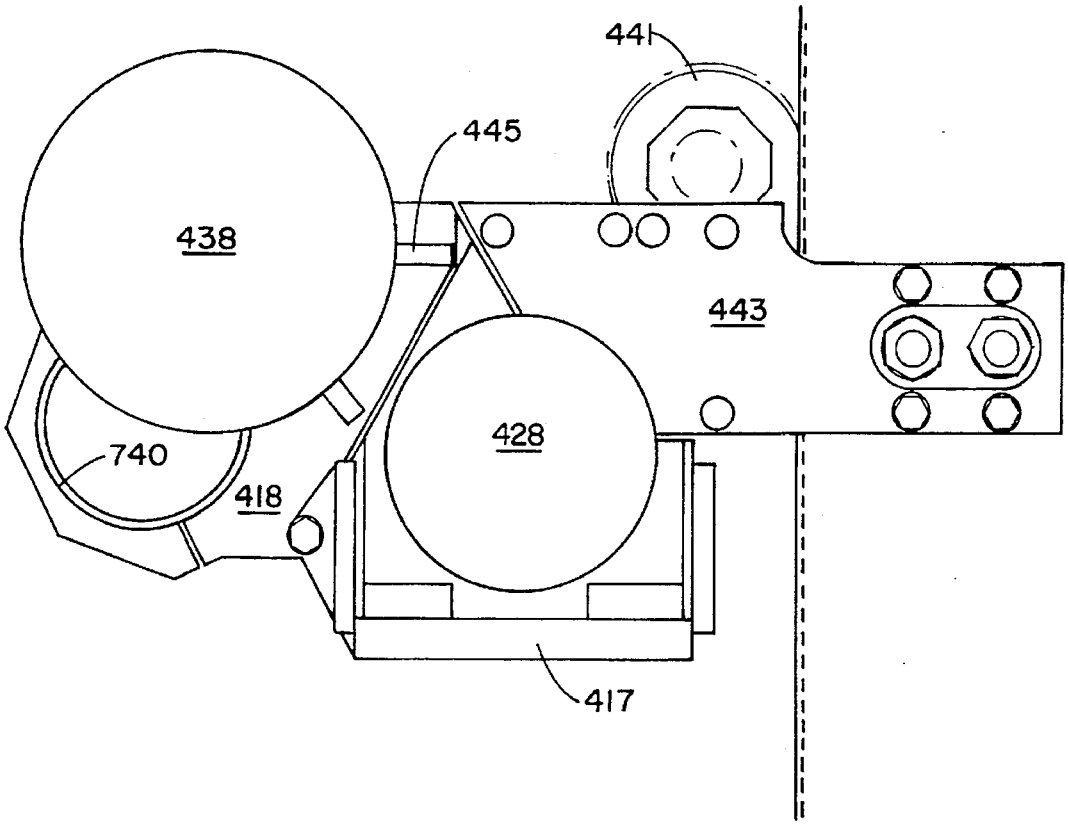
FIG. 45 is a second top view of the upper end of the support column and associated elements of FIG. 43.
Figure 46:
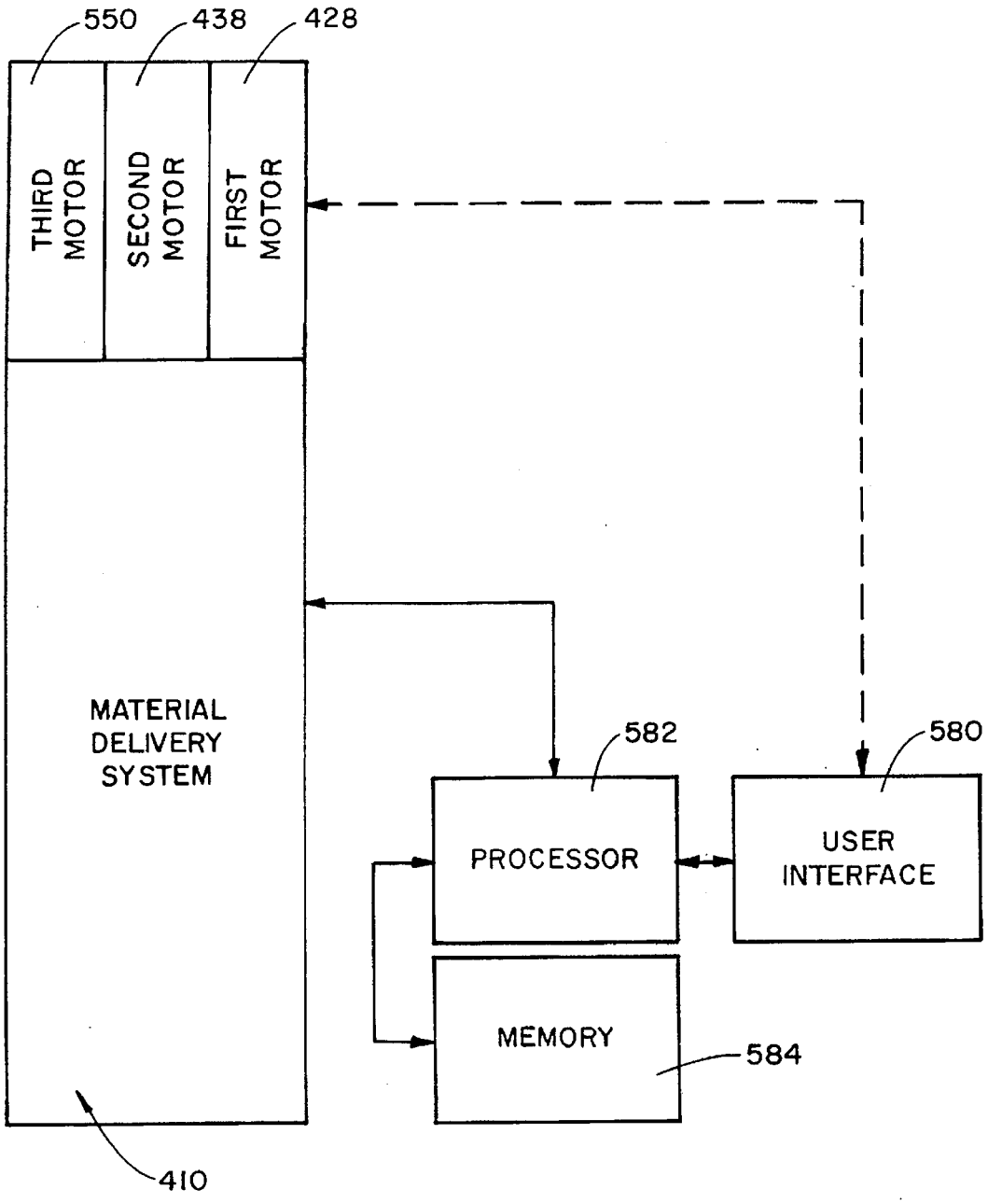
FIG. 46 is a schematic view of a system control configuration for the material delivery system of FIG. 21.
Figure 47A:
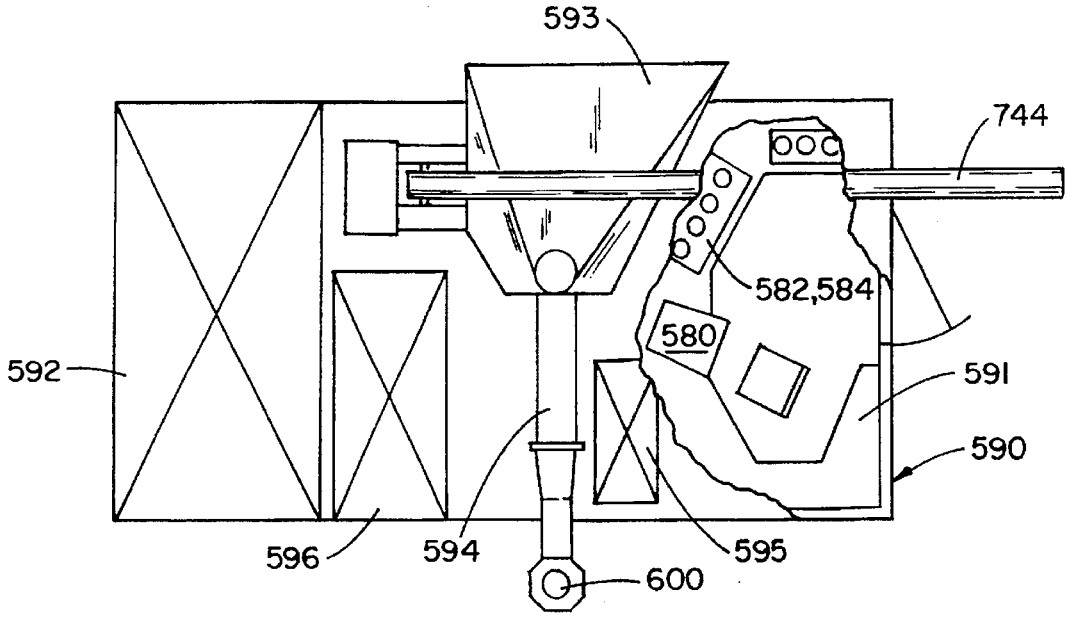
FIG. 47A is a top view of a tracked vehicle as used in the system of FIG. 21.
Figure 47B:
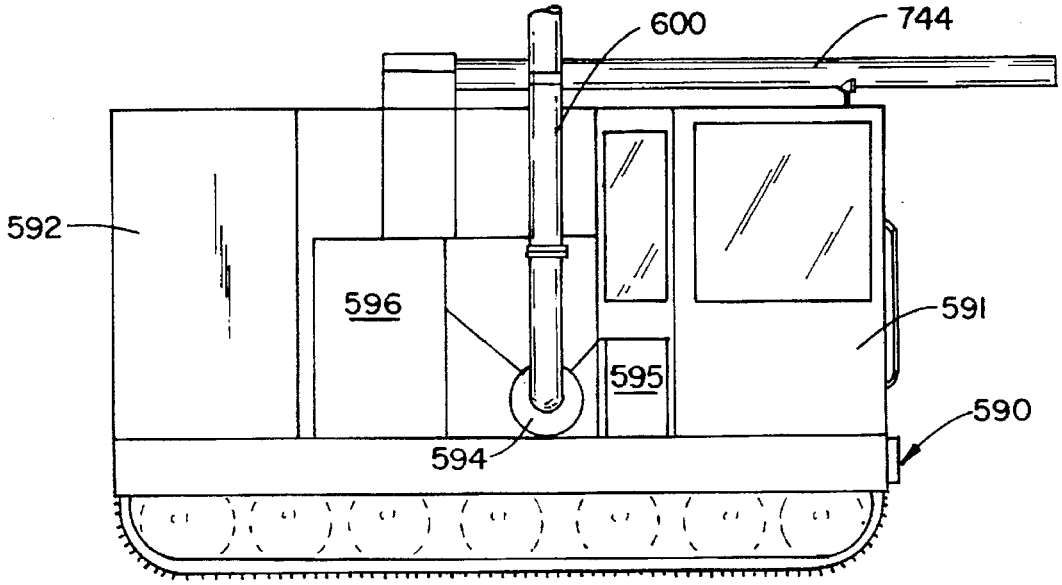
FIG. 47B is a left side view of the tracked vehicle of FIG. 47A.
Figure 47D:
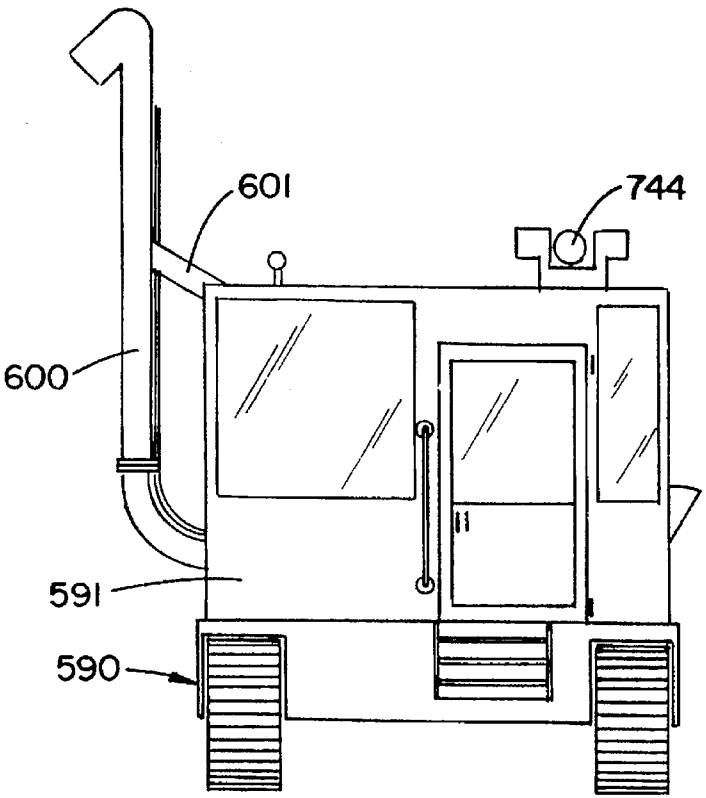
FIG. 47D is a front end view of the tracked vehicle of FIG. 47A.
Figure 47C:
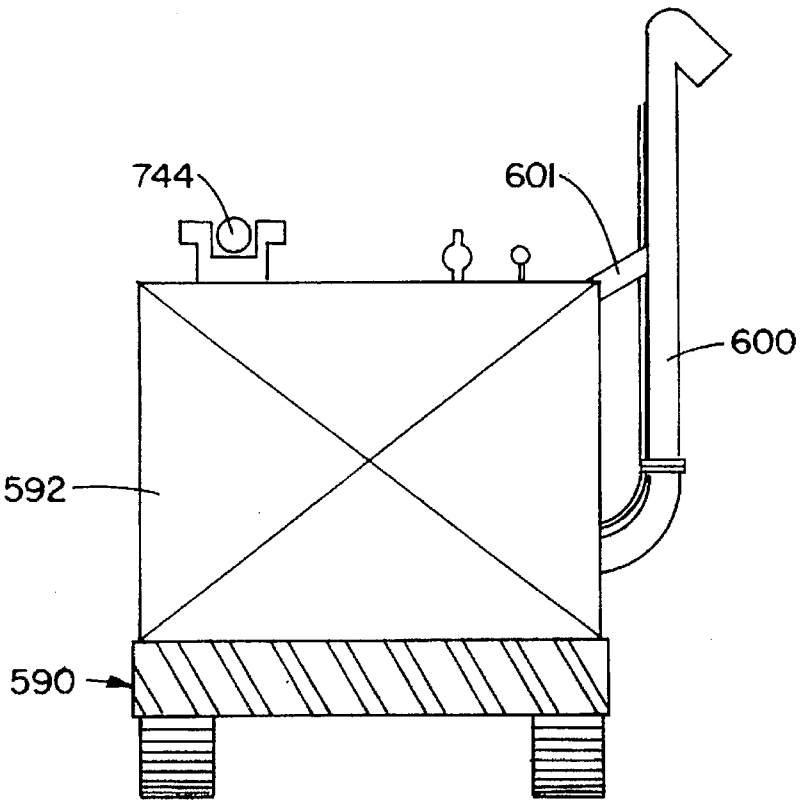
FIG. 47C is a rear end view of the tracked vehicle of FIG. 47A.
Figure 48:
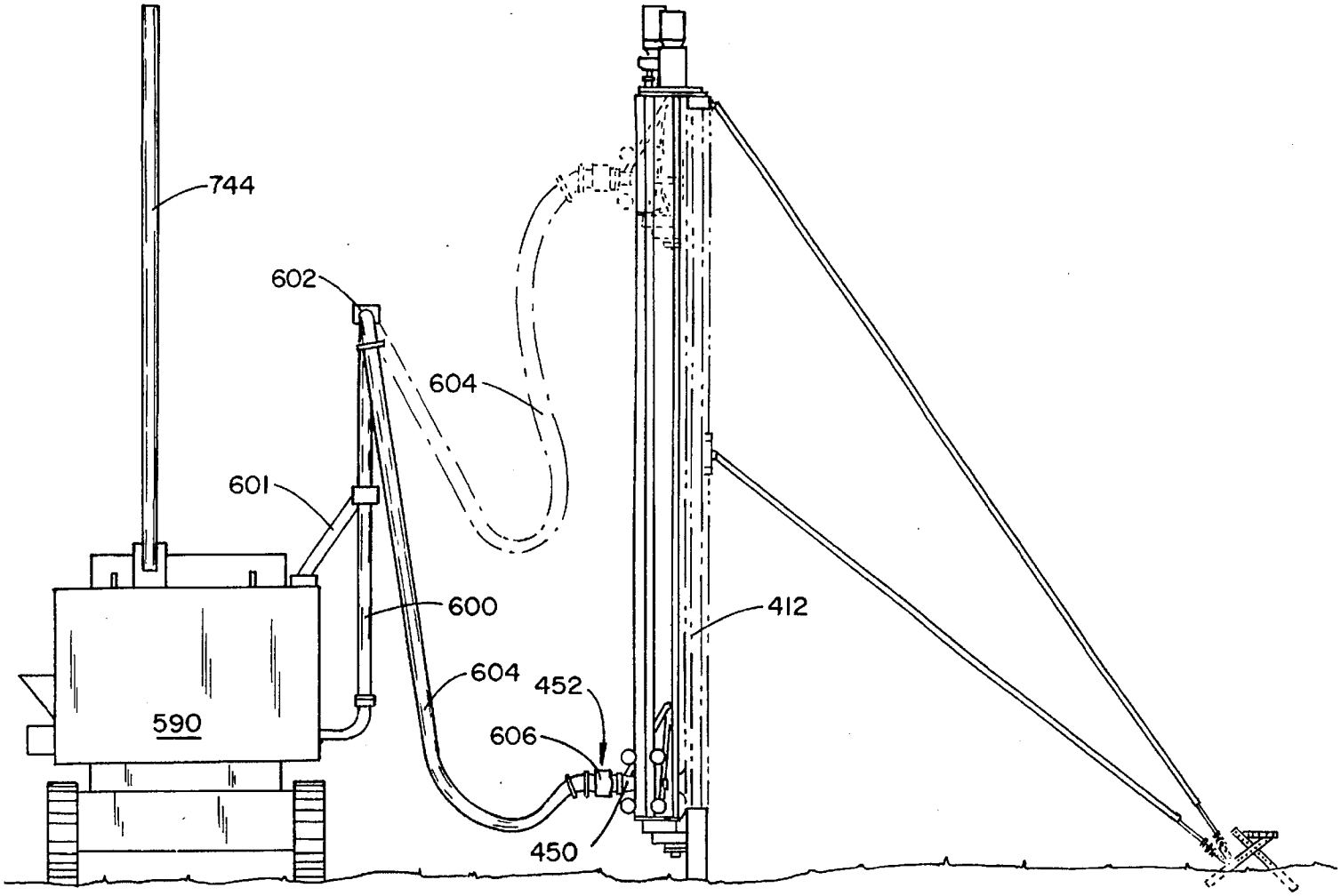
FIG. 48 is a side view of the tracked vehicle of FIG. 47A, the material delivery system of FIG. 21 and a wall support system proximate a wall to be covered.
Figure 49:
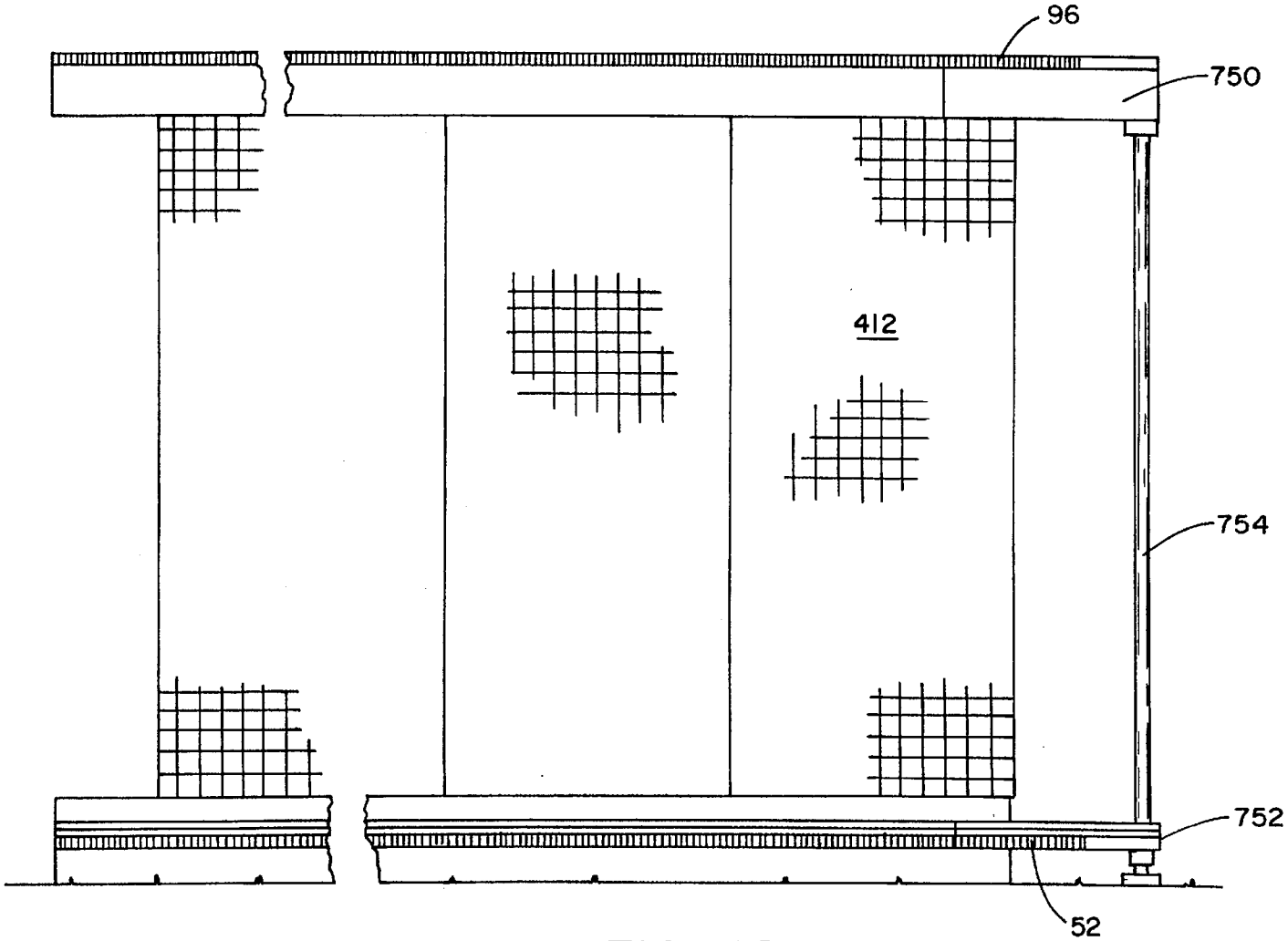
FIG. 49 is a front view of wall panels having material delivery system mounting brackets.
Figure 50A:
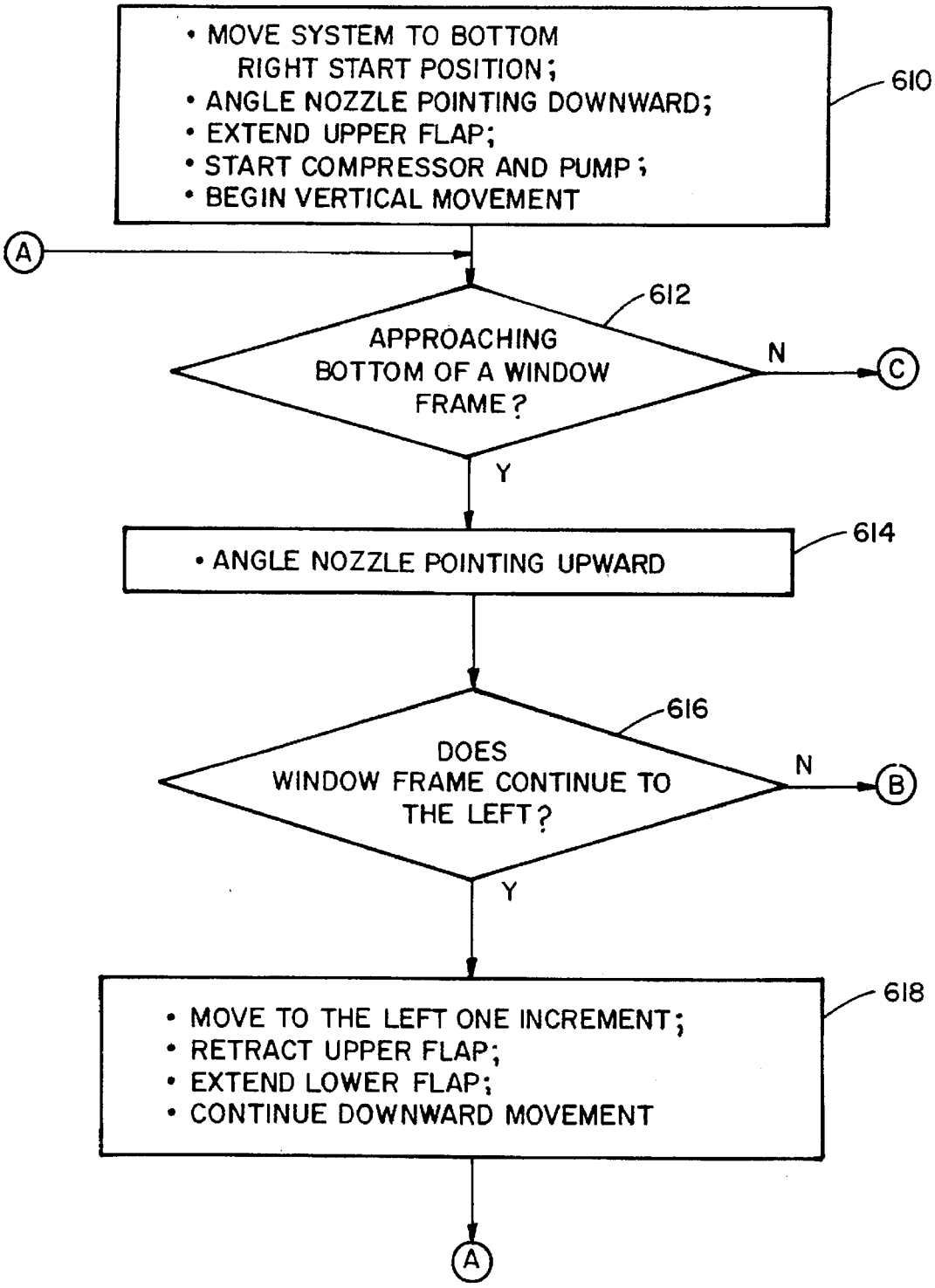
FIG. 50A through 50E are flow chart depictions of sequences of steps executed by a processor associated with the material delivery system of the present invention.
Figure 50B:
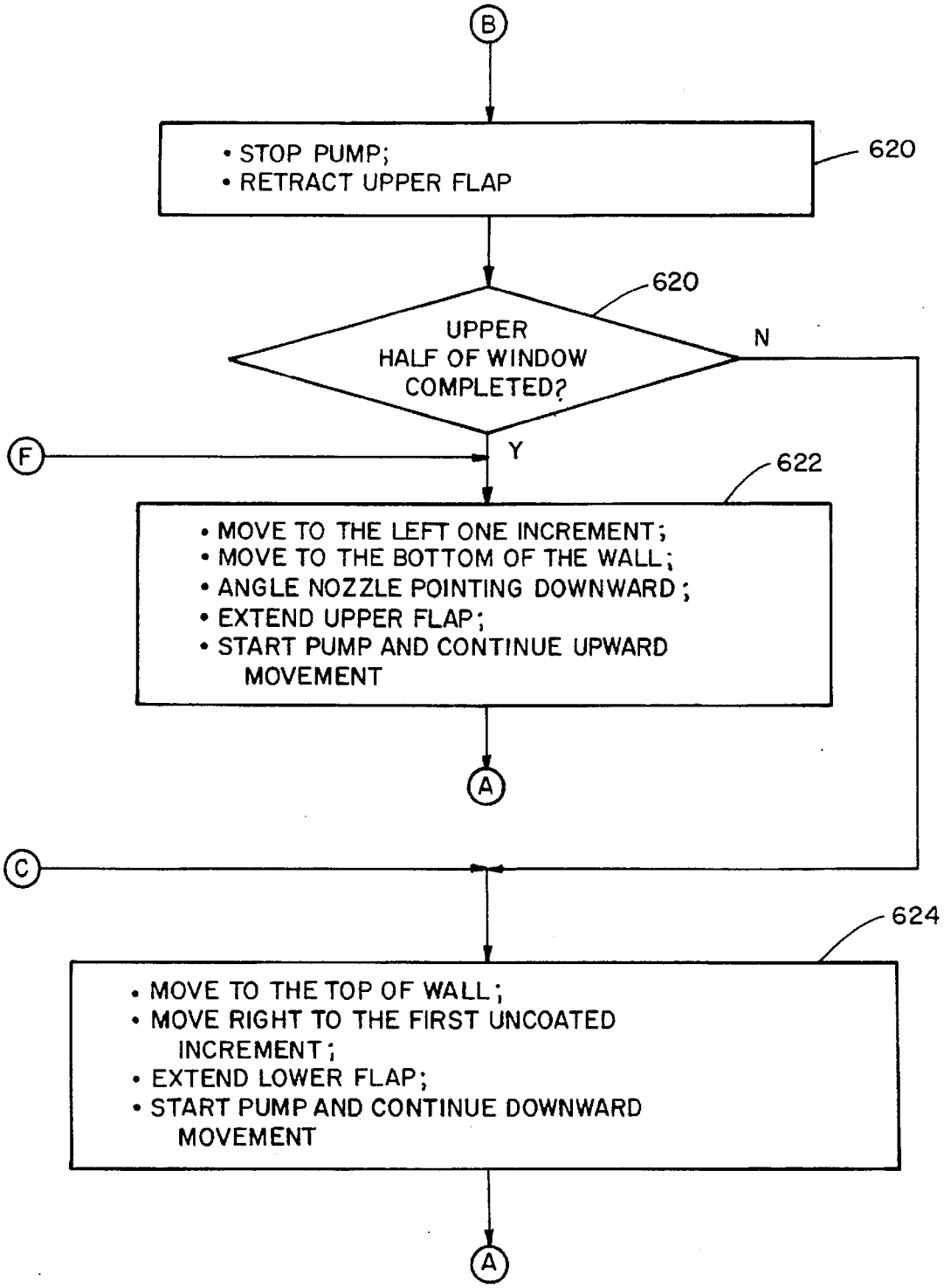
Figure 50C:
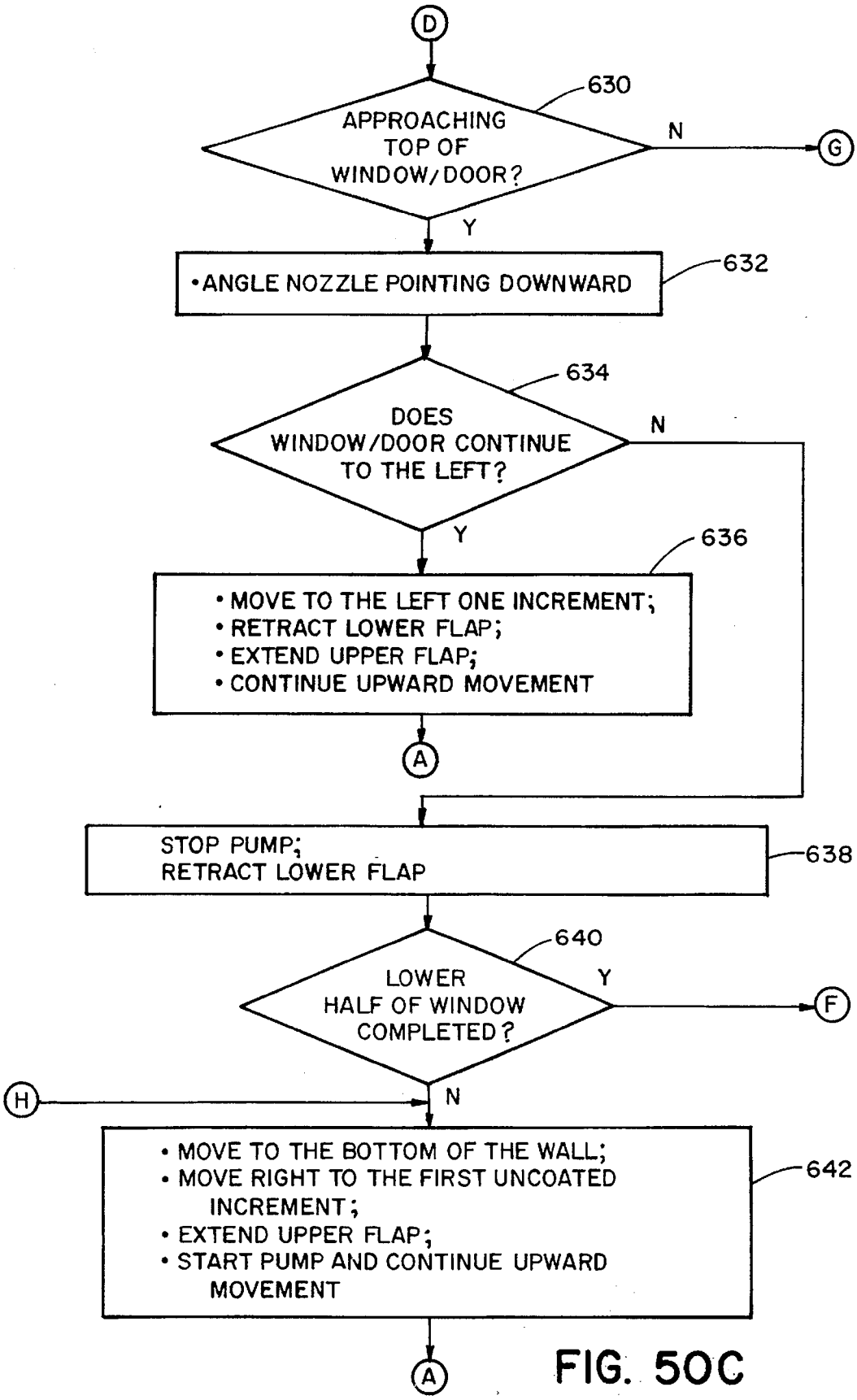
Figure 50D:
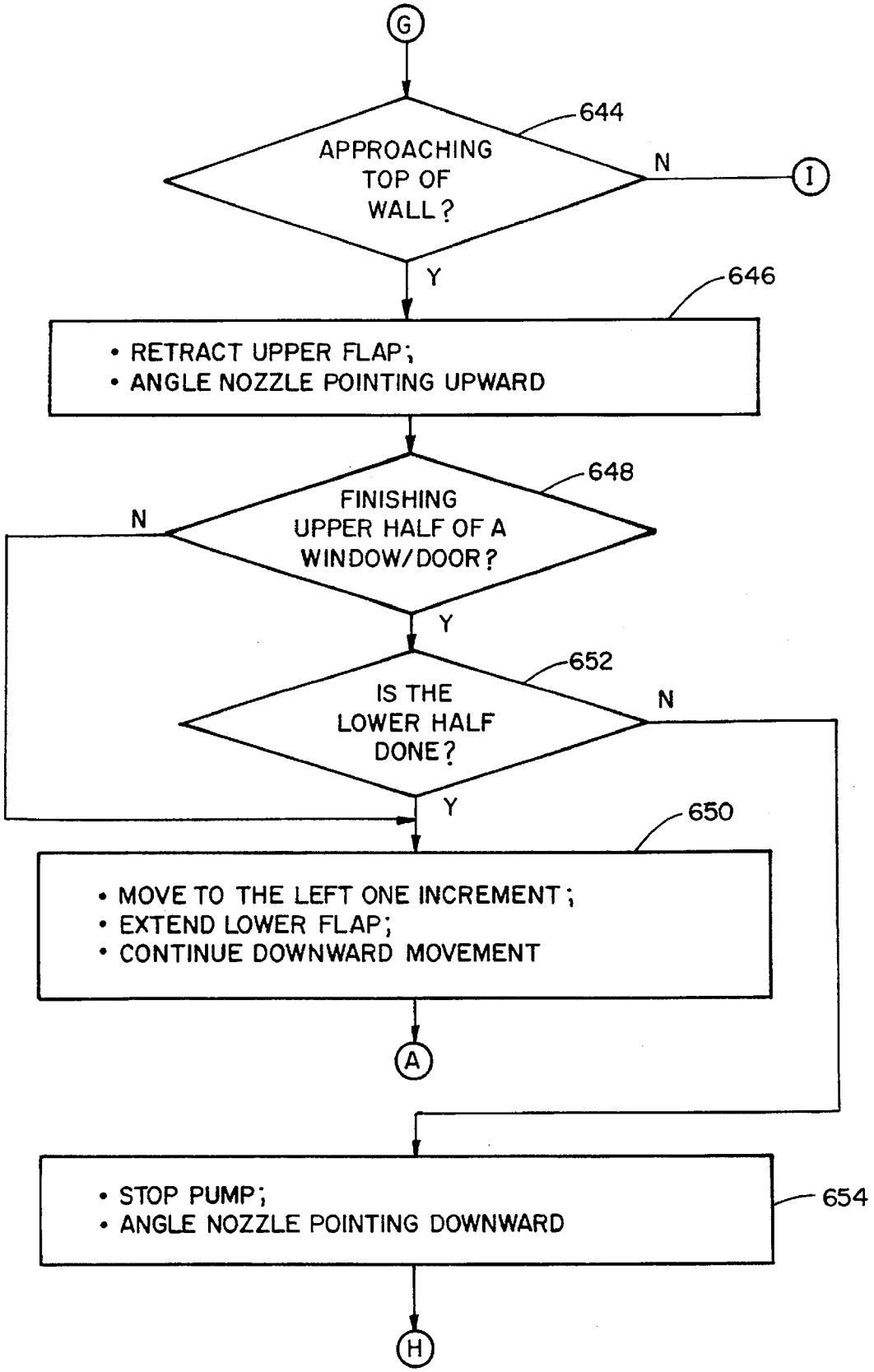
Figure 50E:
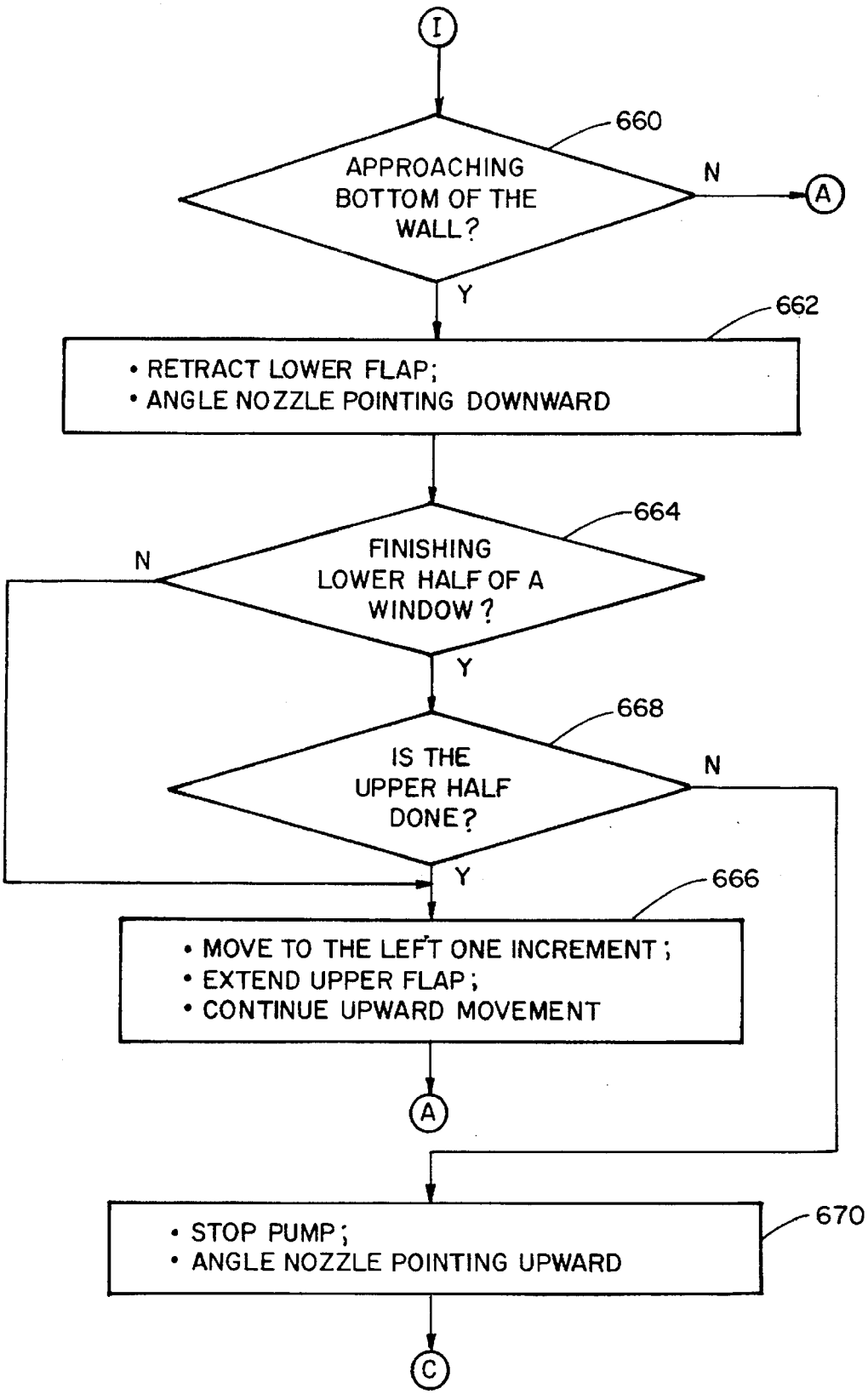
Figure 51:
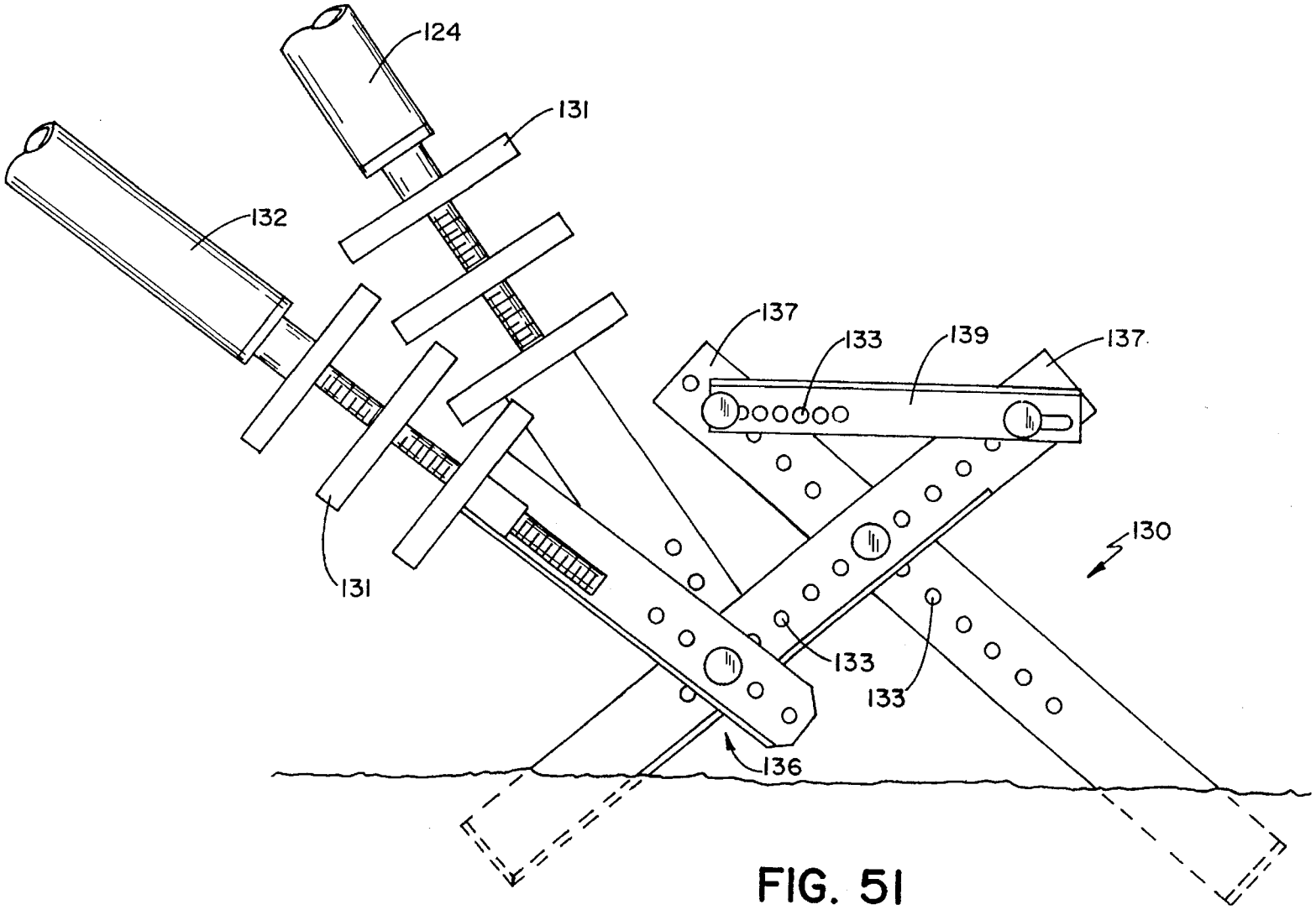
FIG. 51 is a detail view of an anchoring system for the wall support system of FIGS. 16A and 16B.

When initially preparing a wall panel 412 for material application, one embodiment of the present invention includes the use of upper and lower bracket end units 750, 752. In contrast to the upper and lower brackets 432, 430 previously described, which are typically twelve feet in length, the end units 750, 752 are typically six feet in length, as illustrated in FIG. 45. Two feet of end unit 750, 752 are installed on the wall 412 to be coated. The remaining four feet are supported by a height-adjustable column 754. While the drive shaft 429 can have an adjustment point disposed at some point thereon whereby the upper and lower drive gears 441, 431 are aligned with respect to the upper and lower drive tracks 96, 52, it can still be a challenge to initially install the heavy column 422, nozzle support system 434, and nozzle 420. The upper end unit 750 provides a twenty-six inch length free of drive track 96, while the lower end unit 752 has a twenty-eight inch length free of drive track 52. Thus, the second upper drive gear 441 can be aligned with respect to the teeth of the upper drive track 96 before aligning the lower drive gear 431 with respect to the lower drive track 52.

To further ease initial installation of the vertical support column 422 and associated elements onto the wall 412, a ten inch length of channel 104 (see FIG. 13) atop the upper end unit 750 is chamfered. Thus, as the upper follower wheels 570, 572 are lowered towards the upper end unit 750, they are guided into the channel 104. The dimensions of the track-free sections and the chamfered section on the end units 750, 752 are illustrative, and other dimensions are possible.

Thus, the material delivery system 410 is installed on the end units 750, 752 where the teeth of the tracks 96, 52 are removed. Once mounted on these units, the system 410 is urged toward the left (in the illustrated embodiment). The second upper drive gear 441 engages the upper drive track 96 first. As the system 410 moves left, the lower drive gear 431 next engages the lower drive track 52. Thus, installation against the wall 412 is greatly simplified.

In one embodiment, an operating procedure stored in the memory 584 for execution in the processor 582 is executed as follows and as depicted in FIGS. 46A through 46E. First, the material delivery system 410 is commanded to a starting position (step 610). In the depiction of FIG. 21, the material delivery system 410 proceeds to the left and therefore the starting position is the extreme right side of the wall. Furthermore, in a first embodiment of the present system 410, the nozzle mounting system 434 is initially positioned at its lower travel limit on the vertical support column 422. As discussed previously when the nozzle 420 is travelling upward, the nozzle body 450 is preferably angled downward. Therefore, orientation of the system 410 prior to commencement of material delivery as at step 610 includes the downward angulation of the nozzle body 450, the positioning of the upper flap 534, and the retraction of the lower flap 536. After the system 410 has been properly Oriented at the start position, air and fluent material flow and vertical motion to commenced.

In one embodiment of the present system 410, the processor 582 is capable of controlling the pump 594 speed in addition to the rate of motion of the delivery system 410. Processor inputs in this embodiment include dimensions of the wall to be coated 412, the depth to which fluent material is to be applied on the wall 412, and the performance characteristics of the pump 594.

The automated material delivery system 410 according to the present invention is capable of accounting for window and door openings in the wall to be coated 412. Specifically, the processor 582, having been programmed with the coordinates of these openings, calculates when the nozzle will encounter one of these openings based upon knowledge of how far the material delivery system 410 has moved since leaving the starting position. The processor waits for an interrupt or other indication that the mounting system 434 is about to encounter the bottom of a window frame, as at step 612. Once there, the nozzle angulation is adjusted upward, as at step 614. If the window frame continues to the left of the nozzle 420 as determined from the processor's 582 knowledge of the wall 412 or from sensor input (step 616), the nozzle 420 is moved over to the left, the upper flap 534 is retracted (swung out of the way), the lower flap 536 is extended (swung into position), and downward movement is commenced (step 618). Note that in an alternative embodiment, the processor 582 receives input from sensors which indicate the proximity of windows and/or doors, as previously discussed.

If the window frame does not continue to the left of the current nozzle 420 position, the nozzle will be in the middle of the wall 412. In order to start depositing a new swath of fluent material at the top or bottom of the wall 412, the pump must be stopped and the flaps 534, 536 retracted, as in step 620. If the portion of the wall 412 above the window has already been coated, the nozzle mounting assembly 434 is moved to the left to the next swath to be coated, down to the bottom of the wall 412, the nozzle 420 is angled downward, and the upper flap 534 is extended. The pump 594 is then restarted and the nozzle 420 moved upward (steps 620, 622).

If the upper portion of wall 412 above the window has not been coated already, then the nozzle mounting system 434 is moved to the top of the wall 412 and to the rightmost portion which has not yet been coated. The nozzle 420 is already angled upward. The lower flap 5346 is extended, the pump 594 started, and the mounting system 434 is moved downward (see steps 620, 624).

If the nozzle mounting system 434 is not approaching the bottom of a window, it is determined whether it is approaching the top of a wall window or door, as at step 630. If so, the nozzle 420 is angled downward (step 632) before establishing whether the window or door frame continues to the left of the nozzle mounting system (step 634). If it does, the system 434 is moved to the left to deposit the next swath of fluent material, the lower flap 536 is retracted, the upper flap 534 is extended, and the system 434 is moved vertically upward along the vertical support column 422 (step 636).

If the window or door frame does not continue to the left of the nozzle mounting system's 434 current position, the pump is stopped and the flaps are retracted for nozzle mounting system repositioning, as at step 638. If a portion of the wall 412 below a window has already been coated (step 640), the system 434 is moved one increment to the left and to the bottom of the wall 412, as described with respect to step 622. If this lower wall portion has not been coated already, the system 434 is moved to the lower right corner of this uncoated wall portion, where the upper flap 534 is extended, the pump 594 is restarted, and the system 434 is translated upward, as indicated at step 642.

If the processor 582 determines that the system 434 is not approaching the top of a window or door frame, it checks whether the top of the wall 412 is being approached, as at step 644. If so, the upper flap 534 is retracted and the nozzle is angled upward (step 646). If the automated material delivery system 410 is not finishing a portion of the wall 412 above a window or door, the nozzle mounting system 434 is moved one increment to the left, the lower flap 536 is extended, and downward movement of the nozzle 420 is commenced (steps 648, 650).

However, if a portion above a window or door has been coated, the processor 582 determines whether the corresponding lower portion of the wall below a window has been coated (step 652). If yes, the material delivery system 410 proceeds to the left as usual (see step 650). If not, the pump 594 is stopped and the nozzle 420 is angled downward (step 654). The nozzle mounting system 434 is then repositioned to the bottom right corner of the wall portion under the window which has not been coated yet. The upper flap 534 is extended, the pump 594 is restarted, and the system 434 is moved upward again (step 642).

Finally, if the processor 582 establishes that the system 434 is not approaching the top of the wall 412, the processor 582 determines whether the bottom of the wall 412 is being approached (step 660). If not, the processor continues to check whether the system 434 is approaching any of the above mentioned boundaries. If the bottom of the wall 412 is being approached, however, the processor 582 commands the lower flap 536 to retract and commands the nozzle 420 angle to a downward pointing position (step 662).

If the automated material delivery system 410 is not finishing a wall portion below a window (step 664), the processor 582 moves the nozzle mounting system 434 left one increment, extends to upper flap 534, and commands upward vertical movement of the system 434 (step 666).

If the delivery system 410 is finishing a wall portion below a window (step 664) but determines that the upper portion of the wall above the window is already done (step 668), then the processor 582 again moves the mounting system 434 one increment to the left, extends the upper flap 534, and commands vertical motion (step 666). However, if the portion of the wall above the window has not been coated, the pump 594 is stopped, and the nozzle 420 is angled upward (step 670). Then, the nozzle mounting system 434 is moved to the top of the wall above the next uncoated swath, where the lower flap 536 is extended, the pump 594 is restarted, and the nozzle mounting system 434 is moved downward (step 624).

In one embodiment of the present material delivery system, the processor also controls annunciators such as warning lights and sirens or buzzers to alert personnel in the area that the system is, or is about to be, in motion.

As noted previously, in another embodiment of the present invention, a protective bracket 150 is provided to the lower brace 424 of the material delivery system 410 via clamps 154 to protect elements attached to the brace 24, as illustrated in FIGS. 20A and 20B with respect to the lower brace 24 of the wall finishing system 10.

In a further alternative embodiment to the structural support illustrated in FIGS. 16A and 16B, each strut 124 and intermediate strut 132 combination is attached at a common cross-over point 136 which is selectively locatable along one of the two secondary struts 137 which form the X-shaped structure 130, as shown in FIG. 47. Further, the configuration of the X-shaped structure is alterable among a number of fastener holes 133 in the secondary struts 137 and the cross-member 139 depending upon factors such as distance to the wall being supported, angle of the secondary struts 137 with respect to horizontal, and expected load on the support system.

Further illustrated in FIG. 47 are turnbuckles 131 disposed on lower ends of the strut 124 and intermediate strut 132. These turnbuckles enable the proper tensioning of the support system, thus avoiding uneven material delivery and trowelling.

The presently disclosed nozzle 420 has been described in an illustrative embodiment of a material delivery system 410 which includes a vertically oriented support column 422 traveling along horizontally disposed brackets. This embodiment is particularly suited for use with standard, vertical walls. However, in alternative embodiments, the support column 422 is suspended between brackets disposed proximate a variety of surfaces. For example, the present system finds utility in applying fluent material to floor or ceiling surfaces, as well as undulating or otherwise non-planar surface such as the interior or exterior of holding tanks, swimming pools or the like.

The present invention is also embodied in a system having a dynamically adjustable support column, such that the distance between the upper and lower brackets is not constant and the nozzle support system adjusts accordingly.

These and other examples of the concept of the invention illustrated above are intended by way of example and the actual scope of the invention is to be determined from the following claims.

What is claimed is:

1. A material delivery system for applying fluent material to a receiving surface, the system comprising:

a support structure disposed on said surface;

a nozzle support member suspended from said support structure;

a nozzle disposed on said nozzle support member and having an outlet end proximate said surface and an opposite inlet end;

a first motor disposed on said nozzle support member for translating said nozzle support member in a first direction along said support structure and substantially parallel said surface;

a second motor disposed on said nozzle support member for translating said nozzle in a second direction along said support structure and substantially orthogonal first direction and substantially parallel said surface;

a third motor disposed on said nozzle support member for translating said inlet end of said nozzle in an arcuate path centered about said outlet end; and a controller in communication with said first, second and third motors.

2. The system according to claim 1, wherein said support structure comprises:

an upper bracket disposed along an upper edge of said surface, said upper bracket having a channel disposed therein; and a lower bracket disposed along a lower edge of said surface, said lower bracket having a ridge element formed therein, said ridge element comprised of an arcuate portion and an underlying planar portion, said upper and lower brackets each having a toothed drive track extending along the respective bracket.

3. The system according to claim 2, wherein said support structure further comprises plural struts extending away from said upper bracket to a floor surface on a side of said surface opposite said nozzle support member.

4. The system according to claim 2, wherein said support structure comprises:

a support column suspended between said upper and lower brackets, said support column substantially equidistant from said surface along the length of the column and having upper and lower ends.

5. The system according to claim 4, wherein said support column is further comprised of a lower brace member disposed at said lower end of said support column and having at least one lower wheel, said at least one lower wheel having a groove disposed in a circumferential surface thereof for travel on a cooperative arcuate portion of said lower bracket.

6. The system according to claim 5, wherein said lower brace member is further Comprised of at least one follower wheel proximate a respective one of said at least one lower wheel for travel adjacent said cooperative arcuate portion of said lower bracket.

7. The system according to claim 4, wherein said support structure further comprises an upper mounting portion disposed proximate said upper end of said support column.

8. The system according to claim 7, wherein said upper mounting portion further comprises at least one upper follower wheel extending from said upper mounting portion and into said channel.

9. The system according to claim 7, wherein said support structure further comprises a drive shaft substantially parallel to said support column and rotated by said first drive, said drive shaft having an upper drive gear assembly at an upper end thereof and a lower drive gear at a lower end thereof.

10. The system according to claim 9, wherein said upper drive gear assembly comprises:

a first upper gear disposed at said upper end of said drive shaft;

an idler gear disposed on said upper mounting portion in communication with said first upper gear; and a second upper gear disposed at said upper mounting portion in communication with said idler gear and with said upper bracket drive track, wherein rotation of said drive shaft by said first motor causes translation of said system with respect to said surface in said first direction.

11. The system according to claim 9, wherein said lower drive gear is in communication with said lower bracket drive track, and wherein rotation of said drive shaft by said first motor causes translation of said system with respect to said surface in said first direction.

12. The system according to claim 4, wherein said nozzle support member further comprises:

a first pair of support column tracking wheels disposed on a first pair bracket, each wheel of said first pair circumferentially grooved and disposed on a side of said support column opposite another of said first pair;

a second pair of support column tracking wheels disposed on a second pair bracket, each wheel of said second pair circumferentially grooved and disposed on a side of said support column opposite another of said second pair; and an interconnecting plate disposed between said first and second pair brackets, wherein said first pair of support column tracking wheels is disposed above said nozzle and said second pair of support column tracking wheels is disposed below said nozzle.

13. The system according to claim 12, wherein said nozzle comprises:

an oblong funnel disposed on said at last one interconnecting plate and oriented with a divergent end proximate said surface and an opposite convergent end, wherein said oblong funnel defines said nozzle outlet end;

a swivel joint disposed at said convergent end of said oblong funnel;

a nozzle body having an anterior end and a posterior end, said anterior end rotatably mounted to said swivel joint, and said posterior end of said nozzle body defining said nozzle inlet end;

a fluent material transport chamber defined by said oblong funnel, said swivel joint, and said nozzle body, said chamber thus extending from said nozzle body posterior end to said oblong funnel divergent end proximate said surface; and end plates disposed on opposite sides of said nozzle, wherein one of said end plates is attached to said interconnecting plate.

14. The system according to claim 13, wherein said nozzle support member further comprises:

a lifter arm having a lower end disposed on one of said end plates and having an upper end extending above said nozzle body, said lifter arm lower end in mechanical communication with said third motor for extension and contraction of said lifter arm; and a lifting link disposed between said nozzle inlet end and said lifter arm upper end, wherein extension of said lifter arm by said third motor results in elevation of said nozzle inlet end relative to said nozzle outlet end, and contraction of said lifter arm by said third motor results in lowering said nozzle inlet end relative to said nozzle outlet end.

15. The system according to claim 14, wherein said nozzle further comprises:

an upper actuator disposed on one of said end plates above said nozzle;

an upper actuator linkage mechanically connected to said upper actuator; and an upper flap rotatably connected to a top edge of said funnel divergent end and rotated by said upper actuator via said upper actuator linkage.

16. The system according to claim 14, wherein said nozzle further comprises:

a lower actuator disposed on one of said end plates below said nozzle;

a lower actuator linkage mechanically connected to said lower actuator; and a lower flap rotatably connected to a bottom edge of said funnel divergent end and rotated by said lower actuator via said lower actuator linkage.

17. The system according to claim 13, wherein said oblong funnel further comprises a side dam disposed on and extending from said oblong funnel divergent end toward said surface and between upper and lower edges of said funnel divergent end.

18. The system according to claim 17, wherein said side dam is resiliently mounted on said oblong funnel to allow said side dam to be urged upward and downward with respect to said oblong funnel.

19. The system according to claim 13, wherein said nozzle further comprises:

a plurality of first conduits disposed at said nozzle body posterior end; and a plurality of second conduits-disposed at said nozzle body anterior end, wherein said first and second conduits each have an entrance port and an exit port.

20. The system according to claim 19, wherein said entrance and exit ports of each of said first and second conduits are radially offset, wherein gas introduced through said conduits spirals within said chamber as said gas progresses from said nozzle inlet end to said nozzle outlet end.

21. The system according to claim 19, wherein said nozzle further comprises:

at least one posterior end plenum surrounding said entrance ports of said first conduits; and at least one anterior end plenum surrounding said entrance ports of said second conduits.

22. The system according to claim 12, wherein said nozzle support member further comprises:

a threaded orifice in at least one of said first and second pair brackets;

a vertical screw shaft engaged within said threaded orifice and in mechanical communication with said second motor, wherein operation of said second motor in a first mode causes said vertical screw shaft to translate said nozzle support member toward said support column upper end and operation of said second motor in a second mode causes said vertical screw shaft to translate said nozzle support member toward said support column lower end.

23. The system according to claim 1, wherein said controller is comprised of a processor, an associated memory and a display.

24. The system according to claim 23, wherein said system further comprises an air compressor supplying compressed air to said nozzle via said at least one posterior end plenum and said at least one anterior end plenum.

25. The system according to claim 1, wherein said system further comprises a tracked vehicle proximate said system.

26. The system according to claim 25, wherein said tracked vehicle comprises:

a platform;

a cabin disposed on said platform and containing a controller for controlling said system;

an air compressor disposed on said platform providing a source of compressed air to said nozzle;

a pump disposed on said platform providing a source of pressurized fluent material to said nozzle; and a generator disposed on said platform providing power for said pump.

27. The system according to claim 25, wherein said tracked vehicle is propelled by a pneumatic motor using compressed air from said air compressor.

28. The system according to claim 26, wherein said pump supplies fluent material to said inlet end of said nozzle via a high pressure hose.

29. The system according to claim 28, wherein said high pressure hose is suspended from said tracked vehicle.

30. A wall finishing material application system for providing an even surface of solidifiable fluent material to a vertical wall, said system comprising:

an upper bracket disposed proximate an upper edge of said wall;

a lower bracket disposed proximate a lower edge of said wall and parallel to said upper bracket;

a vertical support structure suspended from said upper and lower brackets and parallel to a first plane defined by said wall, said vertical support structure disposed on said upper and lower brackets for horizontal translating along said wall;

a nozzle having an outlet end proximate said wall and an inlet end away from said wall, said nozzle having a neutral position lying substantially within a second horizontal second plane orthogonal to said first plane defined by said wall, said nozzle rotatable about said outlet end above and below said horizontal plane, said nozzle disposed on said vertical support structure for vertical translation along said wall;

a first drive disposed on said vertical support structure for horizontally translating said vertical support structure across said wall in a first direction of motion;

a second drive disposed on said vertical support structure for vertically translating said nozzle in a second direction of motion;

a third drive disposed on said vertical support structure for rotating said nozzle inlet end about said nozzle outlet end; and a controller for controlling operation of said first, second and third drives.

31. The system according to claim 30, wherein said upper bracket further comprises a system of struts disposed on a side of said wall opposite said vertical support structure.

32. The system according to claim 30, wherein said vertical wall comprises:

a planar, intermediate styrofoam layer;

two planar, opposing wire mesh layers, said styrofoam layer disposed between and coplanar with said wire mesh layers, and a plurality of linear cross-members, each of said cross-members having two ends, each of said two ends fastened to one of said two wire mesh layers, said cross-members passing through said styrofoam layer.

33. The system according to claim 30, wherein said vertical support structure comprises:

a vertical support column having an upper end and a lower end;

a horizontal lower brace disposed proximate said vertical support column lower end and parallel said first plane; and an upper mounting plate disposed proximate said upper end of said vertical support column.

34. The system according to claim 33, wherein said upper bracket comprises a horizontal upper drive track having regularly spaced teeth.

35. The system according to claim 34, wherein said first drive comprises:

a vertical drive shaft parallel said vertical support column;

a first motor rotating said vertical drive shaft; and an upper drive gear assembly disposed on said upper mounting plate and actuated by rotation of said vertical drive shaft, said upper drive gear assembly having teeth in cooperative engagement with said regularly spaced teeth of said upper drive track.

36. The system according to claim 35, wherein said upper drive gear assembly comprises:

a first upper drive gear disposed on said vertical drive shaft;

an idler gear disposed on said upper mounting plate in mechanical communication with said first upper drive gear; and a second upper drive gear disposed on said upper mounting plate in mechanical communication with said idler gear and said upper drive track, wherein rotation of said vertical drive shaft rotates said second upper drive gear via said first upper drive gear and said idler gear, said second upper drive gear rotation horizontally translating said vertical support structure relative to said upper drive track.

37. The system according to claim 33, wherein said upper bracket further comprises a channel having parallel channel walls.

38. The system according to claim 37, wherein said vertical support structure further comprises at least one upper follower wheel rotatably attached to said upper mounting plate and disposed within said channel for rotation against said channel walls.

39. The system according to claim 33, wherein said lower bracket comprises:

a horizontal lower drive track having regularly spaced teeth; and a ridge surface substantially parallel to said lower drive track, said ridge surface having an arcuate portion and an underlying planar portion.

40. The system according to claim 39, wherein said first drive comprises:

a vertical drive shaft parallel said vertical support column;

a first motor rotating said vertical drive shaft; and a lower drive gear disposed on said vertical drive shaft and having teeth in cooperative mechanical engagement with said regularly spaced teeth of said lower drive track, wherein rotation of said vertical drive shaft rotates said lower drive gear, said lower drive gear rotation horizontally translating said vertical support structure relative to said lower drive track.

41. The system according to claim 39, wherein said lower brace comprises at least one lower wheel having a groove in a circumferential surface thereof, said groove disposed for rolling engagement with said ridge surface arcuate portion.

42. The system according to claim 41, wherein said lower brace further comprises at least one follower wheel associated with a respective one of said at least one lower wheel, said at least one follower wheel extending from said lower brace proximate said respective at least one lower wheel for rolling engagement with said ridge surface underlying planar portion.

43. The system according to claim 33, wherein said nozzle further comprises:

a mounting system disposed between said nozzle and said vertical support column, said mounting system comprised of a first pair of support column tracking wheels disposed on a first pair bracket, each wheel of said first pair circumferentially grooved and disposed on a side of said support column opposite another of said first pair for vertical translation along said support column, a second pair of support column tracking wheels disposed on a second pair bracket, each wheel of said second pair circumferentially grooved and disposed on a side of said support column opposite another of said second pair for vertical translation along said support column, and at least one interconnecting plate disposed between said first and second pair brackets, wherein said first pair of support column tracking wheels is disposed above said nozzle and said second pair of support column tracking wheels is disposed below said nozzle.

44. The system according to claim 43, wherein said second drive further comprises:

a threaded orifice in at least one of said first and second pair brackets;

a vertical screw shaft engaged within said threaded orifice; and a second motor disposed on said vertical support structure in mechanical communication with said vertical screw shaft, wherein operating said second motor in a first mode rotates said vertical shaft in a first direction to elevate said mounting system, and Operating said second motor in a second mode rotates said vertical shaft in a second direction to lower said mounting system.

45. The system according to claim 44, wherein said nozzle further comprises:

an oblong funnel disposed on said at least one interconnecting plate having a divergent end proximate said wall and a convergent end opposite said divergent end, said funnel having a long dimension parallel said lower brace;

a swivel joint disposed at said funnel convergent end, parallel said lower brace;

a nozzle body having an anterior end rotatably attached to said swivel joint and a posterior end opposite said anterior end; and a fluent material transport chamber defined by outer surfaces of said funnel said, said swivel joint, and said nozzle body, said chamber thus extending from said nozzle body posterior end to said funnel divergent end.

46. The system according to claim 45, wherein said mounting system further comprises:

end plates disposed on either side of and mechanically affixed to said nozzle and said at least one interconnecting plate;

a lifter arm having a lower end disposed on one of said end plates and having an upper end extending above said nozzle, said lifter arm lower end in mechanical communication with said third drive for extension and contraction of said lifter arm; and a lifting link disposed between said nozzle body posterior end and said lifter arm upper end, wherein extension of said lifter arm by said third drive results in elevation of said nozzle body posterior end relative to said nozzle body anterior end, and contraction of said lifter arm by said third drive results in lowering said nozzle body posterior end relative to said nozzle body anterior end.

47. The system according to claim 46, wherein said nozzle further comprises:

an upper actuator disposed on one of said end plates above said nozzle;

an upper actuator linkage mechanically connected to said upper actuator; and an upper flap rotatably connected to a top edge of said funnel divergent end and rotated by said upper actuator via said upper actuator linkage, wherein an axis of rotation of said upper flap is parallel said lower brace.

48. The system according to claims 46, wherein said nozzle further comprises:

a lower actuator disposed on one of said end plates below said nozzle;

a lower actuator linkage mechanically connected to said lower actuator; and a lower flap rotatably connected to a bottom edge of said funnel divergent end and rotated by said lower actuator via said lower actuator linkage, wherein an axis of rotation of said lower flap is parallel said lower brace.

49. The system according to claim 46, wherein said funnel further comprises at least one side dam disposed on one of said end plates and extending from said oblong funnel divergent end toward said wall and between upper and lower edges of said funnel divergent end.

50. The system according to claim 49, wherein said at least one side dam is resiliently mounted to allow upward and downward urging of said side dam with respect to said oblong funnel.

51. The system according to claim 45, wherein said nozzle further comprises:

a plurality of first conduits disposed at said nozzle body posterior end; and a plurality of second conduits disposed at said nozzle body anterior end, wherein said first and second conduits each have an entrance port and an exit port providing a flow path through said nozzle body outer surface into said chamber.

52. The system according to claim 51, wherein said entrance and exit ports if each of said first and second conduits are radially offset, wherein has introduced through said conduits spirals within said chamber as said gas progresses through said chamber from said nozzle body posterior end to said funnel divergent end.

53. The system according to claim 51, wherein said nozzle further comprises:

at least one posterior end plenum surrounding said entrance ports of said first air conduits; and at least one anterior end plenum surrounding said input ends of said second air conduits.

54. The system according to claim 53, wherein said at least one anterior end plenum comprises a first plenum disposed on a top surface of said nozzle body and a second plenum disposed on a bottom surface of said nozzle body.

55. The system according to claim 33, wherein said controller is comprised of a processor, an associated memory and a display.

56. The system according to claim 53, wherein said system further comprises a tracked vehicle proximate said wall.

57. The system according to claim 56, wherein said tracked vehicle is propelled by a pneumatic air track motor using compressed air from an air compressor.

58. The system according to claim 56, wherein said tracked vehicle further comprises:

a platform;

a cabin disposed on said platform and housing said controller;

an air compressor disposed on said platform providing a source of compressed air to said nozzle;

a pump disposed on said platform providing a source of pressurized fluent material to said nozzle; and a generator disposed on said platform providing power for said pump.

59. The system according to claim 58, wherein said air compressor supplies compressed air to said nozzle via said at least one posterior end plenum and said at least one anterior end plenum.

60. The system according to claim 58, wherein said pump supplies fluent material to said posterior end of said nozzle body via a high pressure hose.

61. The system according to claim 60, wherein said high pressure hose is suspended from said tracked vehicle.

* * * * *

UNITED STATES PATENT AND TRADEMARK OFFICE

CERTIFICATE OF CORRECTION

PATENT NO. : 5,660,635

DATED : August 26, 1997

INVENTOR(S) : CAROL JACQUES

It is certified that error appears in the above-identified patent and that said Letters Patent is hereby corrected as shown below:

In the Abstract, line 8, reads "System nozzle" should read --system nozzle--

In the Abstract, line 8, reads "angled With respect" should read --angled with respect--

Column 5, line 31, reads "upon various load-bearing requirements" should read --upon various factors relating to wall location, thickness, composition, and load-bearing requirements--

Column 6, line 6, reads "by Conventional means" should read --by conventional means--

Column 22, line 3, reads "actuator 540, is a" should read --actuator 540, 542 is a--

Column 26, line 54, reads "interface. 580 can" should read --interface 580 can--

Column 28, line 29, reads "yet caught" should read --get caught--

Column 28, line 35, reads "a ruled, vertical" should read --a rugged, vertical--

UNITED STATES PATENT AND TRADEMARK OFFICE

CERTIFICATE OF CORRECTION

PATENT NO. : 5,660,635

DATED : August 26, 1997

INVENTOR(S) : CAROL JACQUES

It is certified that error appears in the above-identified patent and that said Letters Patent is hereby corrected as shown below:

Column 29, line 63, reads "Oriented at the" should read --oriented at the--

Column 33, line 12, reads "further Comprised" should read --further comprised--

Column 38, line 12, reads "and Operating" should read --and operating--

Column 39, line 27, reads "wherein has introduced" should read --wherein gas introduced--

Signed and Sealed this

Twenty-third Day of March, 1999

*Attest:*

*Attesting Officer*

Q. TODD DICKINSON

*Acting Commissioner of Patents and Trademarks*